US008671482B2

(12) United States Patent
Willingham

(10) Patent No.: US 8,671,482 B2
(45) Date of Patent: Mar. 18, 2014

(54) METHOD AND APPARATUS FOR DYNAMICALLY CORRECTING POSTURE

(75) Inventor: William Preston Willingham, Park City, UT (US)

(73) Assignee: Backjoy Orthotics, LLC, Boulder, CO (US)

( * ) Notice: Subject to any disclaimer, the term of this patent is extended or adjusted under 35 U.S.C. 154(b) by 157 days.

(21) Appl. No.: 13/145,899

(22) PCT Filed: Jan. 22, 2010

(86) PCT No.: PCT/US2010/021881

§ 371 (c)(1),
(2), (4) Date: Jul. 22, 2011

(87) PCT Pub. No.: WO2010/085707

PCT Pub. Date: Jul. 29, 2010

(65) Prior Publication Data

US 2011/0277246 A1 Nov. 17, 2011

Related U.S. Application Data

(60) Provisional application No. 61/147,053, filed on Jan. 23, 2009.

(51) Int. Cl.

| | |
|---|---|
| ***B68G 5/00*** | (2006.01) |
| ***A47C 20/00*** | (2006.01) |
| ***A47C 7/02*** | (2006.01) |
| ***A47C 3/02*** | (2006.01) |

(52) U.S. Cl.
USPC ..... 5/653; 297/452.21; 297/452.23; 297/258.1; 5/630

(58) Field of Classification Search
USPC ..... 5/630, 632, 640, 648, 652, 653, 657, 5/691, 705, 722, 723; 297/258.1, 297/452.23–452.25
See application file for complete search history.

(56) References Cited

U.S. PATENT DOCUMENTS 1,716,871 A * 6/1929 Weldon ..... 297/452.25
3,138,404 A 6/1964 Newton (Continued)

FOREIGN PATENT DOCUMENTS

| | | |
|---|---|---|
| JP | 10-080928 | 3/1998 |
| WO | 2008068988 A1 | 6/2008 |
| WO | 2011090505 | 7/2011 |

OTHER PUBLICATIONS

European Search Report and Search Opinion dated Jun. 1, 2012 for International Application No. EP 10733947.5 from European Patent Office, pp. 1-5, Munich, Germany.

(Continued)

*Primary Examiner* — William Kelleher
*Assistant Examiner* — David R Hare
(74) *Attorney, Agent, or Firm* — Michael Zarrabian, Esq.; Sherman & Zarrabian LLP

(57) ABSTRACT

An orthopedic device for improving posture while sitting, having a foundation member including a front portion for upper legs and a bowl portion for lower pelvic area. The bowl portion has a central portion and an upwardly inclined lateral portion. The lateral portion and the front portion collectively surround the central portion. The central portion has regions of varying flexibility and the lateral portion has regions of varying flexibility. The bowl portion applies an upwardly and inwardly compressive force when the lower pelvic area is disposed in the bowl portion, and rotates on a supporting surface between a first position when the lower pelvic area is not disposed in the bowl portion, and a second position, rotationally forward of the first position, when the lower pelvic area is disposed in the bowl portion, to thereby cause a forward rotational tilting of the lower pelvic area into a forward lordotic position after the lower pelvic area is placed in the bowl portion.

27 Claims, 48 Drawing Sheets

(56) References Cited

U.S. PATENT DOCUMENTS

| | | | | |
|---|---|---|---|---|
| 3,376,070 | A * | 4/1968 | Johnson | 297/452.26 |
| 3,463,547 | A | 8/1969 | Brennan et al. | |
| 4,962,964 | A | 10/1990 | Snodgrass | |
| 5,163,737 | A * | 11/1992 | Navach et al. | 297/452.25 |
| 5,419,615 | A | 5/1995 | Dozsa-Farkas | |
| 5,456,519 | A | 10/1995 | Davis | |
| 5,887,951 | A * | 3/1999 | Willingham | 297/452.23 |
| 5,997,095 | A * | 12/1999 | Powell et al. | 297/452.23 |
| 6,183,043 | B1 | 2/2001 | Nelson | |
| 6,299,248 | B1 | 10/2001 | Gennaro et al. | |
| 6,336,895 | B1 * | 1/2002 | Dukes | 482/140 |
| 7,201,446 | B2 | 4/2007 | Massara et al. | |
| 7,395,566 | B2 | 7/2008 | Hetzel et al. | |
| 7,607,738 | B2 * | 10/2009 | Gregory et al. | 297/452.23 |
| 7,621,860 | B2 | 11/2009 | Burrell | |
| 2007/0028385 | A1 * | 2/2007 | Hetzel et al. | 5/653 |
| 2007/0057562 | A1 | 3/2007 | Gregory et al. | |
| 2008/0074866 | A1 | 3/2008 | Barker et al. | |
| 2012/0299350 | A1 | 11/2012 | Willingham | |

OTHER PUBLICATIONS

International Preliminary Report on Patentability and Written Opinion dated Aug. 2, 2012 for International Application No. PCT/US2010/042785, from the International Bureau of WIPO, pp. 1-12, Geneva, Switzerland.

International Search Report and Written Opinion dated Sep. 10, 2012 for International Application No. PCT/US2010/042785, from the International Search Authority, pp. 1-13, Alexandria, United States.

International Preliminary Report on Patentability and Written Opinion dated Aug. 4, 2011 for International Application No. PCT/US2010/021881, filed Jan. 22, 2010 from the International Bureau of WIPO, pp. 1-9, Geneva, Switzerland.

Japanse Office Action dated Dec. 18, 2012 for Japanese Application No. 548159/2011 from Japanese Patent Office, pp. 1-5, Tokyo, Japan [English-language translation attached, 8 pages.]

Notification of Transmittal of the International Searching Authority, International Search Report dated Mar. 29, 2010 for International Application No. PCT/US2010/021881, filed Jan. 22, 2010, pp. 1-4, Alexandria, United States.

Written Opinion of the International Searching Authority dated Mar. 29, 2010 for International Application No. PCT/US2010/021881, filed Jan. 22, 2010, pp. 1-10, Alexandria, United States.

Canadian Office Action dated Apr. 3, 2013 for Canadian Application No. 2,750,303 from Canadian Intellectual Property Office, pp. 1-3, Canada.

U.S. Non-Final Office Action for U.S. Appl. No. 13/574,219 mailed Apr. 5, 2013.

* cited by examiner

Kyphotic
lumbar spine

Lordotic
lumbar spine

METHOD AND APPARATUS FOR DYNAMICALLY CORRECTING POSTURE

CROSS-REFERENCE TO RELATED APPLICATION

This application is the U.S. National Phase patent application under 35 U.S.C. §371 of International Application No. PCT/US2010/021881 (published as WO 2010/085707 A1), filed on Jan. 22, 2010, which claims priority from U.S. Provisional Patent Application Ser. No. 61/147,053 filed on Jan. 23, 2009. Both applications, PCT/US2010/021881 and U.S. Application Ser. No. 61/147,053, are incorporated herein by reference in their entirety.

FIELD OF THE INVENTION

The present invention in general to orthosis and in particular to a seating orthosis.

BACKGROUND OF THE INVENTION

Chairs and sofas are typically constructed from posterior and lumbar supporting assemblies having generally a frame with a plurality of springs, a cushion or pad which rests on the springs, and an upholstery cover. These assemblies, although flexible due to their spring construction, assume a predetermined fixed shape which requires that for maximum comfort, persons using such furniture must adjust their body positions relative to these assemblies.

There are many ergonomic supports in the nature of chairs, sofas and the like which include flexible and resilient supporting portions which conform to the body to provide comfort. All of these posterior and lumbar supporting sitting surfaces, whether contoured or non-planar, have the ability to form a plurality of cantilevers which automatically adjust and conform to human body movement without mechanical parts, as opposed to adjusting the human body to conform to the supporting portion of the seating surface.

It is now understood that gluteal spreading, commonly known as "secretary spread" is as injurious to the pelvis and spine as incorrect posture. No matter how comfortable an ergonomic seating device is, continuous sitting on anthropometrically measured seating devices will in most humans result in repetitive stress injuries to the back. U.S. Pat. No. 5,887,951 provides a seating device having a uniform thickness member providing support for a user's pelvic area.

BRIEF SUMMARY OF THE INVENTION

The present invention provided a method and apparatus for improving posture while sitting. In one embodiment, the present invention provides an orthopedic device for improving posture while sitting, the orthopedic device, comprising a foundation member comprising a front portion configured to receive a user's upper legs and a bowl portion configured to receive a user's lower pelvic area, the bowl portion comprising a central portion and an upwardly inclined lateral portion. The lateral portion and the front portion collectively surround the central portion.

The central portion has plural regions of varying flexibility and the lateral portion has plural regions of varying flexibility, the bowl portion configured for applying an upwardly and inwardly compressive force when the lower pelvic area of the user is disposed in the bowl portion.

The bowl portion is configured to rotate on a supporting surface between a first position when the user's lower pelvic area is not disposed in the bowl portion, and a second position, rotationally forward of the first position, when the user's lower pelvic area is disposed in the bowl portion, to thereby cause a forward rotational tilting of the user's lower pelvic area into a forward lordotic position after the lower pelvic area is placed in the bowl portion.

In another embodiment the present invention provides a process for correcting posture while sitting using orthopedic device.

Other aspects and advantages of the present invention will become apparent from the following detailed description, which, when taken in conjunction with the drawings, illustrate by way of example the principles of the invention.

DETAILED DESCRIPTION OF THE INVENTION

The present invention provides a method and apparatus for correcting posture and restricting gluteal spreading. One embodiment an apparatus according to the invention comprises an orthopedic device for improving posture while sitting. The orthopedic device comprises a foundation member including a front portion configured to receive a user's upper legs, and a bowl portion configured to receive a user's lower pelvic area, the bowl portion comprising a central portion and an upwardly inclined lateral portion, wherein the lateral portion and the front portion collectively surround the central portion. The central portion has plural regions of varying (i.e., different) flexibility and the lateral portion has plural regions of varying flexibility. The bowl portion configured for applying an upwardly and inwardly compressive force when the lower pelvic area of the user is disposed in the bowl portion.

The bowl portion is configured to rotate on a supporting surface between a first position when the user's lower pelvic area is not disposed in the bowl portion, and a second position, rotationally forward of the first position, when the user's lower pelvic area is disposed in the bowl portion, to thereby cause a forward rotational tilting of the user's lower pelvic area into a forward lordotic position after the lower pelvic area is placed in the bowl portion. Example implementations of the orthopedic device according to the invention are described below.

Figure 1A:
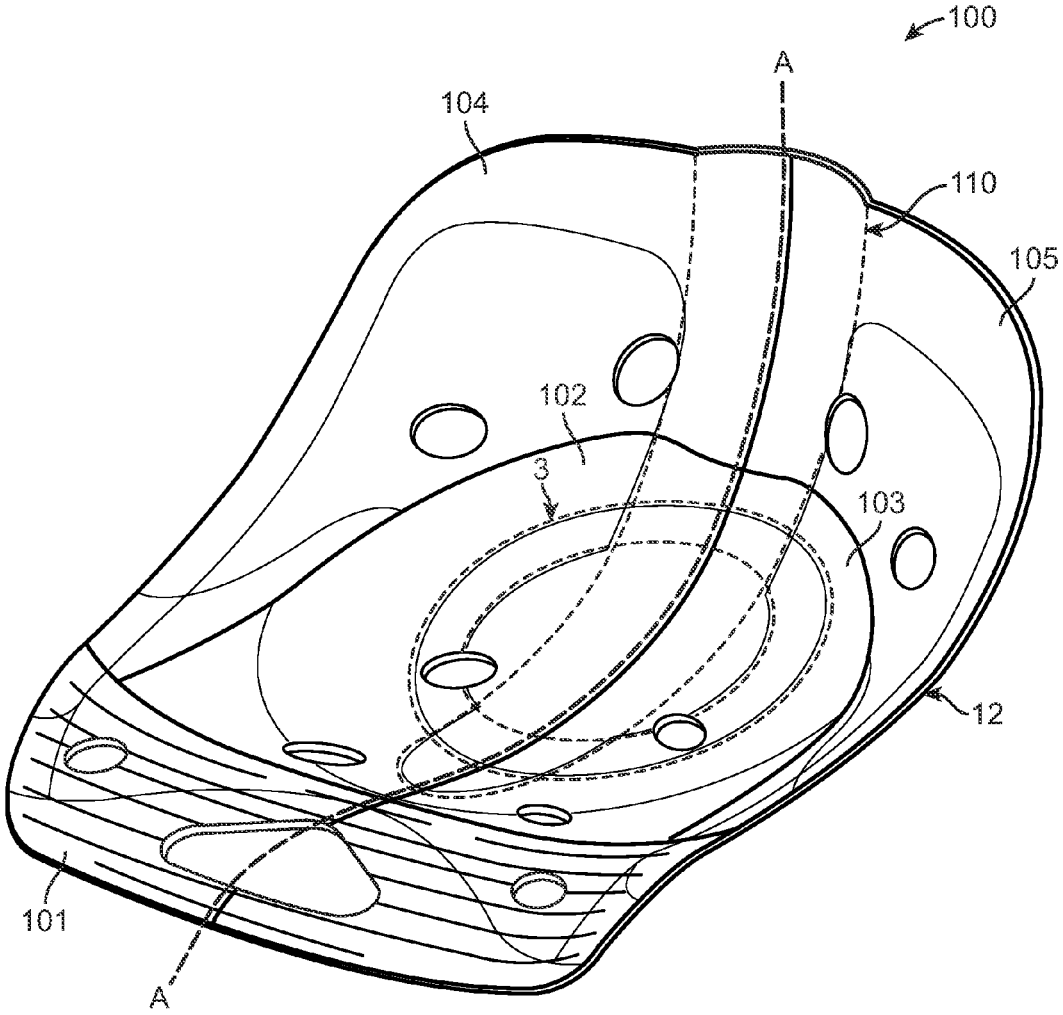
FIG. 1*a* shows a perspective view of a seating apparatus for correcting posture and restricting gluteal spreading in a human user, the seating apparatus having multiple varying thickness sections, according to an embodiment of the invention.
Figure 9:
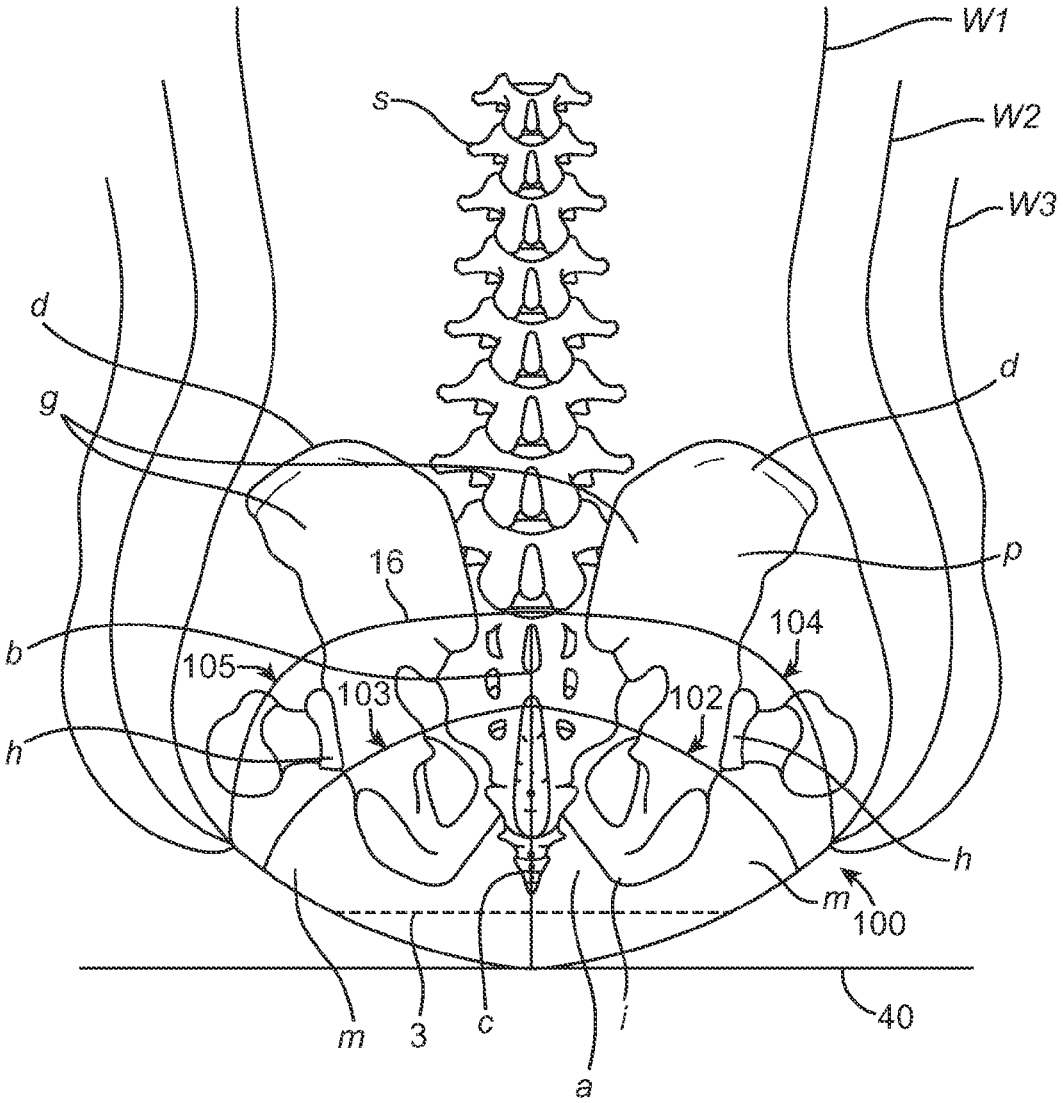
FIG. 9 shows a rear view of the seating apparatus of FIG. 1*a* with anatomy of the user seated in the seating apparatus, according to an embodiment of the invention.

FIG. 1*a* shows an example implementation of an orthopedic seating device (seating orthosis) 100 according to the invention, intended to be utilized by a seated user, which provides a forward tilting of the entire pelvis of the seated user as well as cupping and cradling effect around the lower pelvis and ischial tuberosities of the seated user. The ischial tuberosities are indicated at i in FIG. 9. Parts or components of the pelvic area depicted in FIG. 9 are as follows: a pubic arch, b sacrum, c coccyx, d crest of the ilium, f symphysis pubis crest, g posterior pelvic girdle, h hip socket, i ischial tuberosities, m muscle tissue, p pelvis, s spine, t thigh, w soft tissues of various widths.

In the perspective view shown in FIG. 1*a*, the device 100 comprises a foundation member 12. The device 100 further includes a padding layer 13 (FIG. 15), such as foam, on top of the foundation member 12. The padding layer 13 is only shown in FIG. 15 for clarity of depictions of the foundation member 12 in other figures.

The foundation member 12 comprises a front portion comprising at least one front section 101 configured to receive a user's upper legs. The foundation member further comprises a central portion comprising a pair of adjacent central sections 102 and 103. The foundation member further comprises a lateral portion comprising a pair of upwardly inclined, partially adjacent, lateral sections 104 and 105, flanking and partially surrounding the central sections 102 and 103.

Figure 4A:
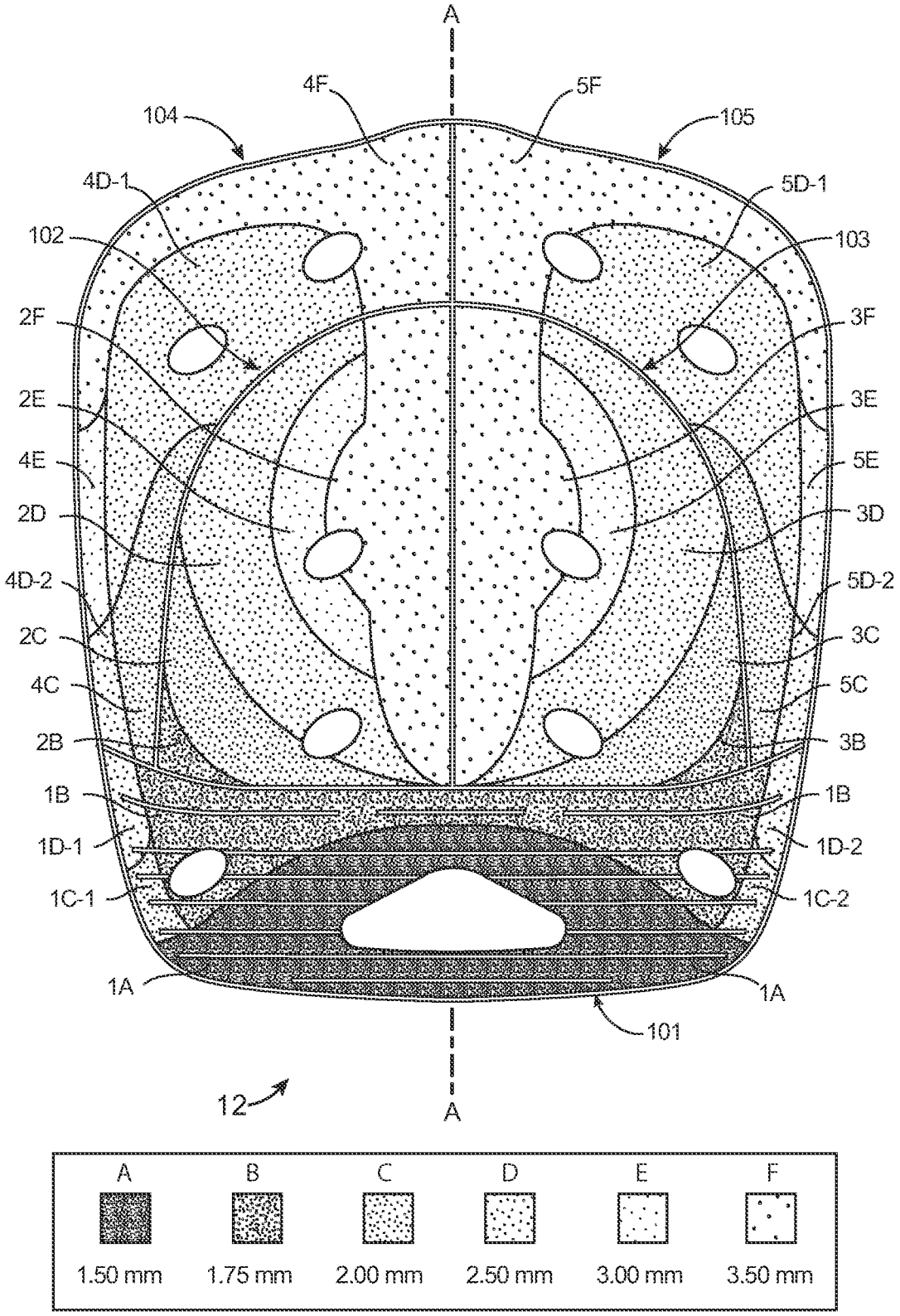
FIG. 4*a* shows an aerial top view of the seating apparatus of FIG. 1*a*, indicating varying thickness regions in the sections of the foundation member of the seating apparatus, according to an embodiment of the invention.

FIG. 4*a* shows an aerial top view of the foundation member 12, indicating varying thickness regions in the sections 101-105 of the foundation member 12. Each of the central sections 102 and 103 has plural regions of varying flexibility and each of the lateral sections 104 and 105 has plural regions of varying flexibility (FIG. 4*a*). The lateral sections 104, 105, and the front section 101 collectively surround the central sections 102 and 103, such that the central portion and the lateral portion together form a bowl portion 20 (generally indicated in FIGS. 8*a*, 8*b*, 10*b*). The bowl portion 20 is generally formed by sections 102, 103, 104 and 105. The bowl portion is configured to receive a user's lower pelvic area and to apply an upwardly and inwardly compressive force when the lower pelvic area of the user is disposed in the bowl portion.

Figure 1B:
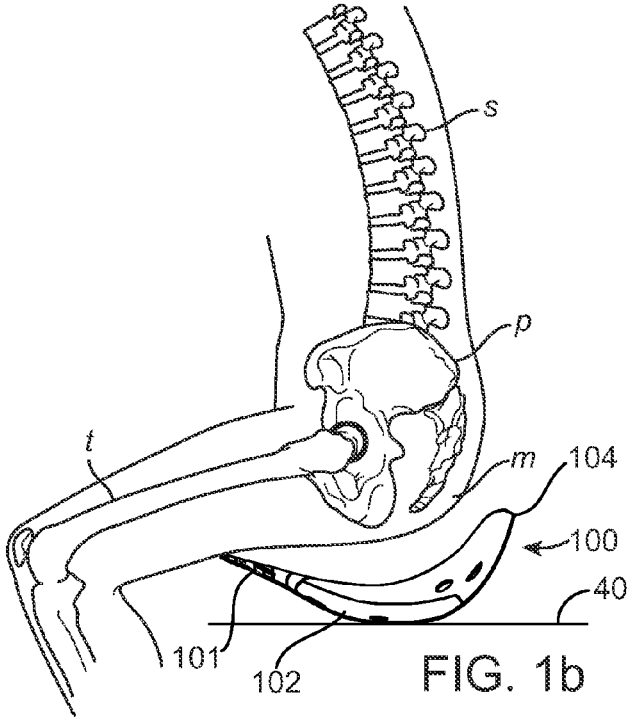
FIG. 1*b* shows a right side view of the seating apparatus of FIG. 1*a* on a supporting surface, with a representation of anatomy of a user in the act of sitting, approaching the seating apparatus, according to an embodiment of the invention.
Figure 1C:
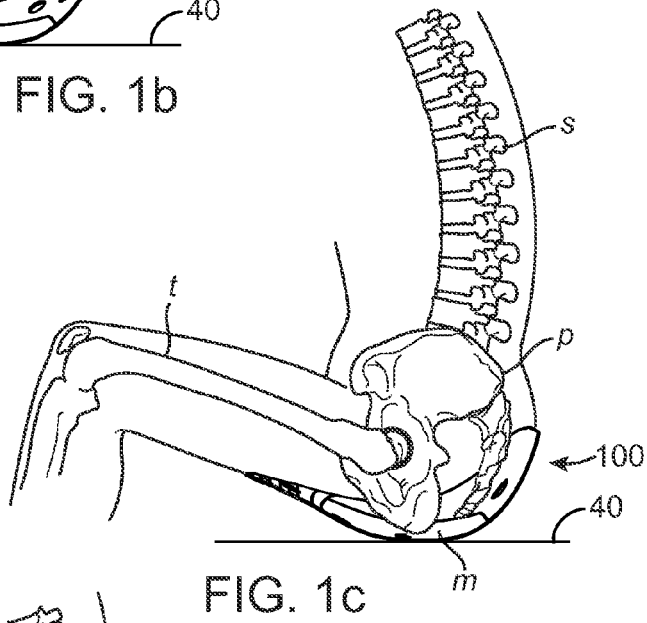
FIG. 1*c* shows a right side view of the apparatus of FIG. 1*b* with the user touching the seating apparatus, according to an embodiment of the invention.

FIG. 1*b* shows a right side view of the device 100 on a supporting surface 40, with a representation of anatomy of a user in the act of sitting, approaching the device 100. In FIG. 1*b*, the device 100 is in the first position (i.e., non-weight bearing position). FIG. 1*c* shows a transitional state with the user touching the device, continuing the act of sitting and continuing transfer of body weight to the device 100.

Figure 1D:
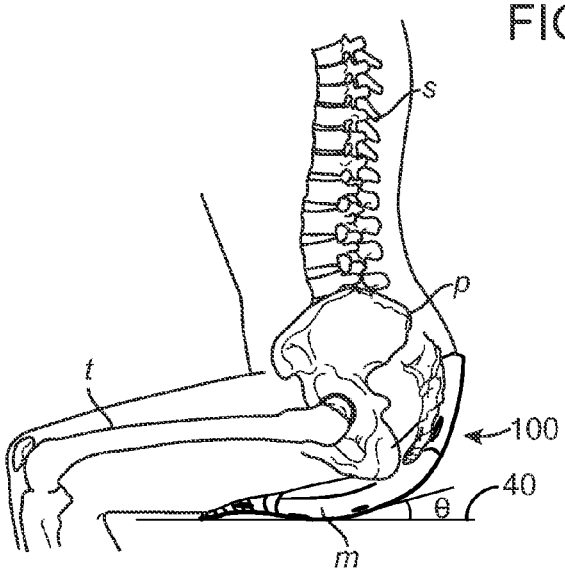
FIG. 1*d* shows a right side view of the apparatus of FIG. 1*c* with the user filling the seating apparatus until a secondary shape is achieved and a full forward lordosis of the pelvis and spine is achieved, according to an embodiment of the invention.

The bowl portion is further configured to rotate on a supporting surface 40 between a first position (FIG. 1*b*) when the user's lower pelvic area is not disposed in the bowl portion, and a second position (FIG. 1*d*), rotationally forward of the first position, when the user's lower pelvic area is disposed in the bowl portion, to thereby cause a forward rotational tilting of the user's lower pelvic area by an angle θ into a forward lordotic position after the lower pelvic area is placed in the bowl portion. FIG. 1*d* shows the user having completed the act of sitting the device 100, filling the device 100 with gluteus muscles of the user in the lower pelvic area, until a secondary shape is achieved and a full forward lordosis of the pelvis and spine is achieved, according to the invention. In FIG. 1*d*, the device 100 is in the second position (i.e., weight bearing position).

Figure 2A:
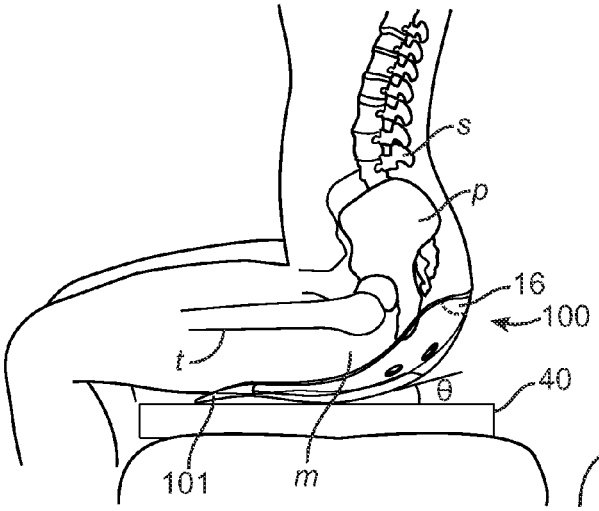
FIG. 2*a* shows a side view of a user seated on the seating apparatus of FIG. 1*a* disposed on a hard supporting surface, wherein the seating apparatus is in a weight bearing position, according to an embodiment of the invention.
Figure 2B:
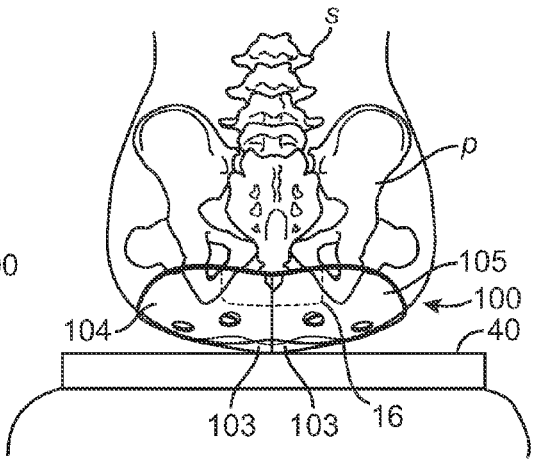
FIG. 2*b* shows a rear anatomical view of a user seated on the seating apparatus of FIG. 2*a*, according to an embodiment of the invention.
Figure 2C:
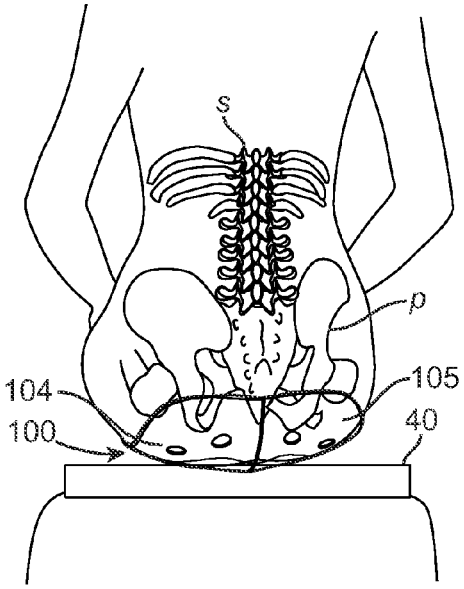
FIG. 2*c* shows a rear anatomical view of a user with twisting spine seated on the seating apparatus of FIG. 1*a* with the seating apparatus in torsion on its axis, according to an embodiment of the invention.
Figure 2D:
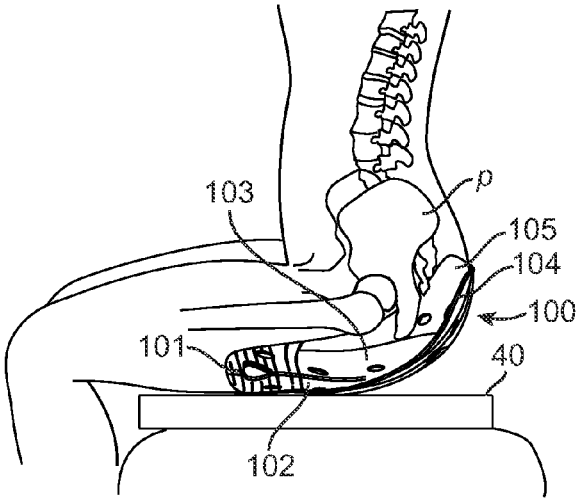
FIG. 2*d* shows a side anatomical view of a user with twisting spine seated on the seating apparatus of FIG. 2*c* with the seating apparatus in torsion on its axis, according to an embodiment of the invention.

FIG. 2*a* shows a side view of the user seated on the device 100 disposed on a hard supporting surface 40, wherein the device 100 is in the weight bearing position. FIG. 2*b* shows a rear view of a user seated on the weight bearing device 100 of FIG. 2*a*. Further, FIG. 2*c* shows a rear view of a user with twisting motion of the spine s as the user is seated on the device 100 with the foundation member 12 in torsion on its axes due to twisting motion of the user, wherein the device 100 is in the weight bearing position. FIG. 2*d* shows a side view of the illustration in FIG. 2*c*. The device 100 in the weight bearing positions shown causes a forward rotational tilting of the user's lower pelvic area into a forward lordotic position after the lower pelvic area is placed in the bowl portion.

Figure 2E:
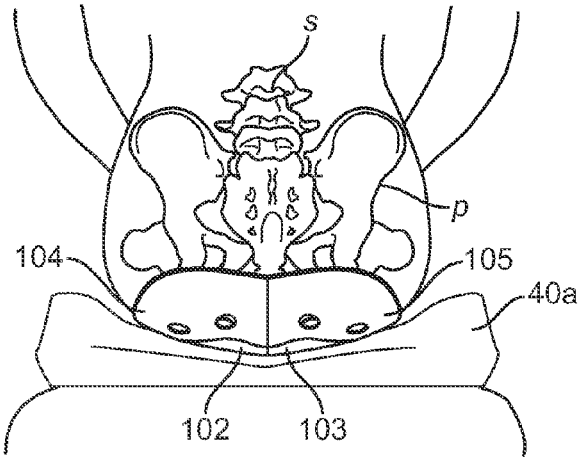
FIG. 2*e* shows a rear anatomical view of a user seated on the seating apparatus of FIG. 1*a* with the seating apparatus on a soft seating surface, according to an embodiment of the invention.
Figure 2F:
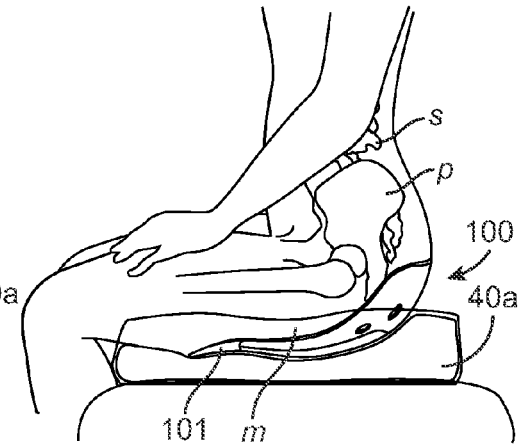
FIG. 2*f* shows a side anatomical view of a user seated on the seating apparatus of FIG. 2*f* with the seating apparatus on a soft seating surface, according to an embodiment of the invention.
Figure 2G:
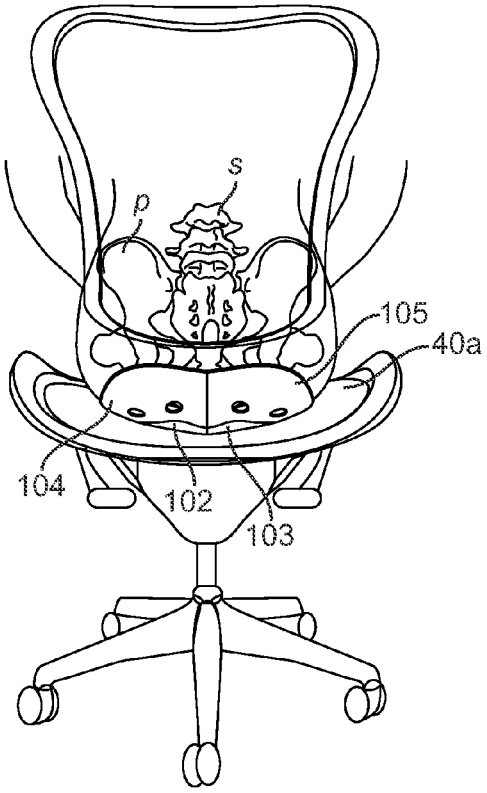
FIG. 2*g* shows a rear anatomical view of a user seated on the seating apparatus of FIG. 1*a* with the seating apparatus on a flexible fiber mesh suspended between a framed seat pan surface, according to an embodiment of the invention.
Figure 2H:
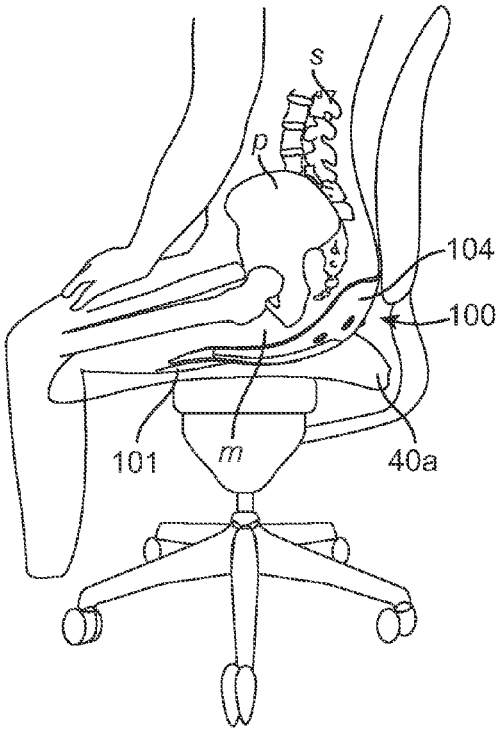
FIG. 2*h* shows a side anatomical view of a user seated on the seating apparatus of FIG. 2*h* with the seating apparatus on a flexible fiber mesh suspended between a frame seat pan surface, according to an embodiment of the invention.

FIG. 2*e* shows a rear view of the user seated on the device 100 disposed on a generally soft supporting surface 40*a* (e.g., a cushion), wherein the device 100 is in the weight bearing position. FIG. 2*f* shows a side view of the user seated on the weight bearing device 100 of FIG. 2*e*. FIG. 2*g* shows a rear view of the user seated on the device 100 disposed on a generally soft supporting surface 40*a* (e.g., flexible fiber mesh suspended between a framed seat pan surface), wherein the device 100 is in the weight bearing position. FIG. 2*f* shows a side view of a user seated on the weight bearing device 100 of FIG. 2*e*. The device 100 in the weight bearing positions shown causes a forward rotational tilting of the user's lower pelvic area into a forward lordotic position after the lower pelvic area is placed in the bowl portion.

In the perspective view of the device 100 shown in FIG. 1*a*, as noted the foundation member 12 comprises multiple sections 101, 102, 103, 104 and 105, configured to assume a highly advantageous weight bearing secondary shape during use when a user is seated on the device 100. As described in more detail further below.

In response to a user sitting on the device 100, the action of the sections 101, 102, 103 and 104 (collectively forming a bowl portion or central bowl portion, as referred to herein), causes cupping and cradling of gluteus muscles of the user in the lower pelvic area. When a user is seated on the device 100, the foundation member 12 continually applies dynamic support to stabilize the pelvis and holds the pelvis in a correct lordotic curve, regardless of how a sitting user moves while seated. The plural regions of varying flexibility in the foundation member 12 allow the foundation member 12 to effectively "reset" in shape such that the user is held essentially in a constant, perpetuating process of tilting of the user's lower pelvic area into a forward lordotic position after the lower pelvic area is placed in the bowl portion. This provides a distinct orthopedic benefit, which is greater than any benefit brought about by conventional seating devices specifically designed to provide pelvic stabilization and comfort for a seated user.

Section 101 is generally referred to as a front section. Central sections 102 and 103 are generally referred to as center or central portion sections. Lateral sections 104 and 105 are generally referred to as rear and/or side sections. Each of the sections 101-105 has one or more regions of varying (different) flexibility which collectively provide the foundation member 12 with a highly advantageous weigh bearing (secondary shape) in said second position. As described further below, in one example of the invention, the foundation member 12 is made of memory retentive nylon or plastic material. In the embodiments described herein, different flexibility regions of the foundation member 12 are achieved by regions of different relative thickness of the foundation member material which collectively provide the foundation member 12 with a highly advantageous weigh bearing (secondary shape) during use. Thicker regions are less flexible to bending forces than thinner regions.

FIG. 4*a* shows an aerial top view of the foundation member 12, indicating varying (different) thickness regions in the sections 101-105 of the foundation member 12. The thickness of the regions varies in depth looking directly down on the drawing sheet of FIG. 4*a* (the regions have different cross-sections in terms of thickness). In this example, section 101 includes regions 1A, 1B, 1C-1, 1C-2, 1D-1, 1D-2. Section 102 includes regions 2B, 2C, 2D, 2E, 2F. Section 103 includes regions 3B, 3C, 3D, 3E, 3F. Section 104 includes regions 4C, 4D-2, 4E, 4D-1, 4F. Section 105 includes regions 5C, 5D-2, 5E, 5D-1, 5F.

Figure 4B:
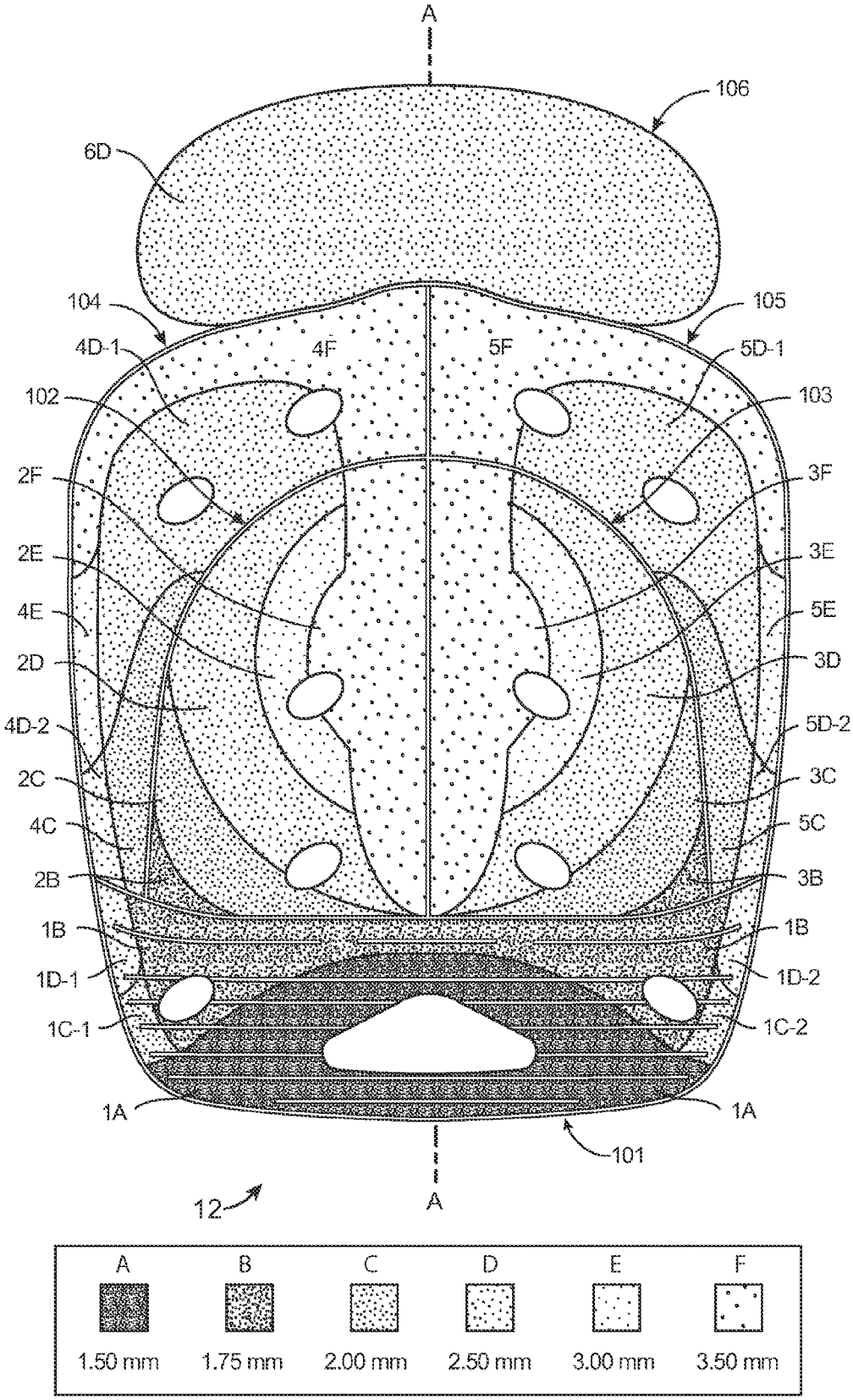
FIG. 4*b* shows an aerial top view of the seating apparatus of FIG. 1*a* with an optional back section, indicating varying thickness regions in the sections of the foundation member of the seating apparatus, according to an embodiment of the invention.
Figure 4C:
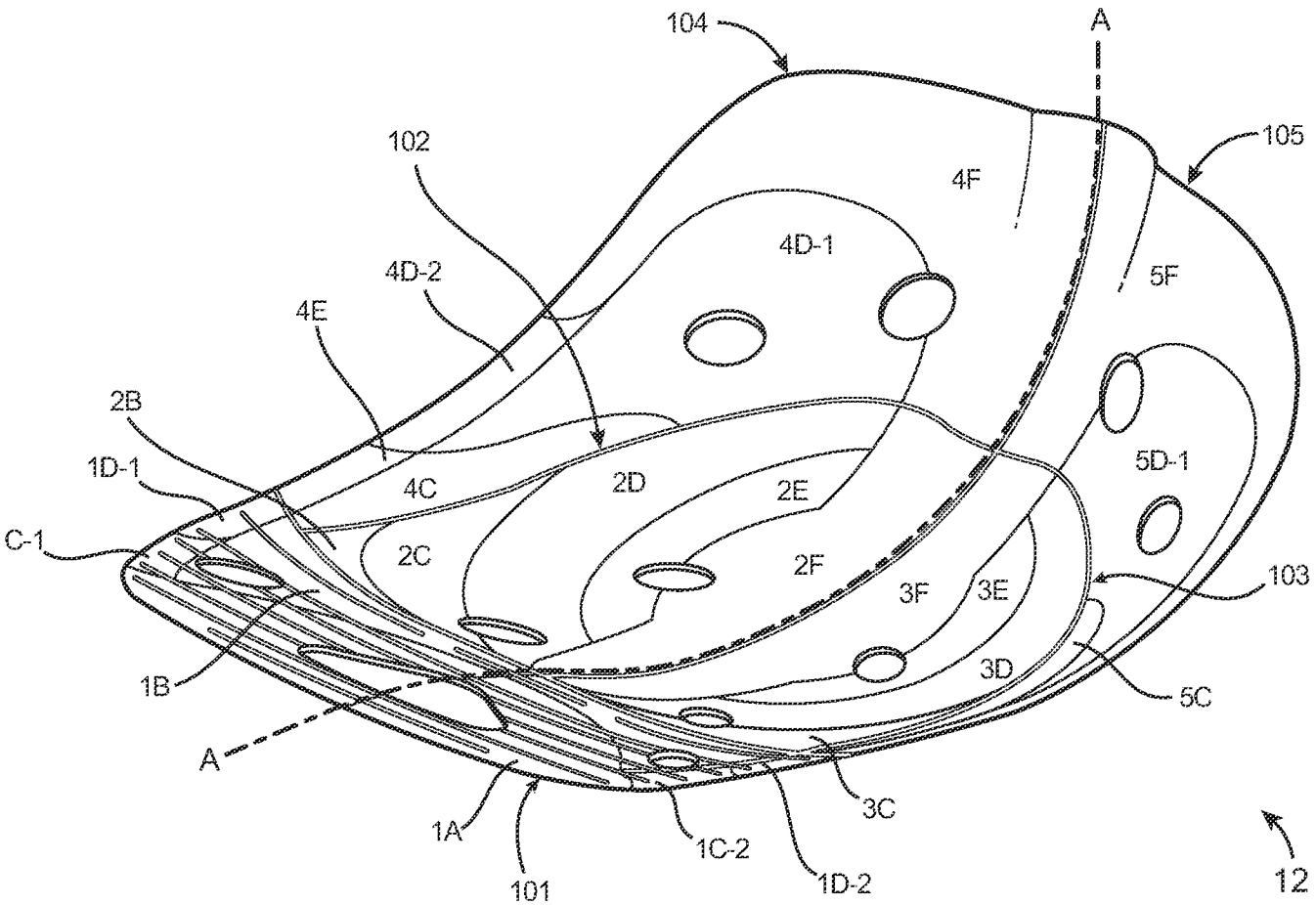
FIG. 4*c* shows a perspective view of the seating apparatus of FIG. 4*a*, indicating varying thickness regions in the sections of the foundation member of the seating apparatus, according to an embodiment of the invention.

FIG. 4*a* illustrates example gradations in thickness for the various regions of sections 101-105 by different stippling, wherein the corresponding stippling in the legend in the bottom of the drawing sheet shows example approximate thicknesses from about 1.5 mm (darkest or most densely stippled indicated by thickness indicator "A") to about 3.5 mm (lightest or least densely stippled, indicated by thickness indicator "F"), for the various regions. For example, regions with thickness A are about 1.5 mm thick, regions with thickness B are about 1.75 mm thick, regions with thickness C are about 2.0 mm thick, regions with thickness D are about 2.5 mm thick. Regions with thickness E are about 3.0 mm thick. Regions with thickness F are about 3.5 mm thick. Other relative thickness ranges may be utilized. FIG. 4*c* shows a perspective view of the foundation member 12 of FIG. 4*a*, indicating varying thickness regions in the sections of the foundation member 12.

In FIG. 4*a*, said thickness indicators A through F are used as part of the naming of the regions of the foundation member 12. Regions 4F and 5F are the thickest regions (e.g., 3.5 mm thick), whereas region 1A is the thinnest region. For the regions on the left side of central (i.e., longitudinal) axis A-A in FIG. 4*a*, the following is a listing of sets of regions, decreasing in order from thickest to thinnest: {4F, 2F}, {4E, 2E}, {2D, 4D-1, 4D-2, 1D-1}, {2C, 4C, 1C-1}, {1B, 2B}, and {1A}. Regions on the right of the center line A-A are of same thickness as corresponding regions on the left of center line A-A. Specifically, the following is a listing of sets of regions on the right side of line A-A, decreasing in order from thickest to thinnest: {5F, 3F}, {5E, 3E}, {3D, 5D-1, 5D-2, 1D-2}, {3C, 5C, 1C-2}, {1B, 3B}, and {1A}.

The regions 1A and 1B of section 101 are relatively thinner and more flexible regions of the foundation member 12. The regions 2F, 3F, 4F, 5F are relatively thicker and least flexible regions of the foundation member 12. A generally "M" shaped zone of the foundation member 12 comprises the regions 2F, 3F, 4F, 5F, 4E, 3E, 4D-2, 5D-2, 1D-1, 1D-2. Dovetailed with the generally "M" shaped zone is a generally "U" shaped zone that comprises regions 4D-1, 5D-1, 4C, 5C, 2D, 3D, 2C, 3C, 1B, 1A in the foundation member 12, wherein the lowest part of the "U" shaped zone (region 1A) is thinnest and so most flexible.

Figure 3A:
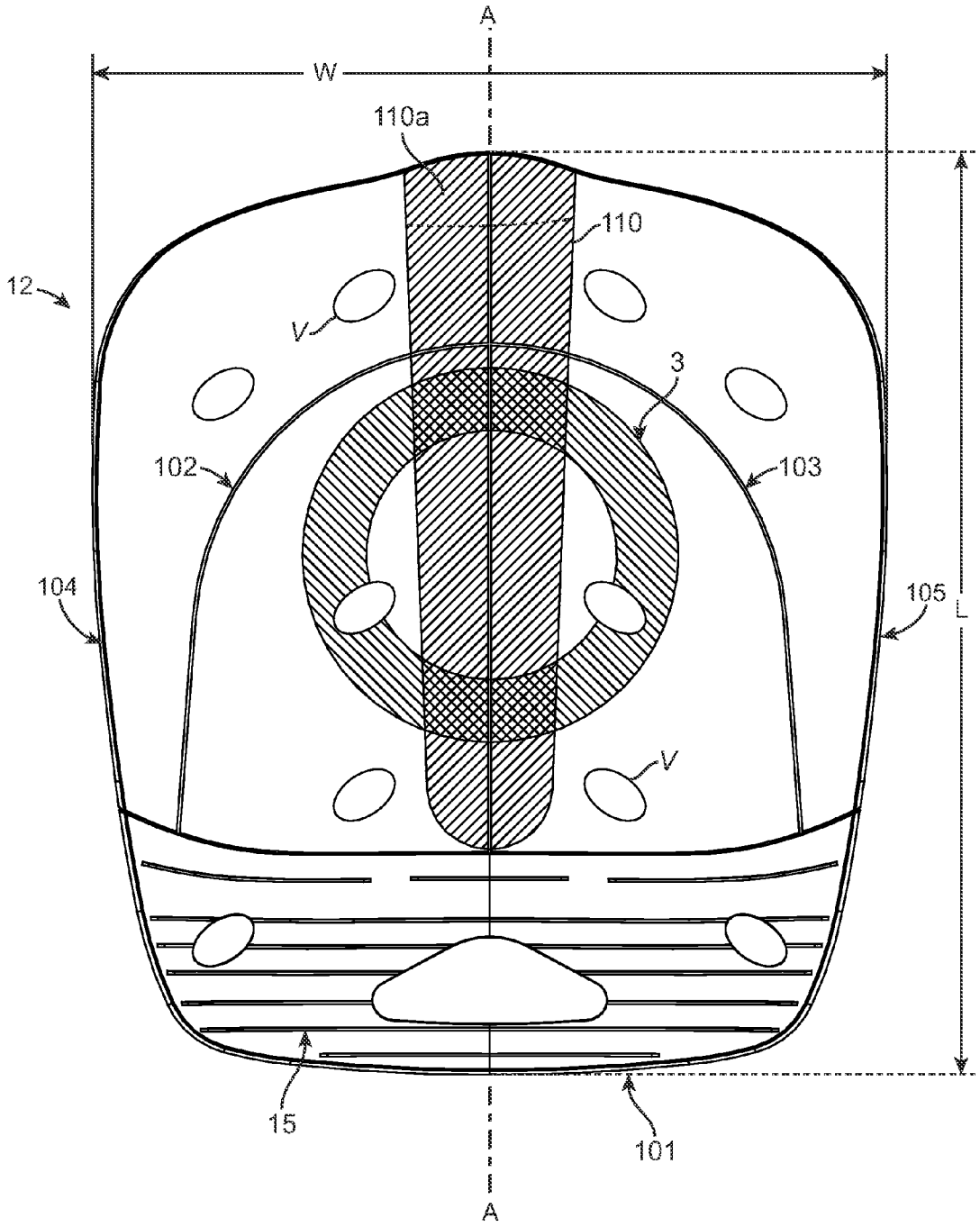
FIG. 3*a* shows an aerial top view of the seating apparatus of FIG. 1*a*, indicating width and length of the seating apparatus having multiple sections, along with a concave channel along the long axis of the seating apparatus, according to an embodiment of the invention.
Figure 3B:
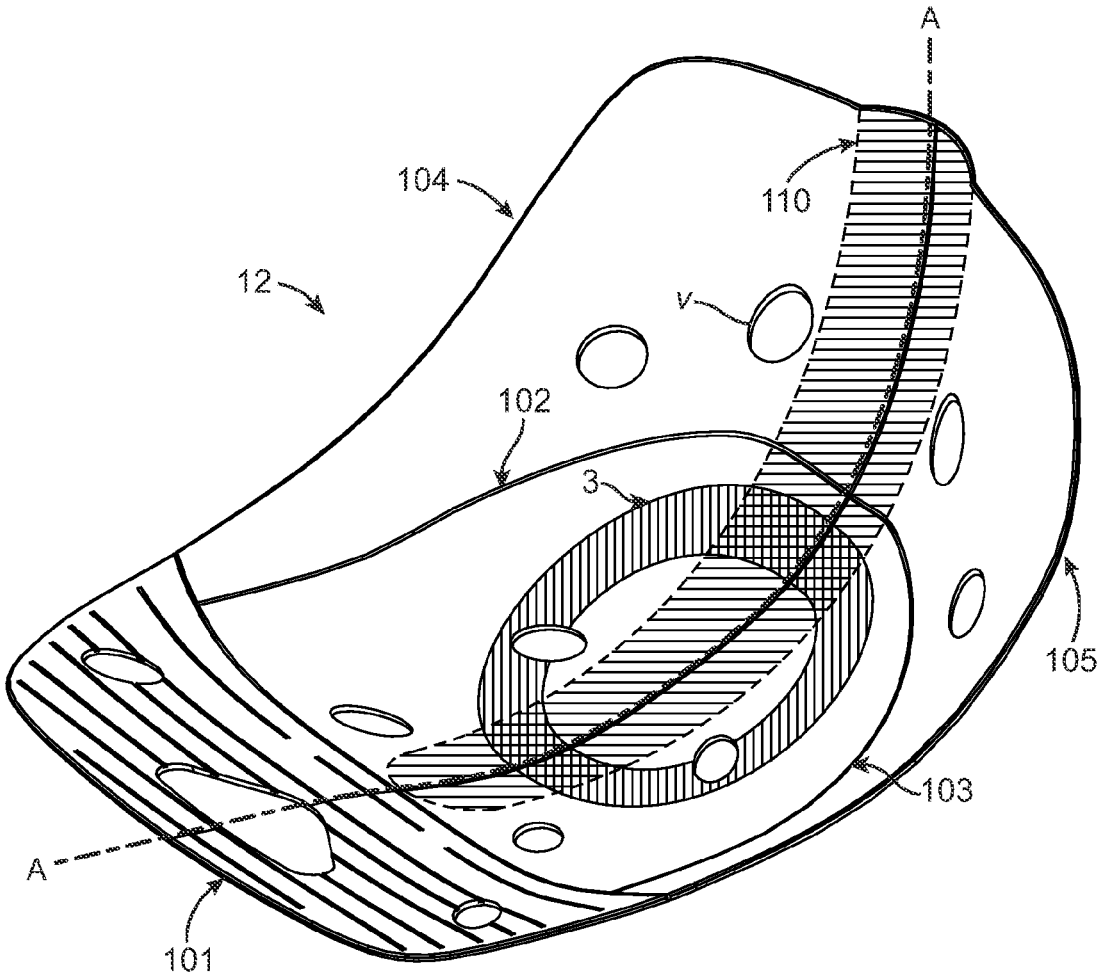
FIG. 3*b* shows a perspective view of the seating apparatus of FIG. 3*a*, indicating a concave channel along the long axis of the seating apparatus, according to an embodiment of the invention.
Figure 17A:
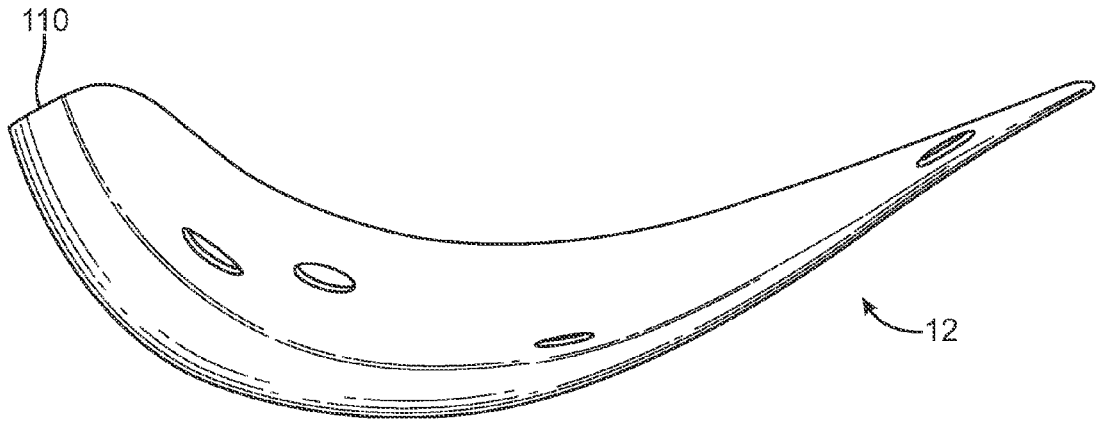
FIG. 17*a* shows a side view of the foundation member of a seating apparatus in FIG. 1*a* with a recessed concave channel detail, according to an embodiment of the invention.
Figure 17B:
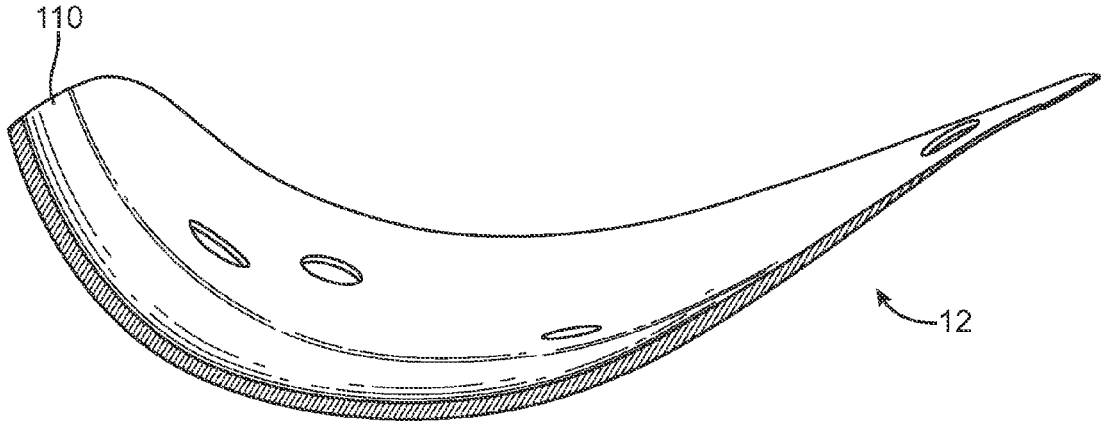
FIG. 17*b* shows a cross section of the foundation member in FIG. 17*a*, in a cutting plane along lines A-A in FIG. 1*a*.

FIG. 3A shows an aerial top view of the foundation member 12, indicating width W and length L of the foundation member 12. FIG. 3B shows a front top perspective view of the foundation member 12 of FIG. 3A. As illustrated, the foundation member 12 includes a concave channel (i.e., concave recessed portion) 110, extending partially along the axis A-A, protruding from the underside of the foundation member 12. Portions of the regions 2F, 3F, 4F and 5F, form said recessed concave channel 110. As indicated in FIG. 4A, the rear and side regions 4F, 5F of sections 104, 105, are among the thickest and least flexible regions of the foundation member 12. Similarly, the regions 2F, 3F of sections 104, 105 are among the thickest and least flexible regions of the foundation member 12. As such, the concave channel 110 is formed of thickest and least flexible regions of the foundation member 12. The concave channel 110 also provides a concave coccyx cup area 110*a* (FIG. 3*a*), allowing the variable coccyx angles so as to keep the surface of the device 100 in the area 110 from ever coming in contact with the lower Sacral joints and coccyx. FIG. 17*a* shows a side view of the foundation member 12 and FIG. 17*b* shows a cross section of the foundation member in FIG. 17*a*, in a cutting plane along lines A-A in FIG. 1*a*, showing the concave channel 110.

Example average dimensions for the device 100 are about W=12.625 inches (i.e., 32.35 cm) wide, and about L=14.625 inches (i.e., 37.6 cm) long (FIG. 3*a*). By contrast, the average size for conventional seta pans (e.g., flexible woven mesh, foam, plastic or wood) is about 21.6 inches wide and about 17.9 inches long (another example is a seat pan 20.25 wide and 21.25 long). Such conventional seat pan dimensions apply to a static sub seat pan. Unlike conventional seat pans, the device 100 does not simply conform to the gluteus shape of a seated user, but rather counter-intuitively, the sections 104 and 105 move inward and upward to cup the gluteus. The supporting surface may be a conventional static seat pan upon which the device 100 may be placed. The conventional seat can be made from a number of materials, woven, flexible fibers suspended between metal framework, contoured foam padding in various densities and hard materials such as plastics, woods and metals.

The concave channel 110 comprises a downwardly extending recess portion at the rear portion 16 of the sections 104 and 105 (regions 4F and 5F), continues throughout sections 102 and 103 (regions 2F and 3F), symmetrically along the longitudinal centerline/axis A-A. The concave channel 110 ends just before section 101. The concave channel 110 is disposed at approximately the location of the coccyx of a user seated on the central bowl portion 20, with the area 110*a* serving to remove the possibility of considerable pressure being applied to the coccyx area of the seated user.

Figure 5:
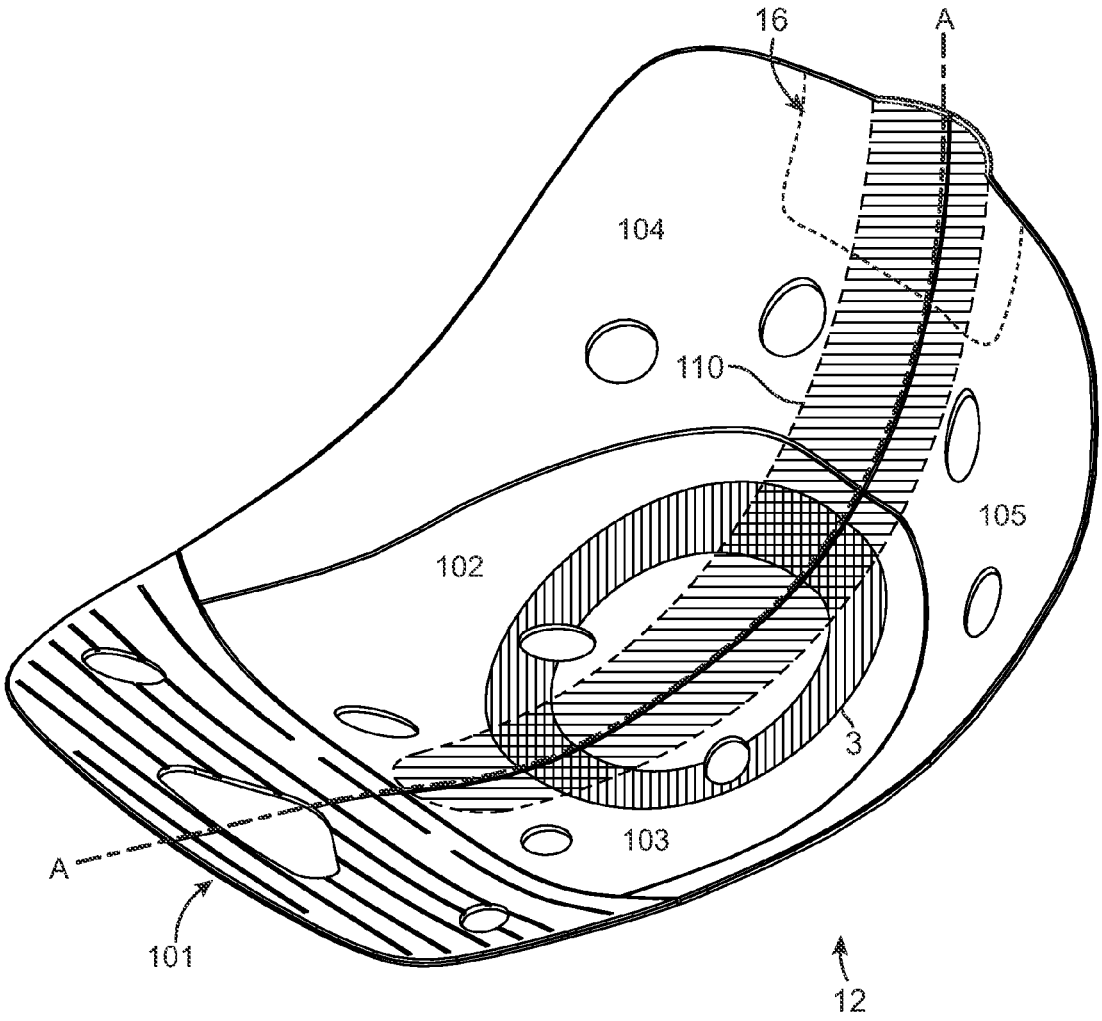
FIG. 5 shows a perspective view of the seating apparatus of FIG. 3*b*, indicating the concave channel and a rear portion of the seating apparatus, according to an embodiment of the invention.

FIG. 5 shows a perspective view of the foundation member 12 of FIG. 3B illustrating the concave channel 110, and further indicating a rear portion (segment) 16 of the foundation member 12. The rear 16 includes portions of the regions 4F and 5F of sections 104, 105.

Figure 18A:
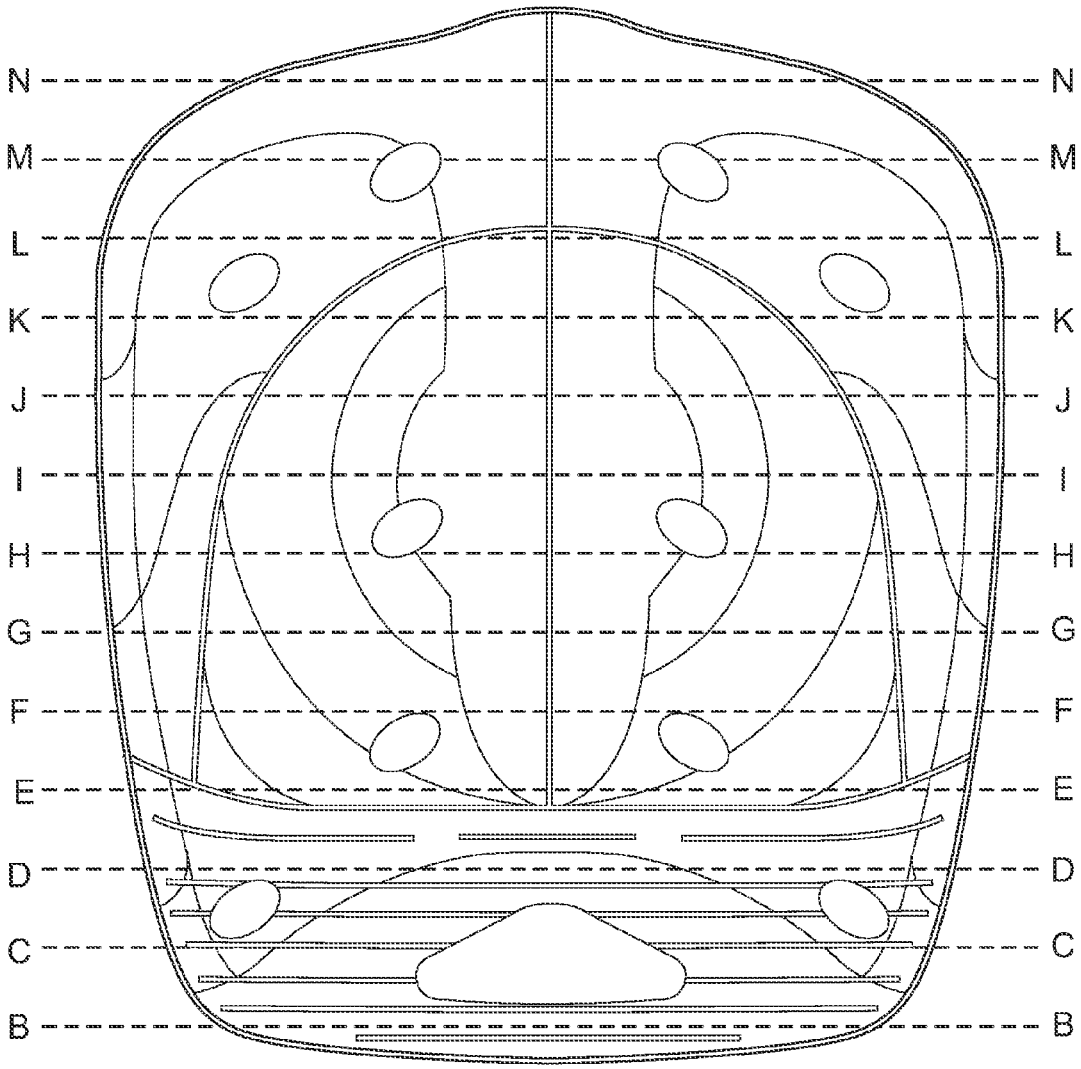
FIG. 18*a* shows a top aerial view of the foundation member of the seating apparatus in FIGS. 3A-3B, according to an embodiment of the invention.
Figure 18B:
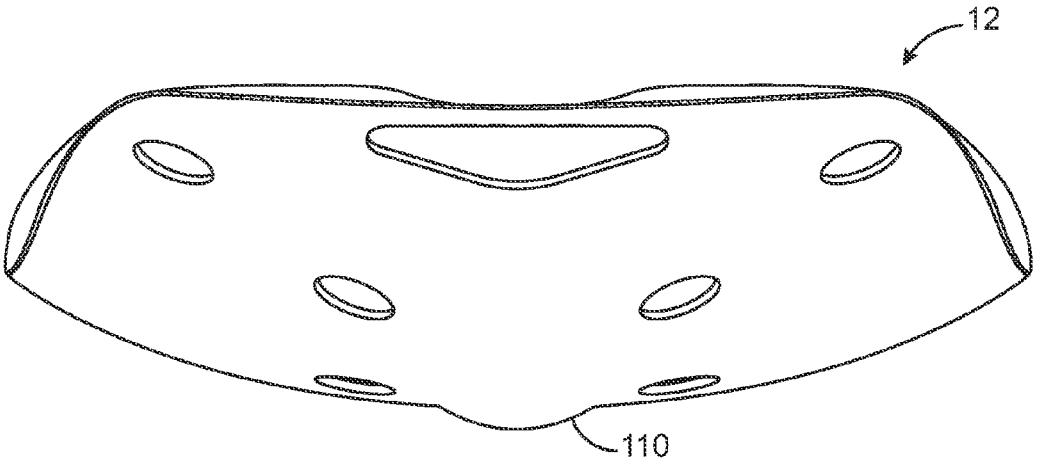
FIG. 18*b* through FIG. 18*n* show cross-sections B-B, C-C, D-D, E-E, F-F, O-O, H-H, I-I, K-K, L-L, M-M, N-N, respectively, as indicated in FIG. 18*a*.
Figure 18C:
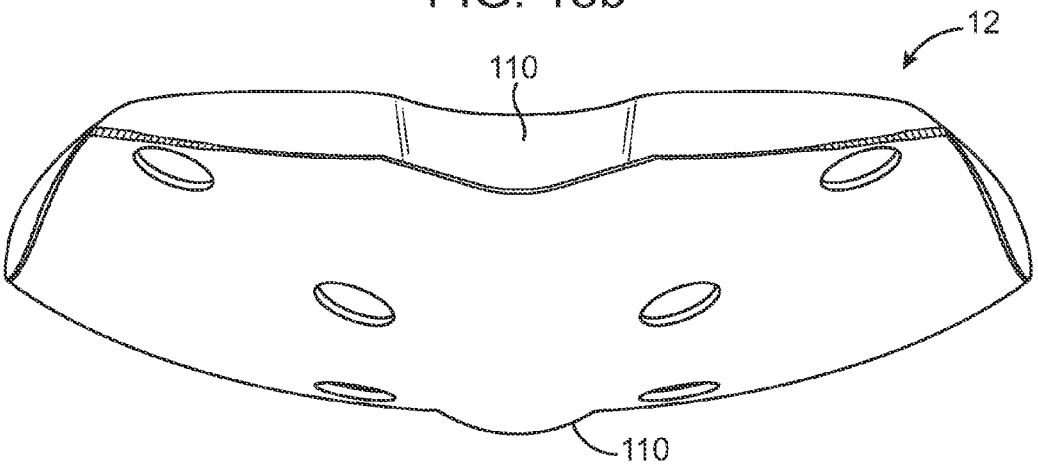
Figure 18D:
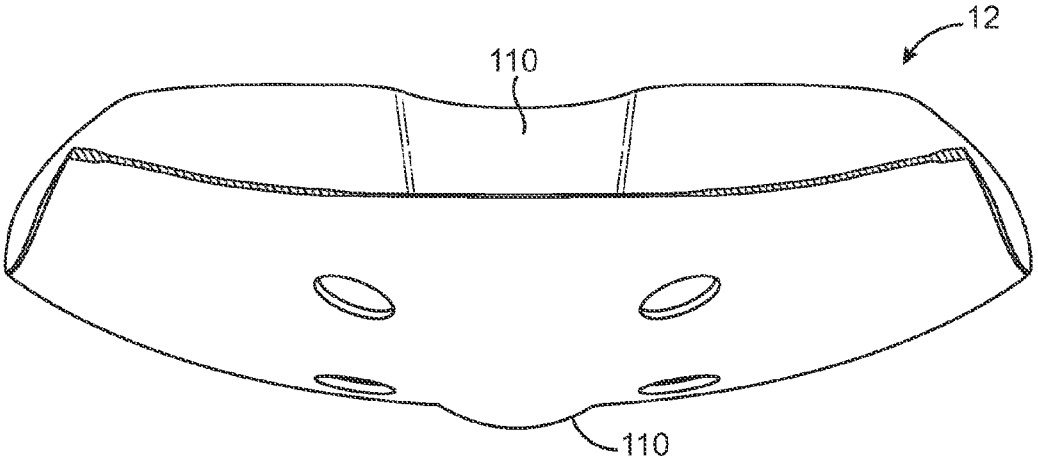
Figure 18E:
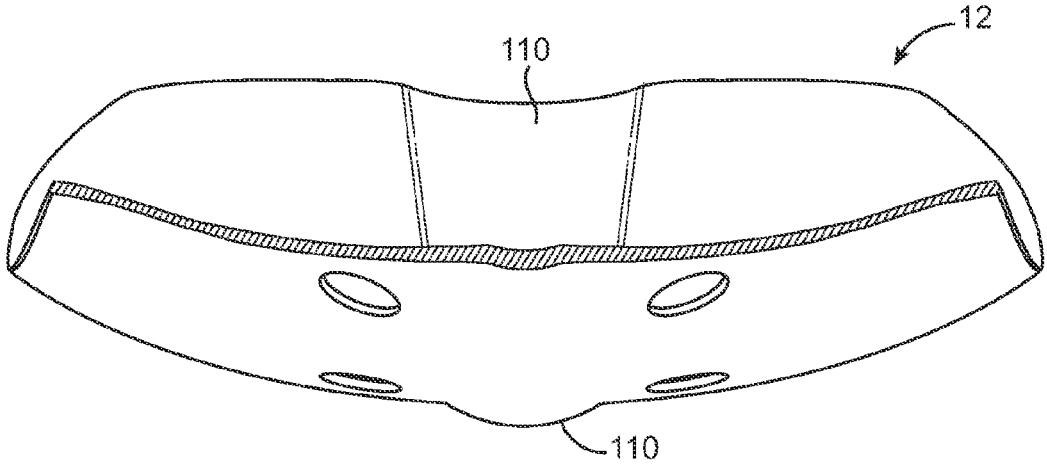
Figure 18F:
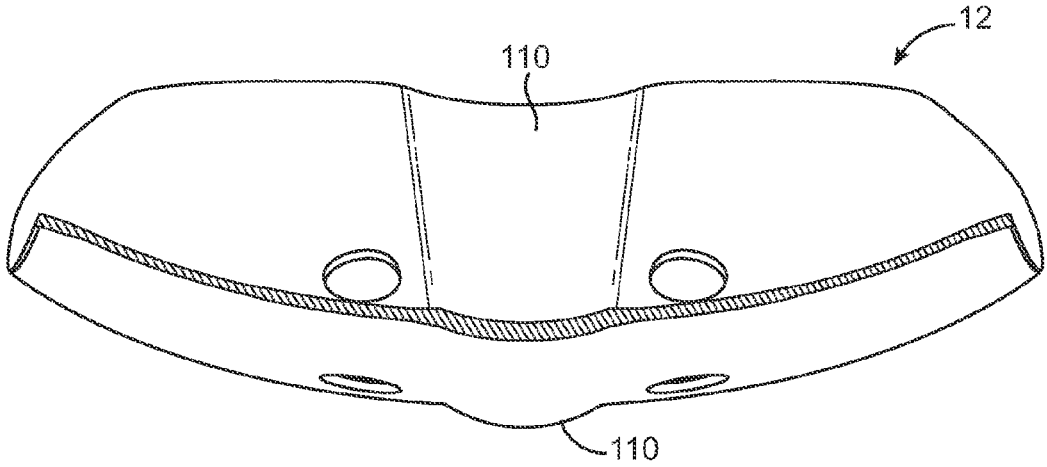
Figure 18G:
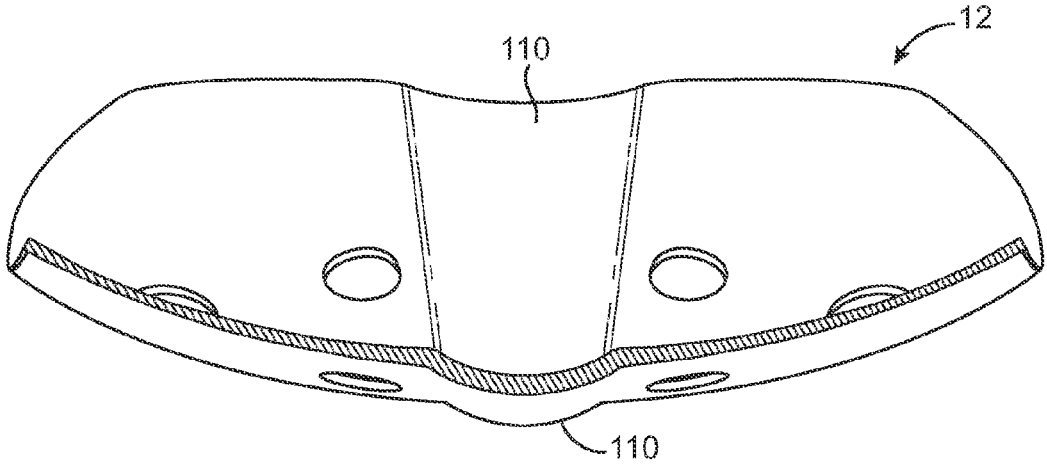
Figure 18H:
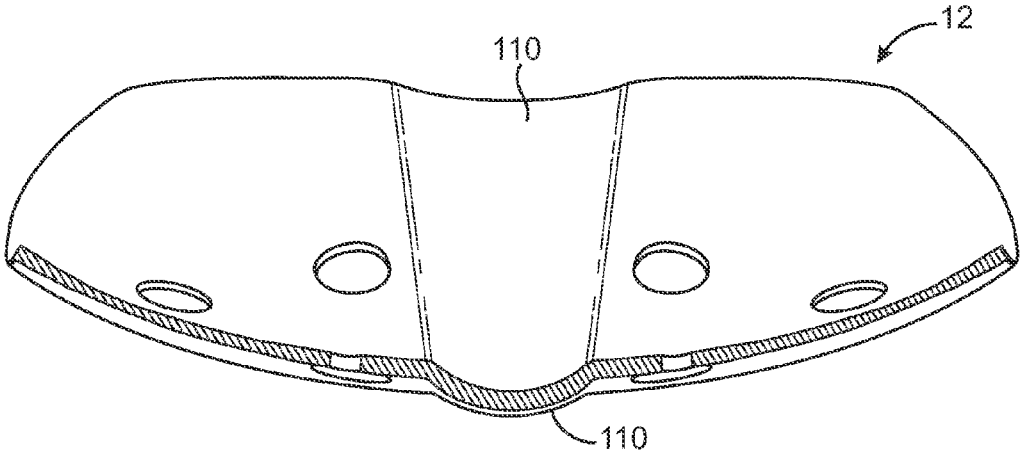
Figure 18I:
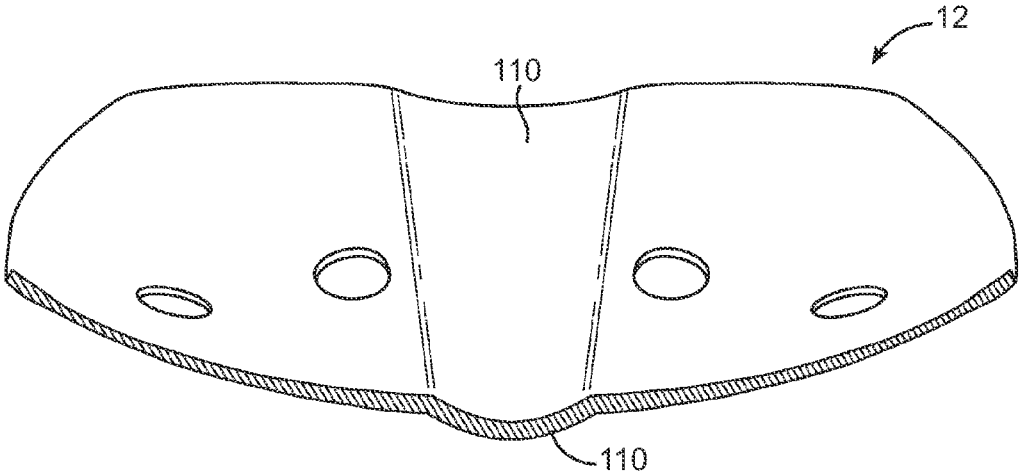
Figure 18J:
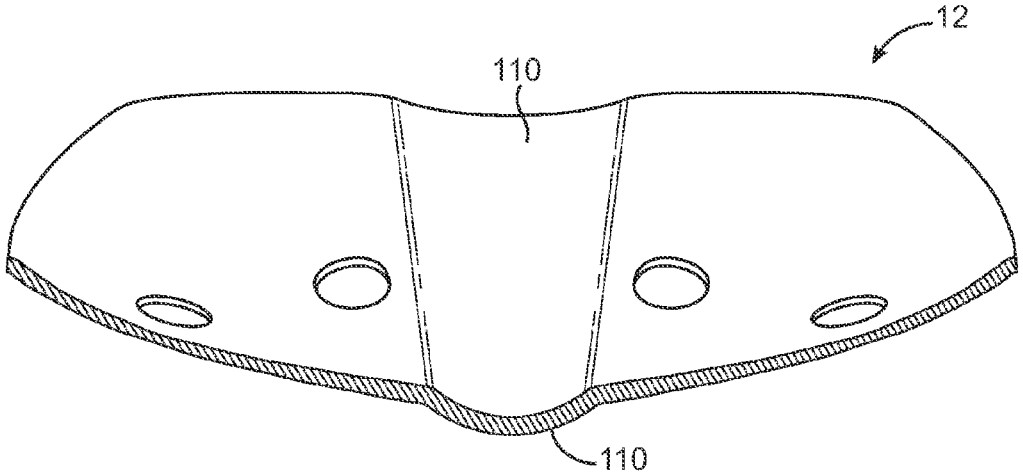
Figure 18K:
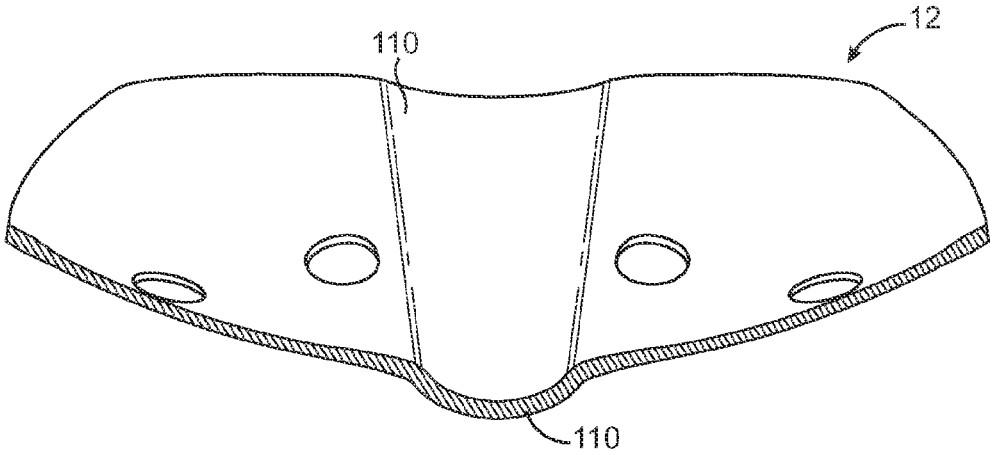
Figure 18L:
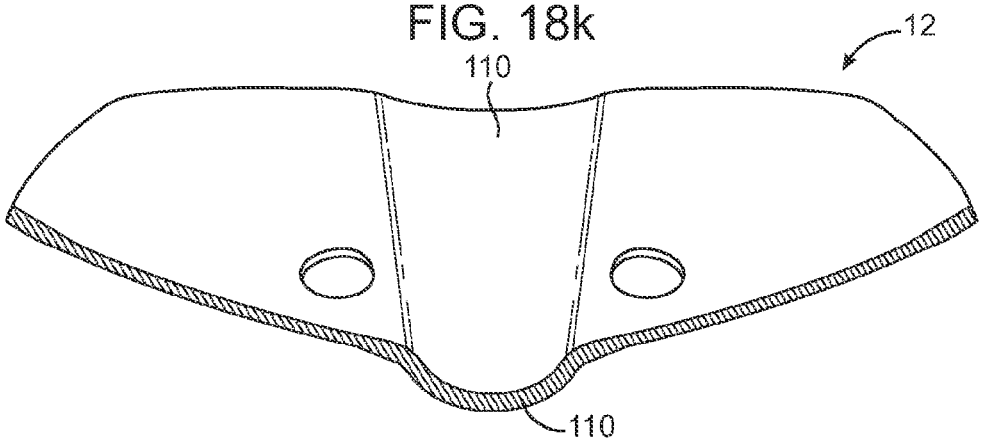
Figure 18M:
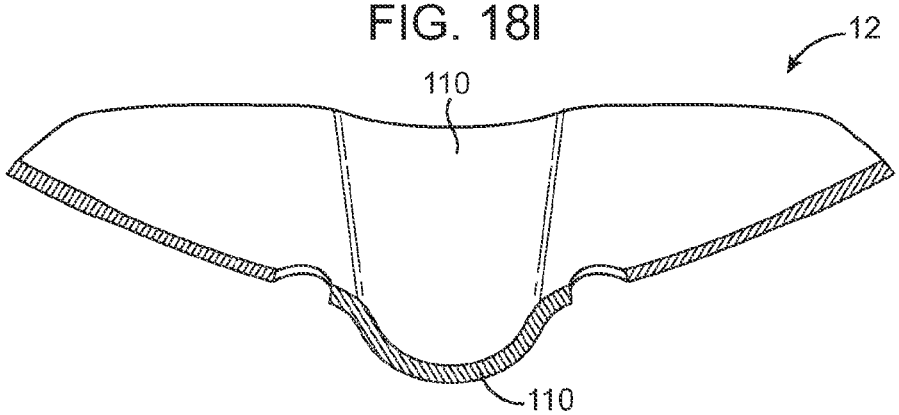
Figure 18N:
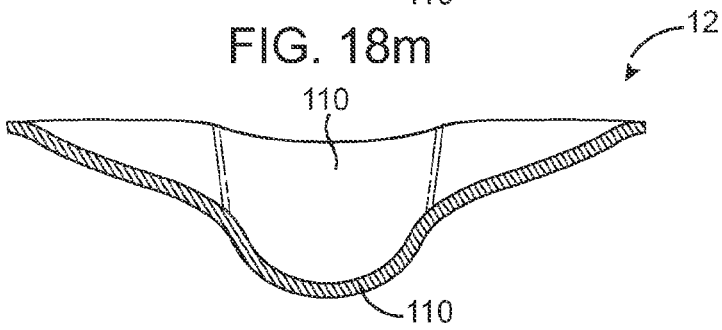

As shown in FIGS. 3A and 3B, the depth of the concave channel 110 gradually decreases as the concave channel 110 extends from upper edges of sections 104 and 105 through the sections 102, 103, to the section 101. FIG. 18*a* shows a top aerial view of the foundation member 12 of FIGS. 3A-3B, and FIG. 18*b* through FIG. 18*n* show cross-sections along cutting planes B-B, C-C, D-D, E-E, F-F, O-O, H-H, I-I, K-K, L-L, M-M, N-N, respectively, as indicated in FIG. 18*a*. FIG. 18*b* through FIG. 18*n* show general cross-section thicknesses of the foundation member 12, and further indicate said gradual change in the depth and thickness of the concave channel 110. The concave channel 110 protrudes from the underside of the foundation member 12 (FIG. 18*b*).

The bowl portion of the foundation member 12 has an underside, at least a portion of which is arcuate and configured to rotate on a supporting surface said first position (non-weight bearing position) when the user's lower pelvic area is not disposed in the bowl portion, and a second position (weight bearing position), rotationally forward of the first position, when the user's lower pelvic area is disposed in the bowl portion. The bowl portion has an underside, at least a portion of which is arcuate along an underside of the concave recessed channel 110 and configured to rotate on a seating surface between the first position and the second position.

The concave channel 110 essentially functions as downwardly extending wheel-like structure, protruding from a portion the underside of the foundation member 12 (FIG. 18*b*), promoting the forward rotation of the foundation member from the non-weight bearing to the weight-bearing position of the device 100 under user's body. In example, the concave channel 110 is about 10 mm deep at its widest 55 mm, tapering to 40 mm (millimeters). The channel 110 causes rotation of the device 100 on all types of seating surfaces including seat pans (FIGS. 2*a*-2*h*). The channel 110 intersects a generally circular pelvic landing zone 3 in central sections 102, 103 (FIG. 1*a*), wherein the circular pelvic landing zone 3 comprises portions of regions 2F, 3F, 2E, 3E (FIG. 4*a*). The relatively thicker regions 2F and 3F, along with adjacent regions 2E and 3E, provide said landing zone 3 which support the user's pelvic floor on the concave channel 110.

Sections 104 and 105 have an upward incline as shown in FIG. 1*a*. Region 4F of the section 104 forms an arcuate rear and lateral area of the bowl portion with an upper edge. Region 5F of the section 105 forms another arcuate rear and lateral area of the bowl portion with an upper edge. Regions 4F, 5F along with regions 4E, 5E, 4D-2, 5D-2, 1D-1 and 1D-2, form tension regions (tension members) of lower flexibility than other regions of the bowl portion. The tension regions couple to the front section 101 from around and sides of sections 102 and 103 (FIG. 4*a*), such that application of a downward force on the front section 101 from a user's upper legs, causes an upward and inward movement of the upper edges of the rear and lateral area (including 4F, 5F, 4E, 3E) of the bowl portion after the user's lower pelvic area is placed in the bowl portion. Other regions of the foundation member 12 that generally have higher flexibility than said tension regions (and generally have higher flexibility than the regions of the concave channel 110), allow upward and inward movement of said tension regions in response to application of said downward force on the section 101. Essentially at the same time, the concave channel 110 protruding from the underside of the foundation member 12, promotes the forward rotation of the foundation member 12 from the non-weight bearing to the weight-bearing position of the device 100 under user's body.

As shown in FIGS. 3*a* and 3*b*, the front portion of the foundation member 12 comprises the front section 101 which is generally lip-like. The sections 104 and 105 are upwardly inclined, and sections 102 and 103 are generally upwardly inclined proximate the sections 104 and 105. The upwardly curved side sections 104 and 105 start at the center line A-A forming said concave channel 110 (FIGS. 3*a*, 3*b*). The sections 104, 105 curve around the sections 102, 103, until they reach section 101. The upwardly curved side sections 104 and 105 extend upwardly somewhat higher than the central sections 102 and 103, wherein the side sections 104 and 105 are essentially equidistant from longitudinal centerline axis A-A extending through the central part of the foundation member 12 between the front section 101 and the rear/side sections 104 and 105.

As shown in FIG. 4*a*, the side sections 104 and 105 are band type, each having five regions. The sections 104 and 105 collectively include around their upper edges the regions 1C-1, 1D-1, 4D-2, 4E, 4F, 5F, 5E, 5D, 1D-1, 1C-1. Further, the sections 104 and 105 collectively include around their lower edges the regions 4D-1, 4C, 5D1, 5C, which are adjacent sections 102 and 103 at regions 2B, 2C, 2D, 3D, 3C, 3B. Essentially all five regions of section 104, and all five regions of section 105, are placed under tension when the user's lower pelvic area is placed in the central bowl portion 20.

The pelvic floor landing zone 3 (FIG. 3*a*) indicated by regions 2E and 3E in FIG. 4*a*) provide an area that is proportionally sized to the average pelvic outlet (base for the ischial tuberosities, that are to be located at its center). The sections 102 and 103 (including regions 2B, 2C, 2D, 2E, 2F, 3F, 3F, 3E, 3D, 3C, 3B), form a portion of the central bowl portion 20 (FIG. 10*b*).

The central sections 102 and 103 form a portion of the bowl area around the lower pelvic area and the muscles that join to the lower pelvis and coccyx. Because the soft tissues of the buttocks typically flow over from sections 102, 103, to the side sections 104 and 105 and front section 101 of the foundation member 12, as generally indicated in FIG. 9, it must be understood that the entire foundation member 12 bears the weight of the seated user.

The sections 104 and 105, which extend along the top of side portions 102 and 103 respectively, form a tension zone extending between the section 101 and the top/rear portion 16 (FIGS. 5, 8*d*) of the sections 104 and 105.

The regions of the side sections 104 and 105 (i.e., band regions 1C-1, 1D-1, 4D-2, 4E, 4F, 5F, 5E, 5D, 1D-2, 1C-2) serve to pull the rear portion 16 forward (i.e., along arrows 104*a* and 105*a* in FIG. 8*d*) at the time a user sits on the central sections 102, 103. Further, the underside of the distal thighs of the legs of the user rest on the front portion section 101. The forward motion of the rear portion 16 serves to assist the outer edges of sections 104 and 105 to move inwardly (i.e., along arrows 104*b* and 105*b* in FIG. 8*d*), resulting in a highly desirable compression of the gluteal and piriformis muscles. Accordingly, the sections 104 and 105 cup around the ischial tuberosities of the user so as to form a dome of cupped muscle tissue m (FIG. 9). The gluteal muscles tend to remain in a desirably slack condition.

Figure 10A:
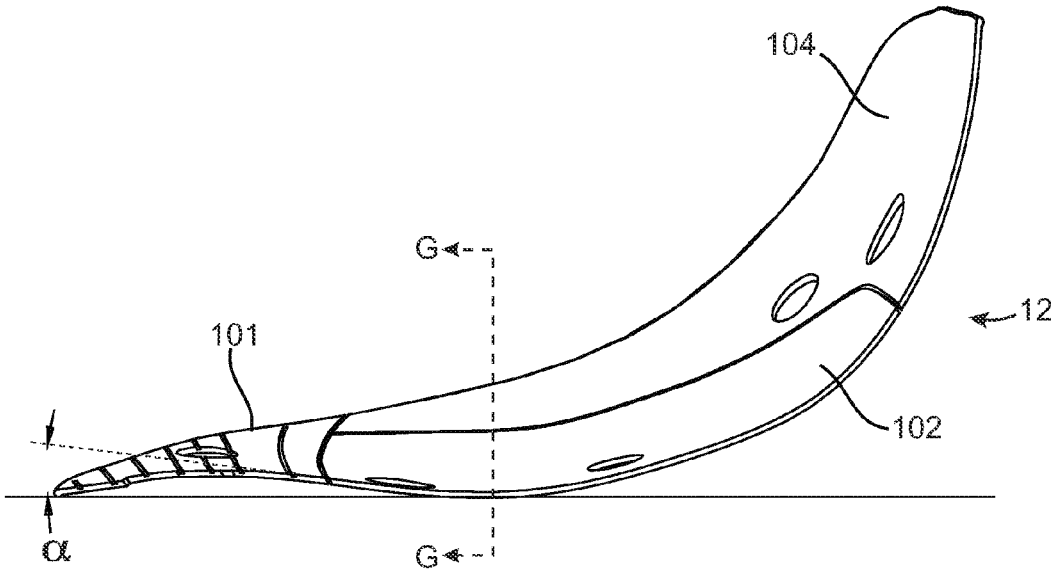
FIG. 10*a* shows a side view of the seating apparatus of FIG. 8*c*, showing a weight bearing position of the seating apparatus, according to an embodiment of the invention.
Figure 10B:
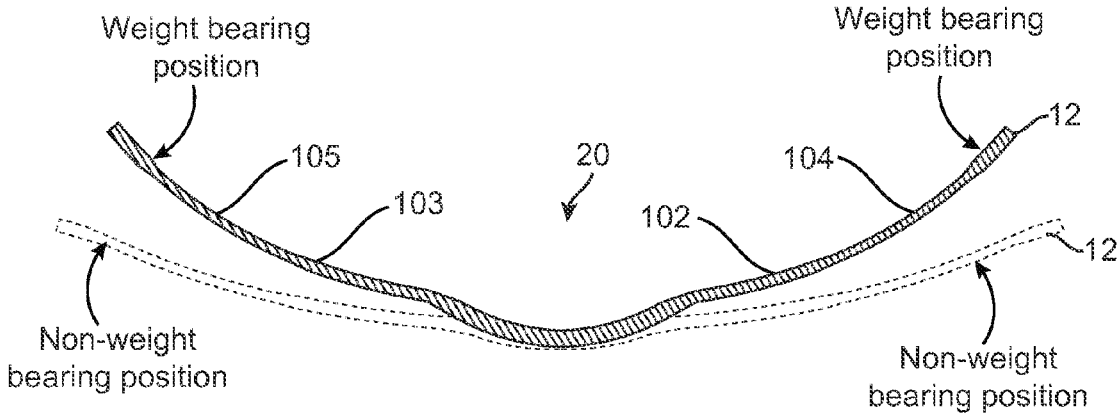
FIG. 10*b* shows a cross-section view G-G of the weight bearing position of the seating apparatus of FIG. 10*a*, with a non-weight bearing position in dashed lines superimposed thereon, indicating the cupping effect of the weight bearing position of the seating apparatus, according to an embodiment of the invention.

FIG. 10*a* shows a side view of the foundation member 12 in weight bearing position, with a cutting plane G-G about which a cross sectional view is taken as shown in FIG. 10*b*. FIG. 10*b* shows in dashed lines the non-weight bearing shape of the foundation member 12, and shows in solid lines the weight bearing shape of the foundation member 12 when a user's pelvic region is disposed in the bowl portion 20, indicating the cupping effect of the weight bearing position of the foundation member 12.

Figure 10C:
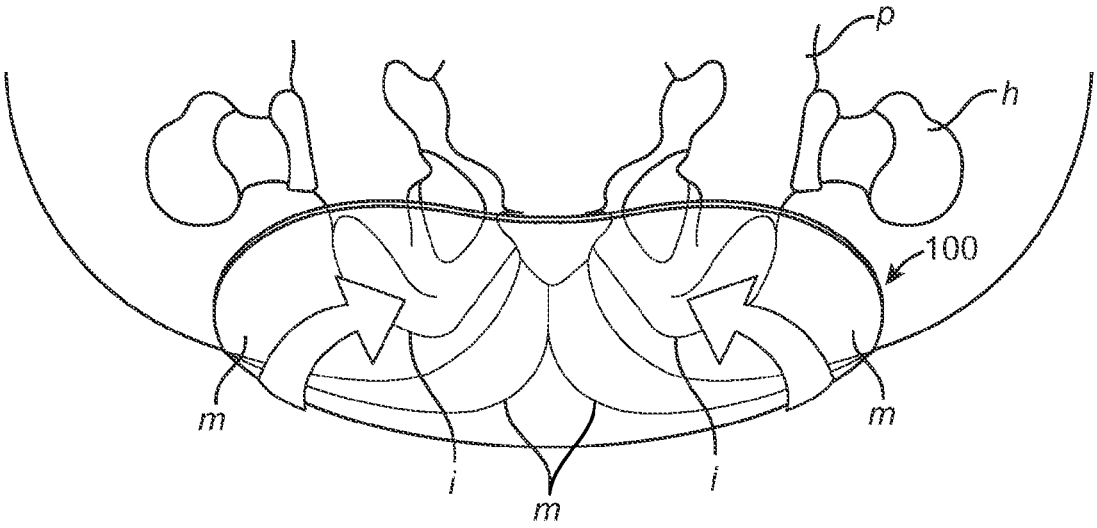
FIG. 10*c* shows a rear view of a weight bearing position of the seating apparatus of FIG. 1*a*, with an anatomical illustration, with arrows indicating the cupping and cradling of the gluteus muscles that place inward pressure on the lower wings of the pelvis Ischial Tuberosites, according to an embodiment of the invention.
Figure 10D:
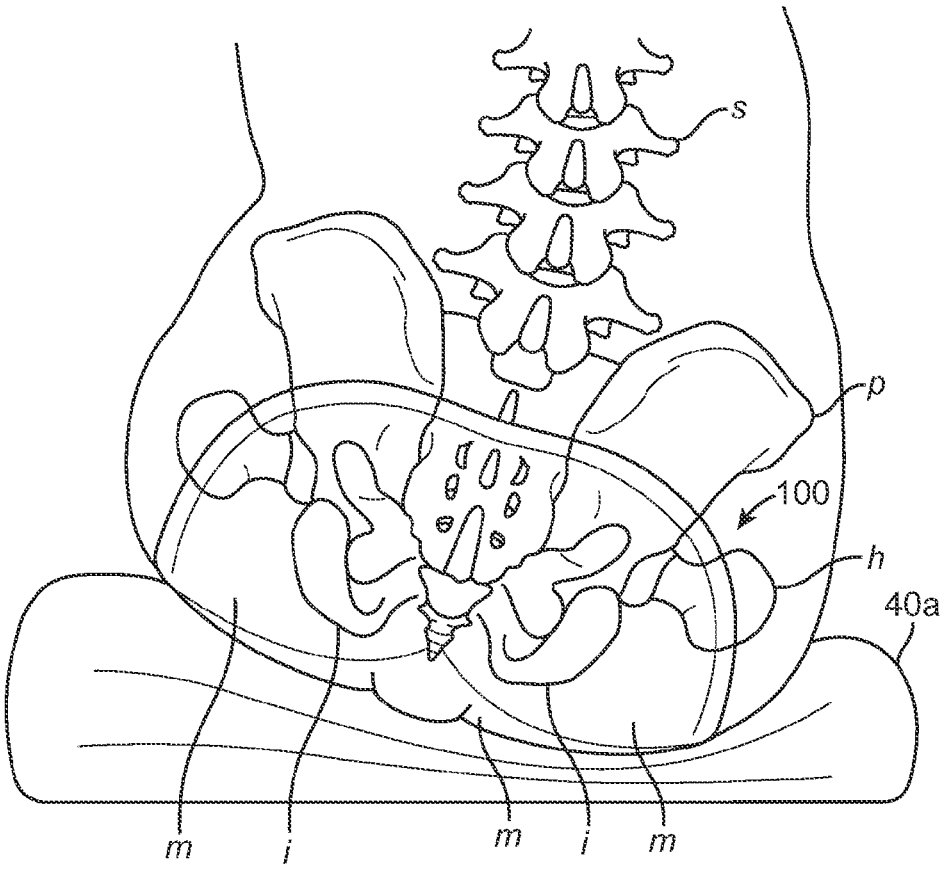
FIG. 10*d* shows a rear view of the weight bearing position of the seating apparatus of FIG. 10*c*, on a soft supporting surface, indicating how the seating apparatus maintains the cupping and cradling of the gluteus muscles when the user leans sideways, according to an embodiment of the invention.
Figure 10E:
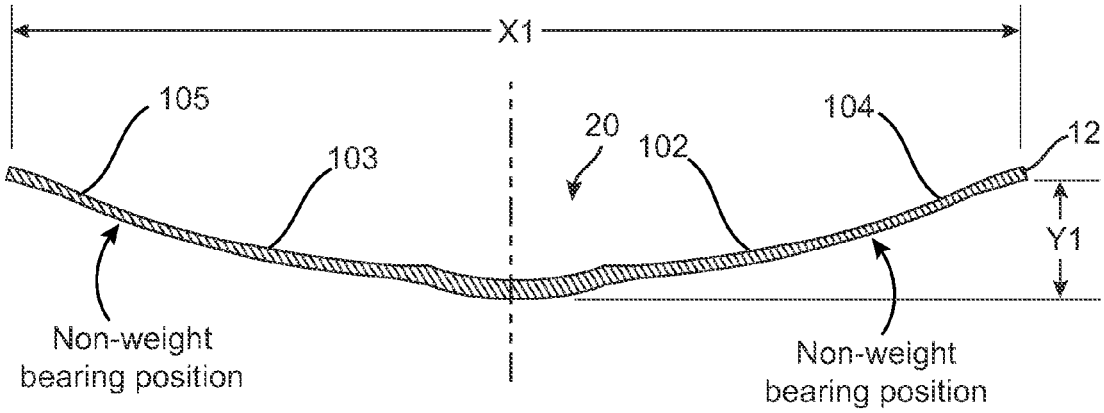
FIG. 10*e* shows a cross-section view G-G of a non-weight bearing position of the seating apparatus of FIG. 10*a*, according to an embodiment of the invention.
Figure 10F:
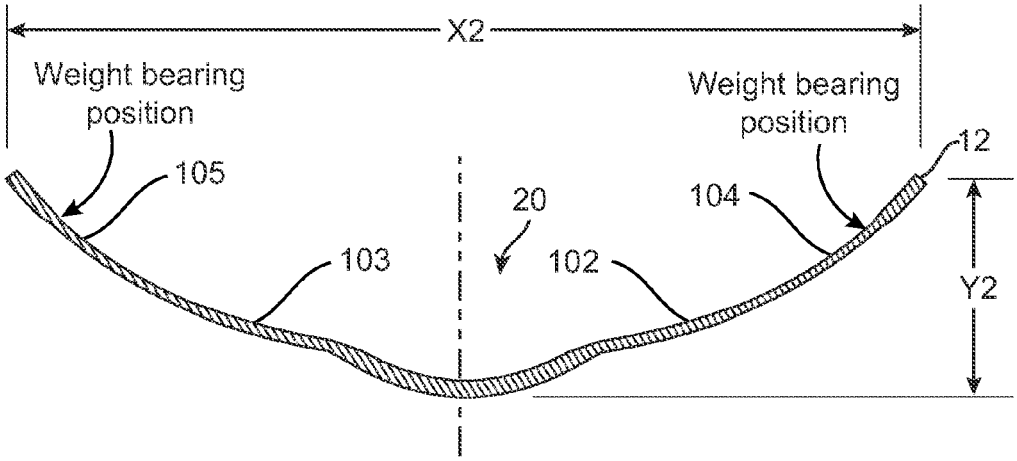
FIG. 10*f* shows a cross-section view G-G of the weight bearing position of the seating apparatus of FIG. 10*a* with a non-weight bearing position in dashed lines superimposed thereon, according to an embodiment of the invention.

FIGS. 10*e*, 10*f* represent cross-sectional views of the foundation member 12 in two different modes or circumstances, with these views being taken at the location of the above-mentioned cutting plane G-G. FIG. 10*e* shows the configuration of the foundation member 12 (first shape) when it is not bearing the weight of a seated user. In this instance, a characteristic depth of the device is indicated by Y1, and the characteristic width is indicated by X1. FIG. 10*f* shows the configuration of the foundation member 12 (secondary shape) when bearing the weight of a seated user. FIG. 10*f* shows the central portion sections 102 and section 103, and side/rear sections 104 section 105 of the device 100 assume a more deeply curved configuration when bearing the weight of a user, wherein the new depth of the device, as indicated by Y2, exceeds the depth of Y1 of the device. This results in a volumetric increase of the central portion 20 of the foundation member 12 when it is bearing the user's weight.

By way of example, the depth dimension Y1 of 10*e* may be about 1.5 inches whereas the depth dimension Y2 may be up to about 3.00 inches. As another example, the width dimension X1 may be about 12.75 inches, and the width dimension X2 in may be as narrow as 10.50 inches.

FIG. 10*b* represents a superimposition of FIGS. 10*e* and 10*f*, emphasizing the inward cupping effect of the upwardly curving side sections 104, 105, which extend along the top of the sections 102 and 103 respectively, forming a type of tension mechanism extending between the front lip-like section 101 and the rear portion 16 of the foundation member 12. The varying thicknesses of spring leaf like band regions of the side sections 104 and 105 (i.e., regions 1C-1, 1D-1, 4D-2, 4E, 4F, 5F, 5E, 5D, 1D-2, 1C-2), serve to pull the rear portion 16 forward at the time a user sits on the sections 102, 103, when under tension by the weight of the seated user. The weight bearing position of the foundation member (FIG. 10*f*) clearly indicates that the side sections 104, 105, push inwardly and somewhat upwardly under the weight of the seated user. Whereas, the non-weight bearing position in FIG. 10*e* shows the side sections 104, 105 are actually lower than their position under a seat user weight in FIG. 10*f*. As such, the downward pressure of body weight does not serve to bend the side sections 104, 105 downward.

Figure 1E:
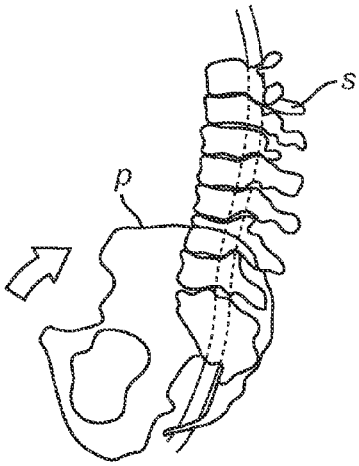
FIG. 1*e* shows a side view rendering of anatomical Kyphotic lumbar spine and pelvis.
Figure 1G:
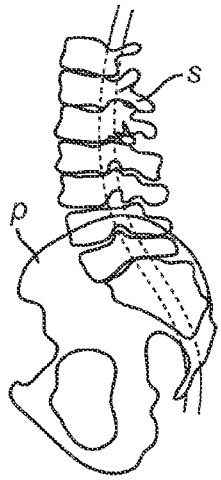
FIG. 1*g* shows a side view rendering of anatomical lordotic lumbar spine and pelvis.
Figure 1F:
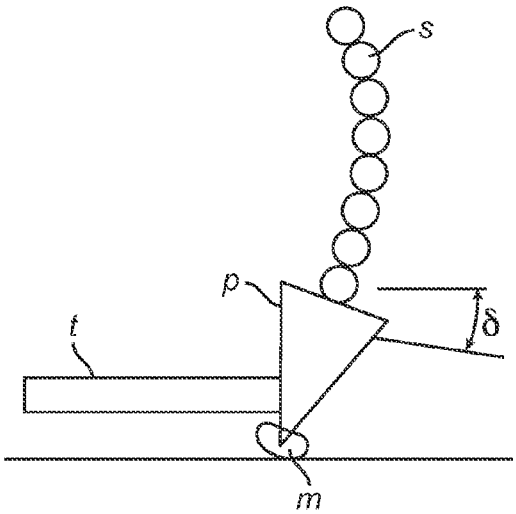
FIG. 1*f* shows a side view of a mechanical robot anatomical skeleton representation corresponding to the anatomical Kyphotic lumbar spine and pelvis of FIG. 1*e*.
Figure 1H:
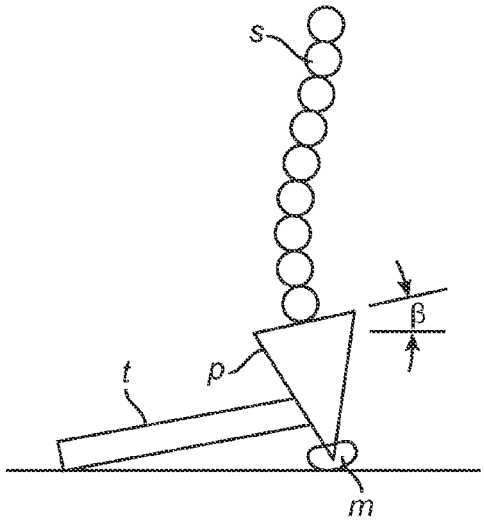
FIG. 1*h* shows a side view of a mechanical robot anatomical skeleton representation corresponding to the anatomical Lordotic lumbar spine and pelvis of FIG. 1*g*.
Figure 8A:
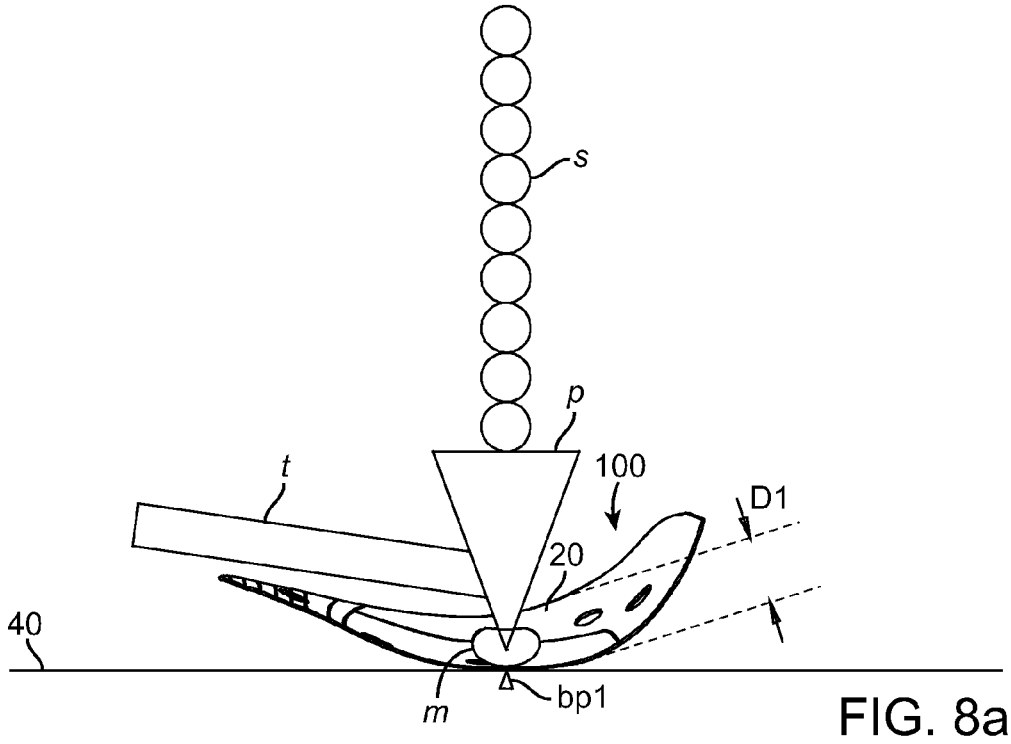
FIG. 8*a* shows a side view of the seating apparatus and mechanical robot anatomical skeleton, corresponding to FIG. 1*c*, according to an embodiment of the invention.

FIG. 8*a* shows a side detailed view of the device 100 and mechanical robot anatomical skeleton representation of a user anatomy. The mechanical robot anatomical skeleton representations in FIG. 8*a* (and other figures) are equivalent to human anatomies shown in other figures, and are used for simplicity and clarity of the figures in showing the device 100 and how it operates. For comparison, FIGS. 1*e*-1*h* show general relationship between the mechanical robot anatomical skeleton representation and the user anatomy. Specifically, FIG. 1*e* shows a side view rendering of a user anatomical Kyphotic lumbar spine and pelvis. FIG. 1*f* shows a side view of an equivalent mechanical robot anatomical skeleton representation corresponding to the anatomical Kyphotic lumbar spine and pelvis of FIG. 1*e*. Approximate angle $\delta=20°$ indicates the posterior tilt of the pelvis. FIG. 1*g* shows a side view rendering of a user anatomical lordotic lumbar spine and pelvis. FIG. 1*h* shows a side view of the mechanical robot anatomical skeleton representation corresponding to the anatomical Lordotic lumbar spine and pelvis of FIG. 1G. Approximate angle $\beta=20°$ indicates anterior tilt of the pelvis.

Figure 8B:
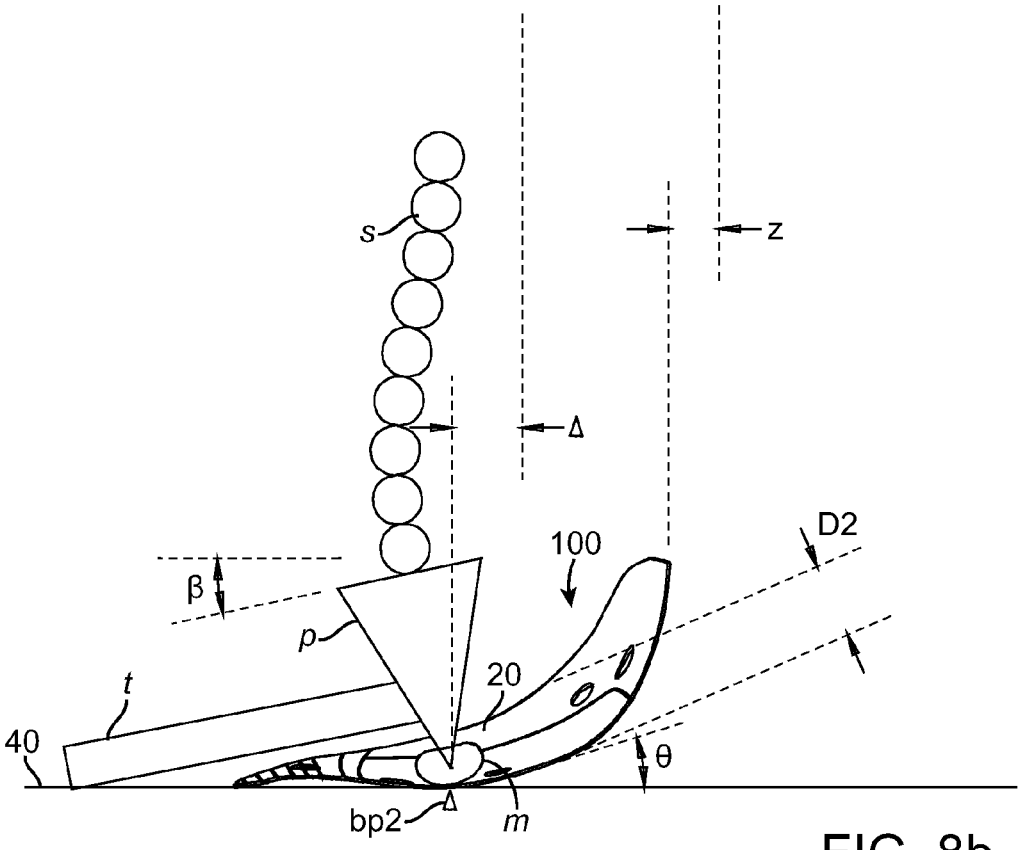
FIG. 8*b* shows a side view of the seating apparatus and mechanical robot anatomical skeleton corresponding to FIG. 1*d*, with the seating apparatus in tilted forward weight bearing position, according to an embodiment of the invention.

The illustration in FIG. 8*a* is equivalent to that in FIG. 1*c*, and showing in more detail the transitional state with the user touching the device 100, continuing the act of sitting and continuing transfer of body weight to the device 100. The example bowl depth D1 is about 1.5 inches. The illustration in FIG. 8*b* is equivalent to that in FIG. 1*d*, and showing in more detail that the device 100 has rotated to its tilted forward, weight bearing position (second position). The approximate angle $\beta=12°$ indicates forward anterior tilt of the pelvis. The example bowl depth D2 is up to 3 inches.

Referring to FIG. 8*b*, the section 101 bends downward under the pressure of the distal thighs of a user, wherein the section 101 creates a stop at a low where pelvis ischial tuberosities pivots on. As such, the device 100 provides forward lordotic curve stabilization of the pelvis that maintains its interior tilt. The device 100 rotates forward from a non-weight bearing gravity equilibrium point bp1 (FIG. 8*a*) into a weight bearing gravity equilibrium point bp2 (FIG. 8*b*), on the supporting surface 40. The illustrations in FIG. 12*c* more clearly shows the position of the device 100 on bp1, and weight bearing position of the device 100 on bp2. The position of the device 100 on bp1 corresponds to the illustrations in FIGS. 1*b* and 1*c*, wherein the device 100 does not yet bear the full weight of the user. In the description herein, the term non-weight bearing indicates the status of the device 100 as in FIGS. 1*b*, 1*c*, 8*a*, in its first position on point bp1, and the term weight-bearing indicates the status of the device 100 as in FIGS. 1*d* and 8*b* with the device 100 bearing the full weight of the user in the bowl portion and tilted forward to its second position on point bp2. The section 101 and the rear portion of the sections 104, 105, move forward a distance Z. By way of example, the distance Z can range between about 0.50 inches and about 3.50 inches, with about 2.5 inches being typical. The shift between the location of balance point bp1 and the location of balance point bp2 as a result of this tilting is represented by the distance $\Delta$ and may be, for example, about 2.0 inches to about 2.3 inches average, and up to about 2.50 inches.

In FIG. 8*b*, the device 100 has assumed an incline angle $\theta$ to the supporting surface 40 (usually a horizontally disposed surface) as a result of the device 100 bearing the weight of the user. An angle $\theta$ of approximately 17° is typical. The forward tilt/rotation of the device 100 on the surface 40 by the incline angle $\theta$ creates an essentially optimal pelvic stabilization that maintains an interior tilt.

By the action of the sections 104, 105, and the downward curving of the front section 101, the rear portion 16 of the sections 104, 105, is move forward the distance Z. The shift between the location of balance point bp1 and the location of balance point bp2 as a result of this tilting is represented by the distance $\Delta$.

Figure 12A:
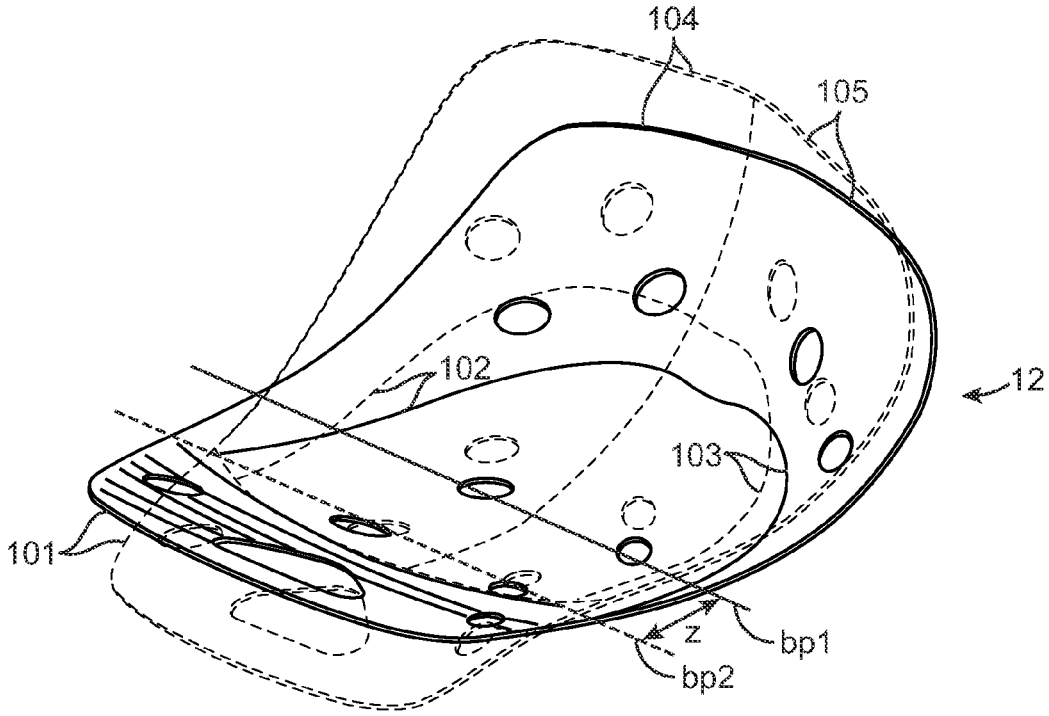
FIG. 12*a* shows a top perspective view superimposition of non-weight bearing position of the seating apparatus of FIG. 1*a* in dashed lines, and weight bearing position of the seating apparatus in solid lines, indicating forward shifting in center of gravity equilibrium from the non-weight bearing position to weight bearing position of the seating apparatus, according to an embodiment of the invention.
Figure 12B:
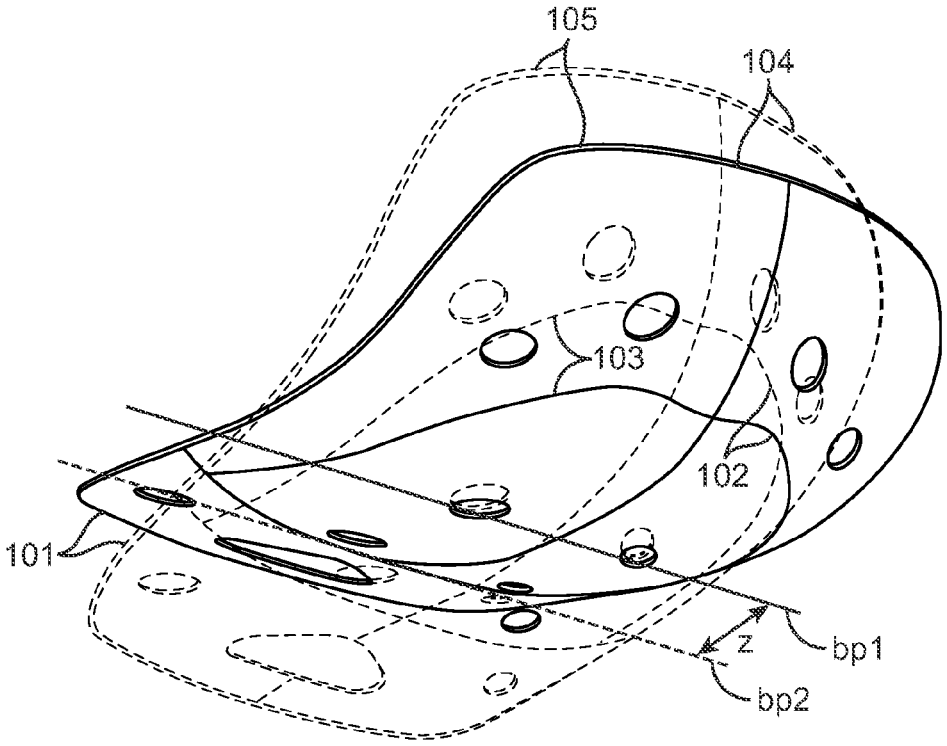
FIG. 12*b* shows a bottom perspective view of the illustration in FIG. 12*a*, according to an embodiment of the invention.

FIG. 12*a* shows a top perspective view superimposition of non-weight bearing position of the foundation member of the device 100 (in dashed lines), and weight bearing position of the foundation member 12 (in solid lines). As in FIGS. 8*b* and 12*c*, the illustration in FIG. 12*a* indicates forward shift Z in the center of gravity equilibrium bp1 from the non-weight bearing position to the center of gravity equilibrium bp1 in the weight bearing position, of the foundation member 12. FIG. 12*b* shows a bottom perspective view of the illustration in FIG. 12*a*.

Figure 7A:
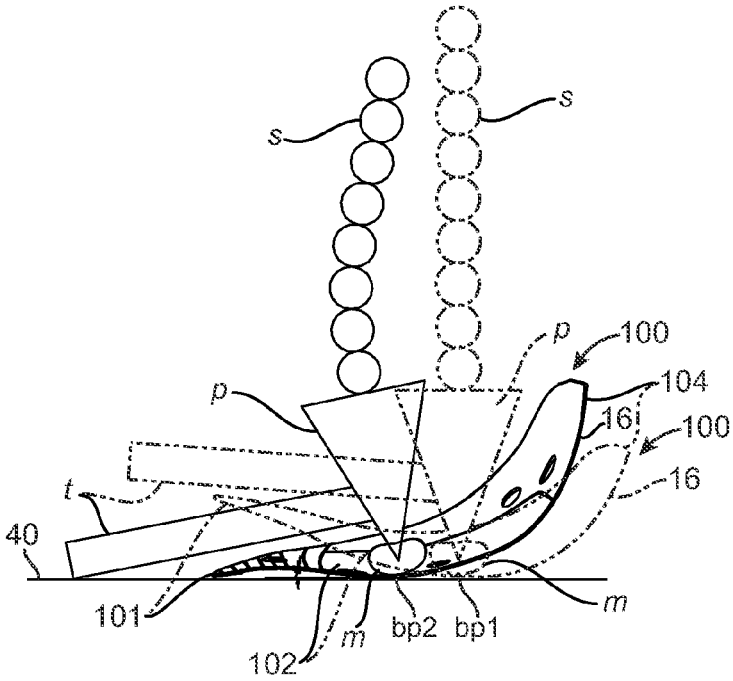
FIG. 7*a* shows a right side view of the apparatus of FIG. 1*a*, on a supporting surface, superimposing the illustration on FIG. 1*c* on the illustration of FIG. 1*d*, according to an embodiment of the invention.
Figure 7B:
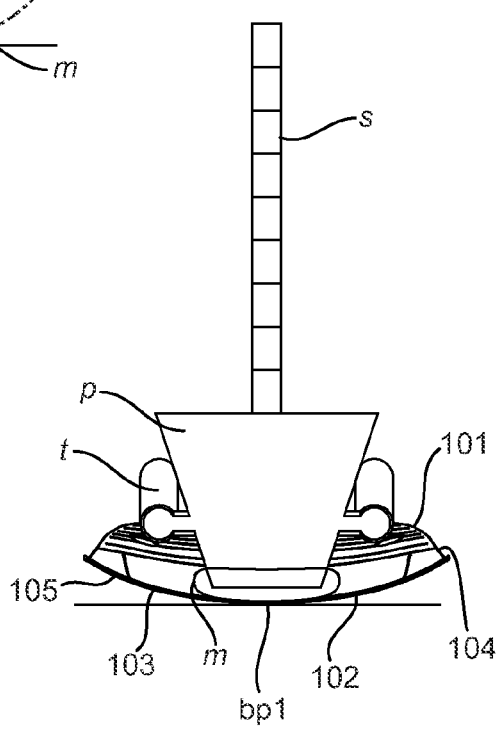
FIG. 7*b* shows a cross-section view E-E of the seating apparatus of FIG. 7*a*, looking from the rear, showing the ischial tuberosities pelvis prior to the user distal thighs pushing down on the front section of the seating apparatus, according to an embodiment of the invention.
Figure 7C:
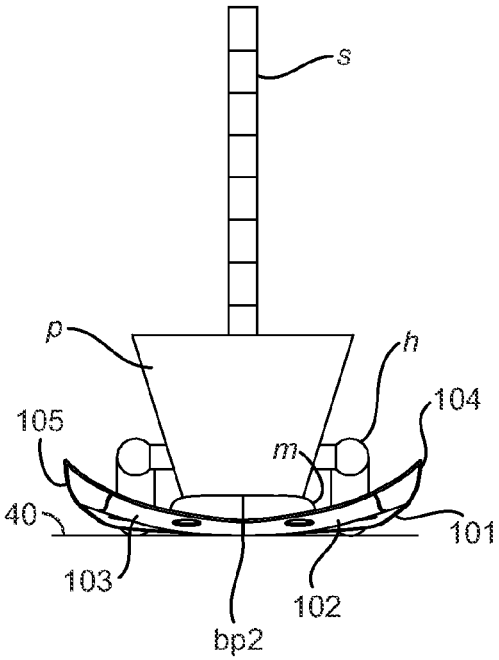
FIG. 7*c* shows a cross-section view E-E of the seating apparatus of FIG. 7*a*, looking from the rear, showing tuberosities and pelvis fully engage and filling central sections of the weight bearing seating apparatus with muscle tissue, according to an embodiment of the invention.

FIG. 7*a* shows a side view superimposition of the non-weight bearing position of the device 100 on the point bp1, and the weight bearing position (rotated forward) to the point bp2. FIG. 7*b* shows a cross-section view of the device 100 of FIG. 7*a* at cutting plane through bp1 (FIG. 12*a*), looking from the rear, showing the ischial tuberosities pelvis prior to the user distal thighs pushing down on the front section of the device 100. FIG. 7*c* shows a cross-section view of the device 100 of FIG. 7*c* at cutting plane through bp2 (FIG. 12*a*), looking from the rear, showing the ischial tuberosities pelvis prior to the user distal thighs pushing down on the front section of the device 100.

Figure 12C:
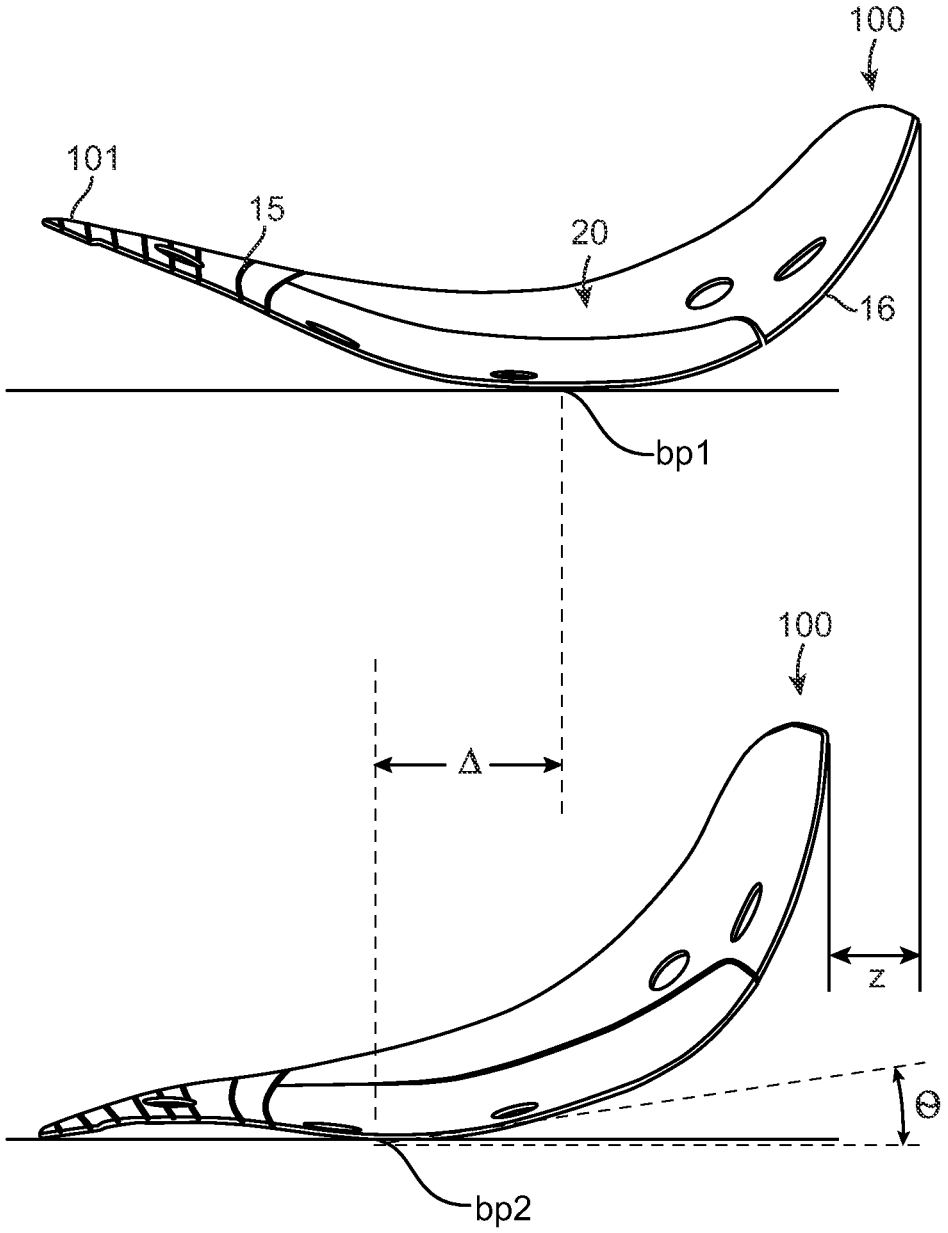
FIG. 12*c* shows cross-section views of the illustration in FIG. 12*a*, according to an embodiment of the invention.

FIG. 12*c* shows a cross sectional view of the device 100 taken at a location parallel to the centerline A-A of the device 100 (FIG. 1*a*), with this view indicating the relationship of the front portion 101 to the rear portion 16 of sections 104, 105. FIG. 12*c* shows cross-section views of the illustration in FIG. 12*a* indicating two positions or states of the device 100. The top illustration in FIG. 12*c* (corresponding to FIG. 8*a*) indicates the first position of the device 100 wherein weight of a user is not being borne by the device 100, illustrating how that the bowl portion 20 resides on the parent surface 40 in approximately a horizontal attitude. The bottom illustration in FIG. 12*c* (corresponding to FIG. 8*b*) indicates the second position of the device 100 as having been caused to undertake a considerable amount of downward rotation/tilt, indicated by the angle $\theta$. This downward rotation is partly as a result of the weight of the lower pelvis of the user on the sections 102, 103 of the bowl portion 20, and presence of the legs of the user, with the hamstring portions of the distal flies, that is, the underside of the upper thigh portions of the user's legs, resting on the front, lip-like section 101, causing a substantial amount of downward curvature.

FIG. 12*c* shows the dramatic difference when the device 100 goes from its original non-weight bearing state into its secondary state (secondary shape). This overlay/superimposition exhibits the shift of central balance point from location bp1 forward to location bp2. Also depicted is the back portion 16 shifting forward by distance Z, the bowl portion 20 being shifted forward and the front section 101 bending down and coming in contact with the parent surface 40.

FIG. 9, taken at approximately at the cutting plane G-G of FIG. 10*a*, shows the addition of the anatomical details of a typical pelvic area in order to indicate a proportional relationship of the pelvic area to the size of the device 100. This view, looking from the back of the device 100, involves the device 100 resting on a hard supporting surface 40. The positioning of the ischial tuberosities i with respect to the central bowl portion 20 sections 102 and 103 is shown. Also indicated are the positions of the side sections 104, 105, which are almost directly below the hip sockets h.

For example, FIGS. 9, 2*a-h*, 10*c*, 10*d*, 11*b*, show the cupping effect upon the lower part of the pelvic area, with this cupping effect not extending to the soft tissues that overhang the periphery of the device 100. Soft tissues representing the outlines of buttocks of various sizes are denoted by W1, W2 and W3 in FIG. 9.

FIGS. 2*a*, 2*b* and 9 illustrate anatomical representation of a typical pelvic area and spine, along with the distal thigh bone, clearly indicating the proportional size of the average pelvis to the device 100. The anatomical illustration in FIG. 2*a*, FIG. 9, and FIG. 7*a* (in solid lines) indicate the forward tilt that is undertaken by the pelvis when the device 100 has moved into its secondary shape. Also illustrated is the effect of the weight of the upper body when the ischial tuberosities are residing in the center of the bowl portion 20. This weight does not distort the secondary shape beyond a front lip-like section 101 being bent downward, placing the side sections 104, 105 under tension and pulling the upwardly inclined rear portion 16 forward.

Also indicated in FIGS. 8*b*, 10*b* and 10*f*, is the increase in depth of the bowl portion 20 of the device 100 (sections 102, 103 along with sections 104, 105) helping to cup and cradle the gluteus muscles directly around the bottom outlet of the pelvis. A constant compression of the gluteal and piriformis muscles such that they cup around the ischial tuberosities is thus advantageously brought about by the device 100.

Figure 3C:
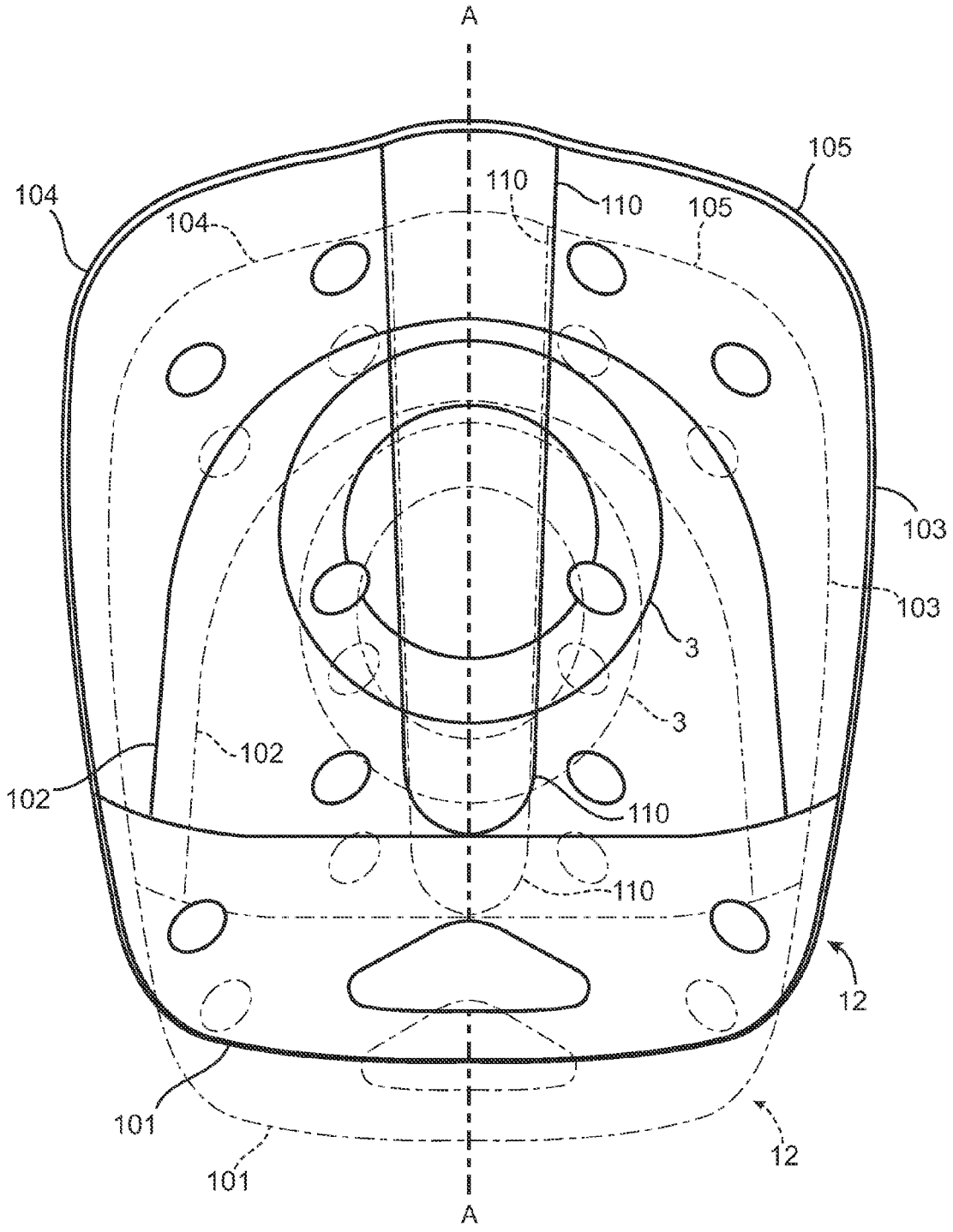
FIG. 3*c* is a view similar to FIG. 3*a* but to a larger scale and showing by the use of dashed lines, the shift that has taken place when the seating apparatus has assumed its secondary configuration while bearing the weight of a seated user.

FIG. 3*c* shows by use of dashed lines, the shifting that takes place at the time weight has been placed upon the foundation member 12, and downward tilting of the front, lip-like portion section 101. The shifting of the zone 3 are specifically depicted by a circle made up of dashed lines. The long dashed lines extending along the sides indicate that as a result of the placement of weight of the seated user upon the central portion of the device 100, the periphery/side edges of sections 104 and section 105 are caused to move inwardly and somewhat upwardly. The side sections 104, 105 have moved inwardly rather than outwardly during the application of the user's weight to the device 100, this being due to the fact that the under surfaces of the user's thighs push downwardly on the forward section 101, which brings about a tensioning of the side sections 104, 105. This tensioning of the side sections 104, 105 cause the inward movement of the side sections 104, 105. The varying thicknesses of the sections 102-105, function as a type of a leaf spring, enhancing the inwardly and upwardly cupping action of the sections 104, 105.

Preferably, the front lip-like section 101 of the foundation member is constructed to have a specific bend point at the front of the central bowl portion 20. One implementation involves provide at least one flexible arc or groove 15 thereon (FIG. 12*c*). The groove 15 extends across the front section 101, substantially perpendicular to the longitudinal centerline A-A. The groove 15 not only serve to increase the flexibility of the front section 101, but also serve to cause the device 100 to bend so as to assume the desired secondary shape at the time the undersurface of the user's distal thighs come into contact with the front, lip-like section 101. As previously mentioned, the downward bending of the front section 101 acts through the sections 104 and 105 so as to pull the rear portion 16 to move forward. The sections 104 and 105, which extend along the top of side portions 102 and 103 respectively, form a type of tension member extending between the front section 101 and the rear portion 16 of the device 100. The side sections 104 and 105 with their spring leaf like band regions (i.e., regions 1C-1, 1D-1, 4D-2, 4E, 4F, 5F, 5E, 5D, 1D-2, 1C-2) serve to pull the rear portion 16 forward at the time a user sits on the central bowl section 102 section 103, with the underside of the distal thighs of the user's legs resting on the front section 101. Such forward motion of the rear portion 16 serve to assist the side sections 104 and 105 moving inwardly so as to bring about a highly desirable compression of the gluteal and piriformis muscles such that they cup around the ischial tuberosities so as to form a dome of cupped muscle tissue.

The flexible arcs/groove 15 is positioned on the device 100 proximate the point where the section 101 and the sections 102, 103 meet. The groove 15 causes bending of the device 100 proximate the groove 15, in addition to providing flexibility. The groove 15 helps bring about the secondary shape of the device 100 identically each time the device 100 is placed under pressure from the seated user. The arc 15 may be duplicated other places in section 101 (FIG. 3*c*).

The device 100 may be utilized in a variety of environments, such as on the seat of an automobile; on any item of furniture such as a couch or easy chair; upon a chair with a relatively hard bottom; or even on a hard seat such as to be found in a stadium or the like (e.g., FIGS. 2*a*-2*h*). In any of these events, the bowl portion 20 of the foundation member 12 will undertake a degree of downward rotation/tilt with respect to the horizontal in the general manner described above.

Although certain illustrations employed in such drawings as FIGS. 2*a-d*, 8*a*, 8*b*, have been utilized while the foundation member 12 is residing on a hard surface, it is to be understood that the secondary shape of the device 100 is also obtained while the device 100 is residing upon a resilient or soft surface. This secondary shape in soft surfaces floats down into the foams and fabric of ergonomic chairs and takes on the same secondary shape as if it was on a hard surface. Certain illustrations have been shown on a hard surface because the overhanging soft tissues and the angle of the forward tilt of the foundation member is visually more dramatic. It is most important to keep in mind, however, that the same highly advantageous tilt and cupping action brought about by the device 100 occurs essentially independently of the hardness or softness of the supporting surface.

The varying thickness regions of the foundation member 12 (FIG. 4*a*), function as leaf spring band like regions with their specific thickness flows allowing transitioning of the additional soft tissues over the edge of the device 100 comfortably without the need for additional padding. Specifically, the five sections 101-15 and their varying thickness regions function as a spring leaf structure, wherein with each thickness change is analogues to a separate layer of thickness of the material the device 100 is made of, much like a spring leaf assembly. When the device 100 is placed under weight of a user in the central bowl portion 20, the downward pressures push down on the leaf spring like assembly of the device 100. The sections 101-105 with their varying thickness regions provide the function of the novel device 100, compared to devices with constant thickness which depend only upon memory retentive plastics they are made of.

The "wings" on the concave channel 110 in sections 102, 103 (regions 2E and 3E), in the bowl-like pelvic zone 3, holds the ischial tuberosities pelvic floor that land just outside the concave channel 110. The serpentine bands like sections 104, 105, which extend along the top of side portions 102 and 1033 respectively, form a type of tension member extending between the front, lip-like portion section 101 and the rear portion 16 of the foundation member 12. The side sections 104 and 105 along with their spring leaf like band regions (1C-1, 1D-1, 4D-2, 4E, 4F, 5F, 5E, region 1D-2, 1C-2) serve to pull the rear portion 16 forward at the time a user sits on the central sections 102, 103 with the underside of the distal thighs of the user's legs resting on the front portion section 101. Such forward motion of the rear portion 16 serve to assist the side sections 104 and 105 moving inwardly so as to bring about a highly desirable compression of the gluteal and piriformis muscles such that they cup around the ischial tuberosities so as to form a dome of cupped muscle tissue.

Figure 3D:
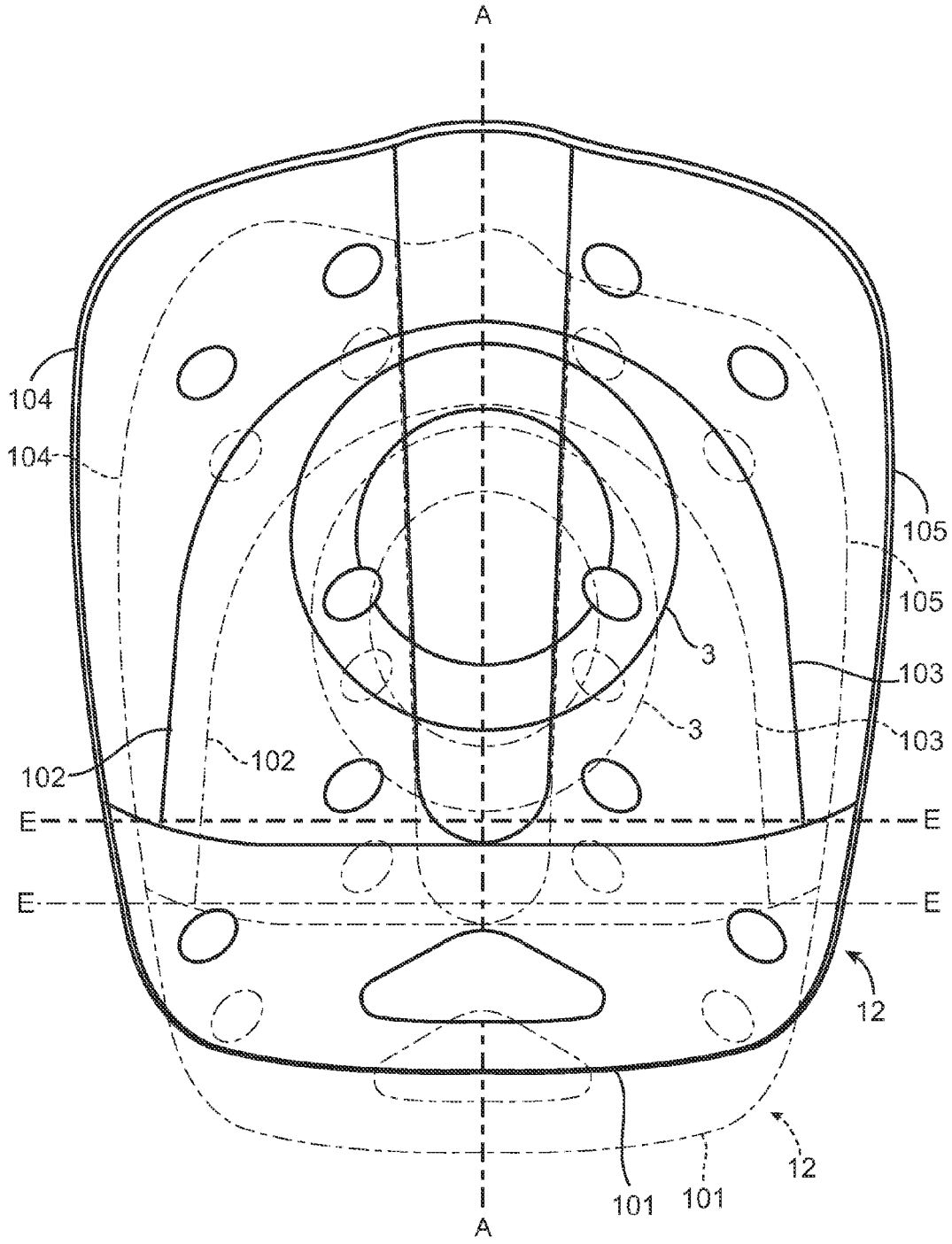
FIG. 3*d* is a view similar to FIG. 3*c*, but showing by use of dashed lines, the shifting that takes place at the time weight has been placed upon the foundation member, further torsion of the foundation member when a seated user twists to the right.
Figure 3E:
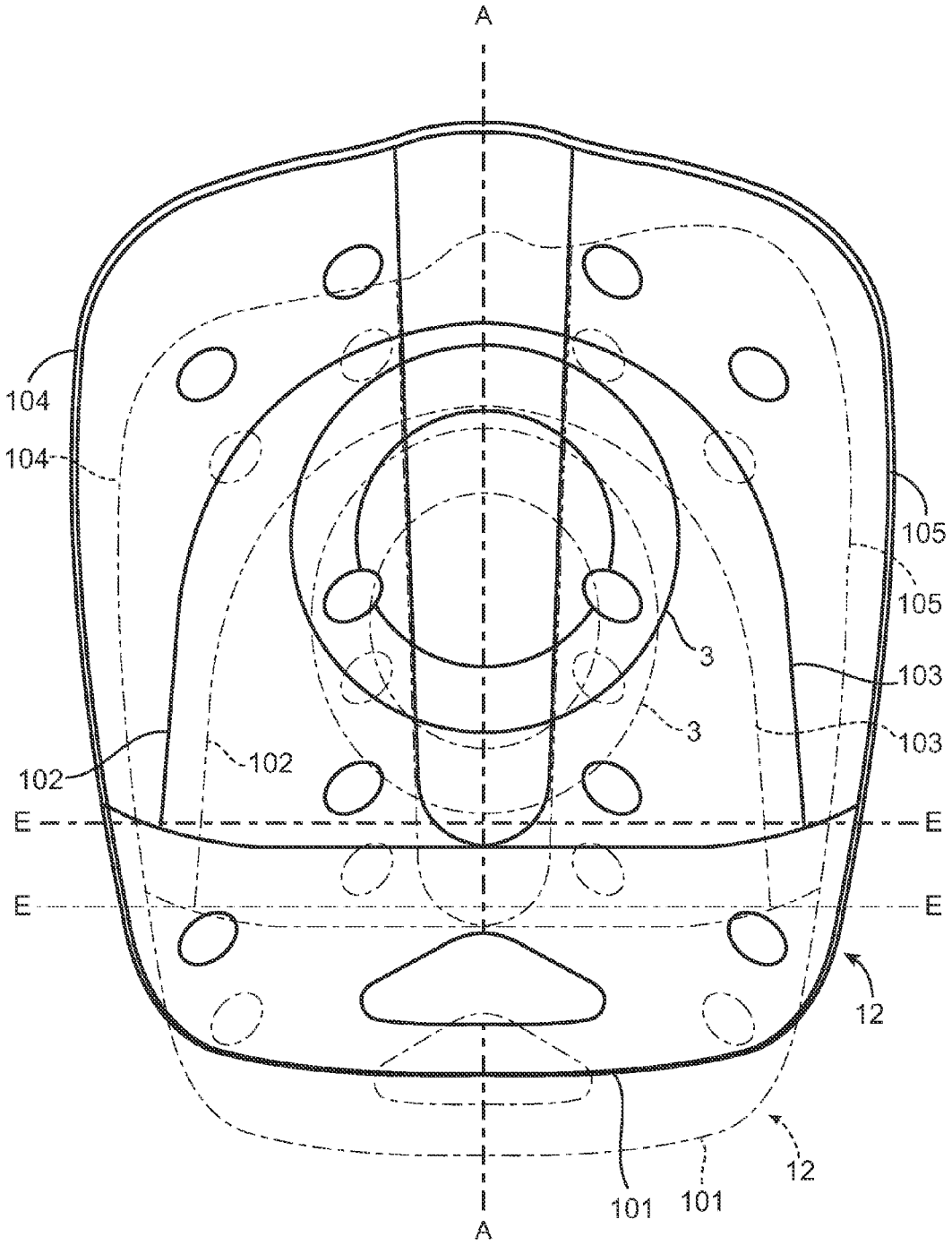
FIG. 3*e* is a view similar to FIG. 3*c*, but showing by use of dashed lines, the shifting that takes place at the time weight has been placed upon the foundation member, further torsion of the foundation member when a seated user twists to the left.

The relatively thinner regions of the foundation member 12 assist in concert with the, rotation, cupping, cradling and torsioning on its longitudinal axis A-A along with the thicker regions in one plane and torsioning on its lateral axis E-E intersecting the longitudinal axis A-A (FIGS. 3*d*, 3*e*). The lateral axis E-E is proximate the area where the front section 101 meets the bowl portion sections 102-105. The thinner region in section 101 proximate lateral axis E-E allow torsioning in that area. The axis A-A and axis E-E are collectively referred to as axes of the foundation member 12 (and device 100), herein. The thicker a regions in the concave channel 110 and central pelvic landing zone 3 keep the concave channel 110 and central pelvic landing zone 3 from distorting under the pressure from user's lower pelvic region, wherein said rotation, cupping, cradling and torsioning on the axes of the foundation member is not impeded.

The regions surrounding the central pelvic landing zone 3 and the concave channel 110 in sections 102 and 103, are relatively thinner, moving toward the out side edges. Then the foundation member is thicker again sections 104, 105, providing the tension members/regions that provide improved forward rotation and the upward cupping by the device 100.

FIG. 10*c* shows a rear view of a weight bearing position of the device 100, with an anatomical illustration, wherein arrows indicate the cupping and cradling of the gluteus muscles that place inward pressure on the lower wings of the pelvis Ischial tuberosities, by the bowl portion 20. FIG. 10D shows a rear view of the weight bearing position of the device 100, on a soft supporting surface 40*a*, wherein the bowl portion 20 of the device 100 maintains the cupping and cradling of the gluteus muscles even when the user leans sideways.

Figure 11A:
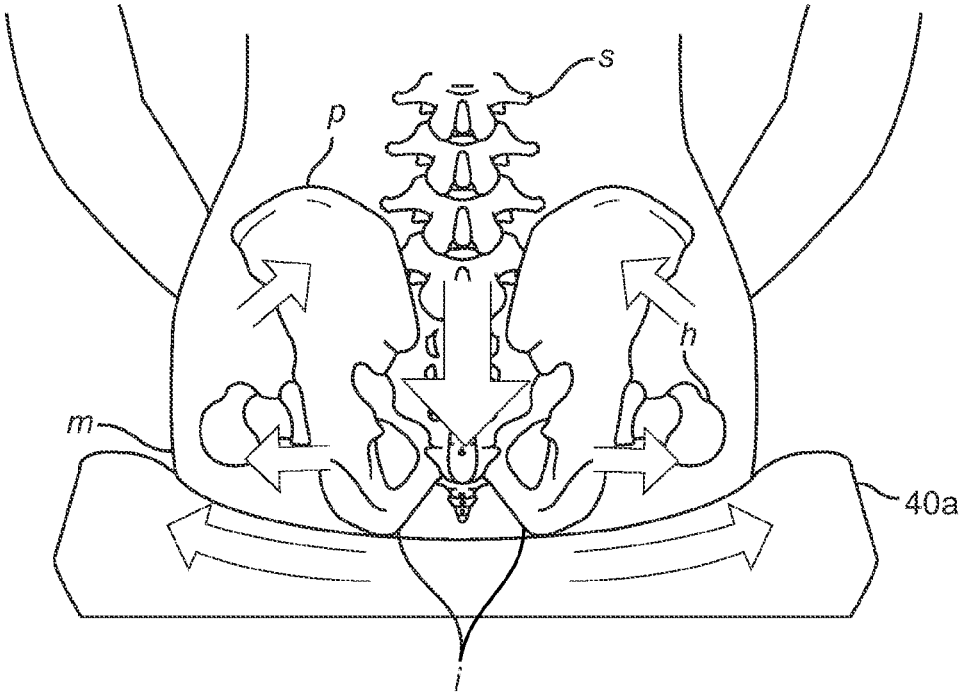
FIG. 11*a* shows a user seated on a seating surface without the seat apparatus of the invention, with the arrows indicating improper distribution of pressure and the outward movement of the lower pelvis in a sitting position of the wing like pelvis, according to an embodiment of the invention.
Figure 11B:
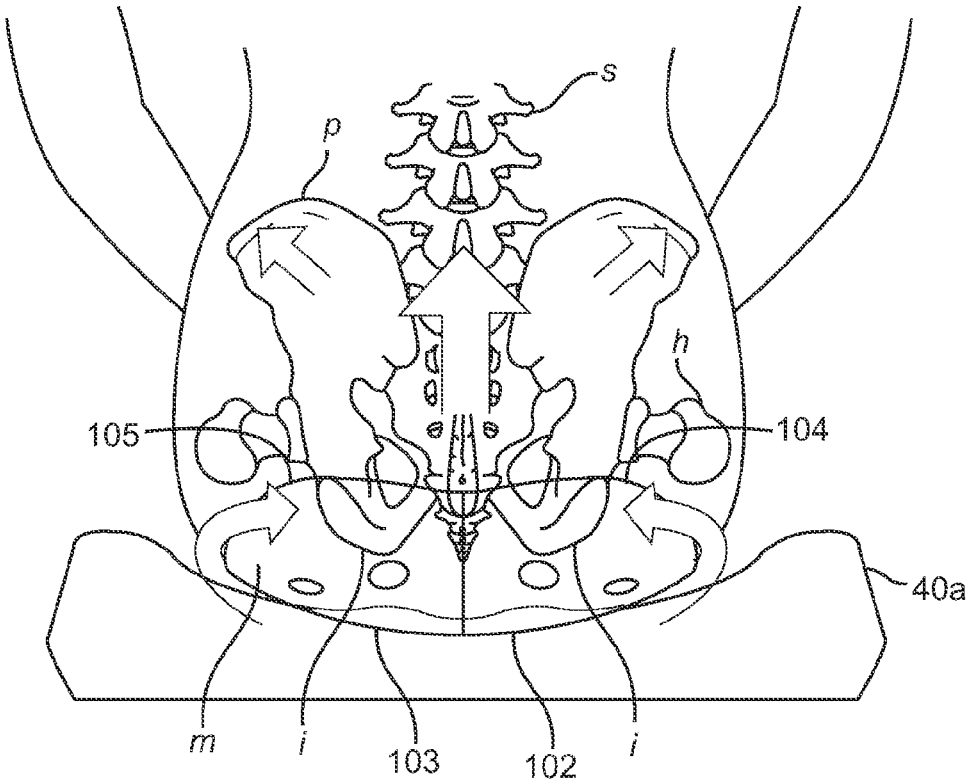
FIG. 11*b* shows another of the weight bearing seating apparatus of FIG. 10*c* with a user seated thereon, arrows indicating proper distribution of pressure cupping and cradling of the rear and side sections of the weight bearing seating apparatus and the inward movement of the lower pelvis in a sitting position of the wing like pelvis, according to an embodiment of the invention.

FIG. 11*a* shows a user seated on a seating surface without the seat apparatus of the invention, with the arrows indicating improper distribution of pressure. FIG. 11*b* shows a review of the device 100 in weight bearing position, with a user seated thereon, with arrows indicating proper distribution of pressure cupping and cradling of sections 1020-105 of the device 100.

Further, the device 100 torsions on its axes under twisting of the user weight in the bowl portion 20. The forward rotation of the device 100 tilts the user pelvis into a forward lordosis, cupping, cradling effect regardless of how the user upper or lower body twists or moves while the user remains seated on the device 100 (described further below).

Figure 19:
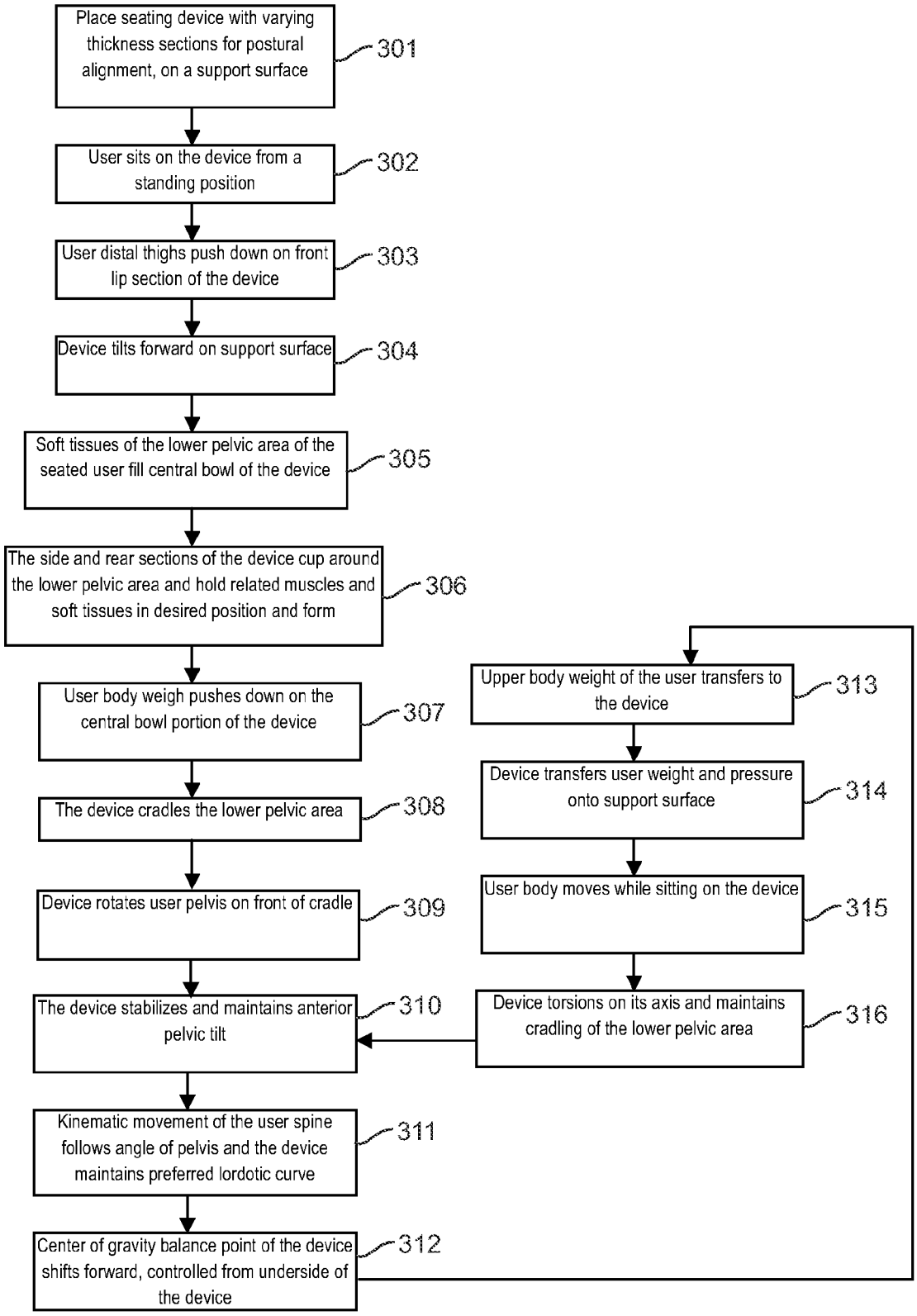
FIG. 19 shows a flowchart of a process for posture alignment, according to an embodiment of the invention.

The sections 101-105 of the device 100 with their varying thickness regions provide the cupping and cradling of a seated user into a wide range of the human the population. The device 100 in conjunction with a user sitting in the bowl portion 20, tilts, cups, cradles and torsions on its axes for continually applying dynamic support to stabilize the pelvis of a user, holding the pelvis in a correct Lordotic curve through a wide range of motion of a sitting human, and holding the user in a constant, perpetuating system. This is described further in relation to the flowchart in FIG. 19 showing a flowchart of a process 300 for correcting posture and restricting gluteal spreading for a human user, according to an embodiment of the invention. In this embodiment the process utilizes said device 100.

Generally, the device 100 is useful for a human user (e.g., male, female) capable of standing and walking, and having typical gluteus muscles of the buttocks. The device 100 is placed on a support surface (i.e., sitting surface) may be of any desired choice capable of supporting the device 100 for sitting thereon (e.g., office chair, vehicle seat, fixed bench, reclining easy seat, reclining office chair, reclining aircraft seat).

Step 301: Place seating device 100 with varying thickness sections for correcting posture and restricting gluteal spreading, on a support surface. In one implementation, the device 100 is portable for carrying from seat to seat, for use in any sitting situation from home, car, plane and office. The portable device comprises said at least five sections 101-105. In another embodiment, an optional section 106 attachment forms a backrest, but is not integral. FIG. 4*b* shows an aerial top view of the foundation member 12 (similar to FIG. 4*a*) with an optional back section 106 including a thickness region 6D.

Step 302: User sits on the device 100 from a standing position, involving user changing their posture from a standing position to a seated position by sitting on the device 100.

Step 303: Distal thighs of the user first come in contact with the front lip like section 101 of the device 100, push down on the front section 101 of the device 100. The Distal thighs hold the section 101 down against the support surface below it. One or both thighs can hold down section 101, wherein the device 100 will stay pressed down by the distal thighs. As portions 102, 103, 104 and 1055 are filled with the buttocks of the user, the device 100 becomes filled to overflowing with gluteus muscles and soft tissues until finally the sitting bones of the pelvis are above the center of sections 102 and 103 (FIGS. 8*b*, 9).

Step 304: The device 100 tilts forward (FIG. 8*b*), providing a lift tilting effect. Lift tilting is the effect of achieving an upright posture by stabilizing the sacral pelvic area of the back to sustain a forward pelvic tilt. Conventionally, achieving an upright posture is achieved by the action of the backrest of a chair using a lumbar support that pushes against the sacrum and the iliac crest of the pelvis. Further, the user must sit up against the back rest or lumbar support for achieving an upright posture. However, such conventional backrest and lumbar support does not provide a lift tilting effect according to the invention.

According to an embodiment of the invention, the device 100 provides a lift tilting effect as the device 100 rotates forward creating a typical incline angle θ of as high as about 17° (FIG. 8*b*). This incline lifts the entire pelvis upward and forward at the same time. Because the pelvis is being cupped in the central bowl portion 20 of the device 100, the incline is more than just an angle the pelvis is being rotated forward from its Ischia and sacrum. The lifting tilt of the device 100 causes the ischial tuberosities to slide forward until they are stopped by an incline 111 (FIG. 8*c*) on the front edge of the bowl portion 20, stopping atop the center of gravity balance equilibrium point bp2 (FIG. 8*b*). The incline 111 of the bowl portion 20 impedes forward motion of ischial tuberosities in the pelvic area and causing user's lower pelvic area to pivot forward into a forward lordotic position in the second position of the bowl portion 20 on a center of gravity balance equilibrium point on the supporting surface, thereby maintaining ischial tuberosities atop said center of gravity balance equilibrium point in response to user motion while the lower pelvic area is in the bowl portion.

Figure 8C:
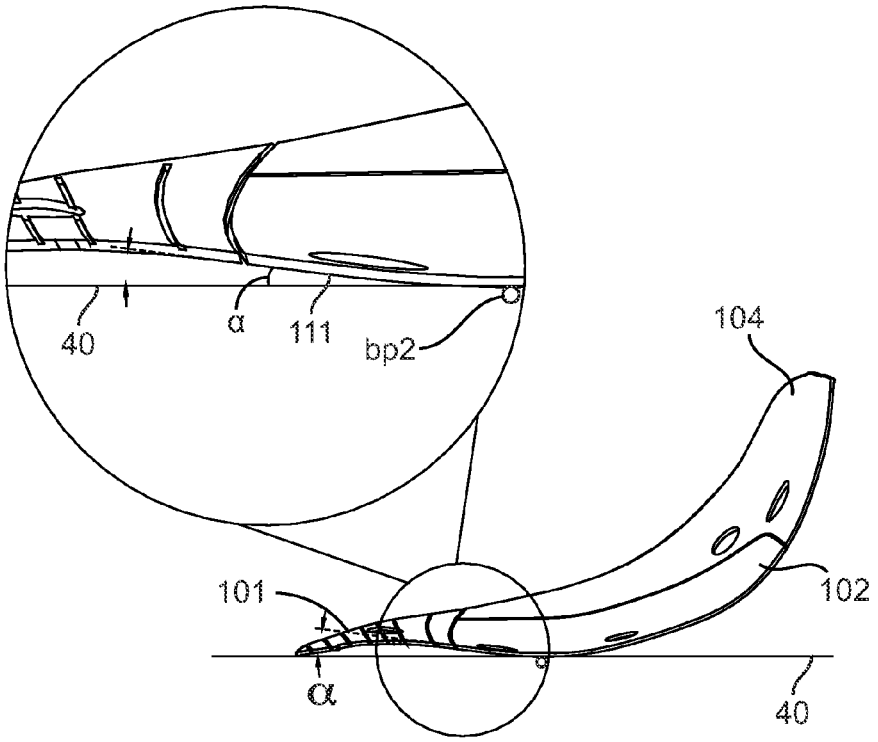
FIG. 8*c* shows a side view of the seating apparatus of FIG. 8*b* without mechanical robot anatomical skeleton, showing shifted center of gravity equilibrium point due to tilt/rotation of the seating apparatus in a weight bearing position, and a central section incline, according to an embodiment of the invention.
Figure 8D:
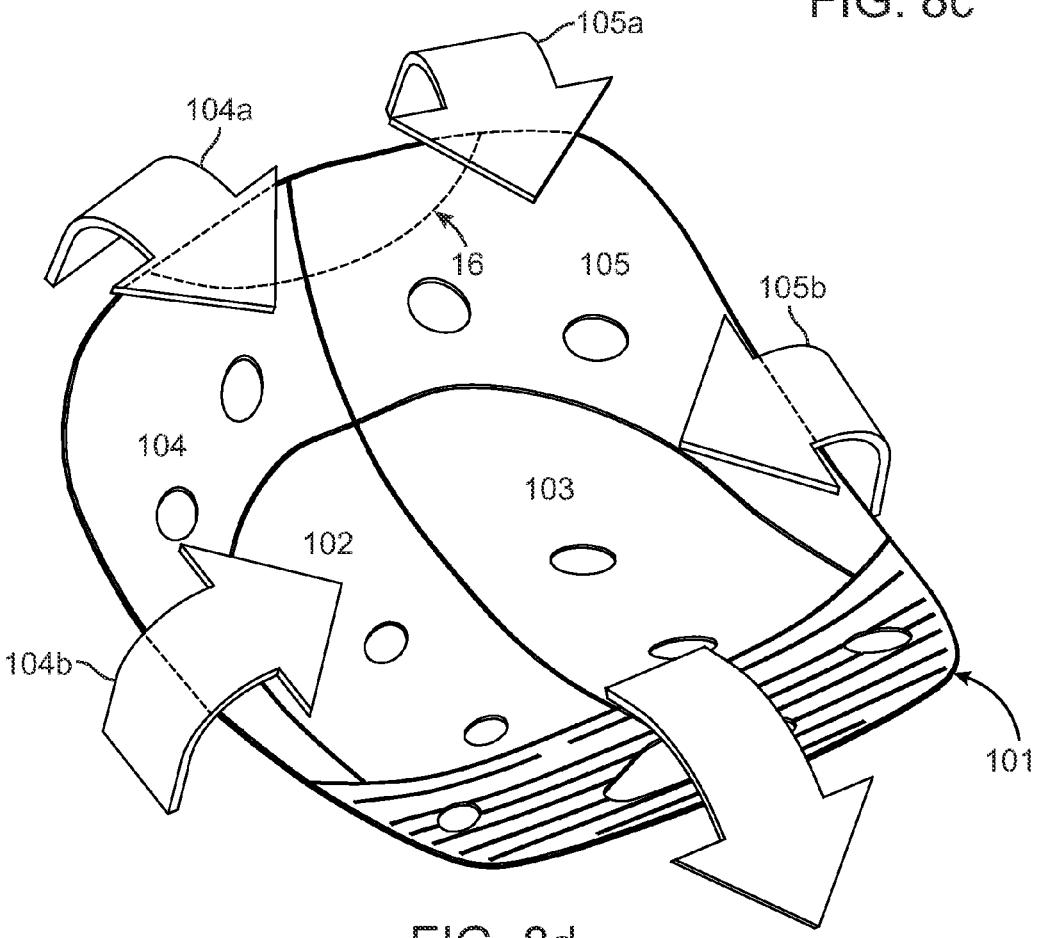
FIG. 8*d* shows a front perspective view of the seating apparatus of FIG. 1*a*, with arrows illustrating movement of the sections when the seating apparatus transitions from a non-weight bearing shape to a weight bearing shape, according to an embodiment of the invention.

FIG. 8*c* shows a side view of the foundation member 12 of FIG. 8*b* without mechanical robot anatomical skeleton, showing shifted center of gravity equilibrium point due to tilt/rotation of the foundation member 12 in a weight bearing position, and a central section incline. FIG. 8*c* also shows bending down of the front portion 101. Lift tilting by the device 100 does not require leaning up and against a backrest or against a lumbar support. Lift tilting by the device 100 occurs when the user sits thereon, wherein the device continues to actively adapt to the individual no matter how the body moves or twists or if the legs are uneven to the floor. The user legs could be crossed and still the lifting tilt is provided by the device 100. The upper body can be leaning in any direction and lifting tilt is provided by the device 100. The device 100 provides lift tilting in a perpetuating process involving the user and the device 100, without requiring the user to sit in a specific way in a typical chair to be effective.

Step 305: As the user continues the sitting process into the central bowl portion 20, the device 100 is filled in with the lower pelvic region of the seated user (FIG. 9). This includes the ischial tuberosities of the lower pelvis and their connected gluteus and piriformis muscles, skin and in any clothing of the buttocks region. When the apparatus is filled any additional muscle and soft tissue will flow over the edges on to the seating surface.

Step 306: The side/rear sections 104 and 105 move inward and upward so as to cup around the lower pelvic region of the seated user and hold the muscles and soft tissues of the user in the desired position and form, wherein the gluteus muscles replace the usually used foam, flexible mesh, feathers or other cushion type padding on conventional sitting surfaces. The device 100 causes slacking of the gluteus muscles which become an active participant with the device 100 when the gluteus muscles and soft tissues are cupped from their perimeter by sections 104 and 105. The muscle tissues as manipulated by the device 100 only provide a pressure point reducing source.

The cupping effect of sections 104 and 105, and tilting of the pelvis into the tipped and upright position by the action of the concave channel 101 when the device 100 rotates forward (FIG. 8*b*), holds the gluteus muscles in slack form. The slack gluteus muscles dramatically reduce the tightening required in other muscles and ligaments used to hold the back erect when sitting.

Gluteus muscles and soft tissues are formed and held constant under and around the ischial tuberosities by the cupping of sections 104, 105. Where the Ischial tuberosities would normally press downward into a sitting surface, the weight bearing device 100 causes the Ischial tuberosities to be held by the slack gluteus muscles on the bowl portion 20.

Step 307: As the user sits on the device 100, the user body weight moves with gravity toward the support surface under the device 100 as the user center of gravity changes from the standing position to the seated position (i.e., from over user feet and entire body, to being over the pelvis and distal thighs).

Step 308: Under user weight, the device 100 cradles the pelvic area. As the body weight pushes downward on the device 100, said cupping of sections 104, 105 around the base of the pelvis stabilizes and restricts the spreading of the lower pelvis, keeping it from spreading apart such that the six component bones of the pelvis can work fluidly as one unit. As such, building of pressure on the lumbar-sacral joint is restricted, thus minimizing wear and tear on the sacral joints. While being supported in the cradled position (FIG. 8*b*), the pelvis can articulate and move with the user movement while the user remains seated and move and twists.

Step 309: Pelvis rotates pivoting on front of Cradle. The cradle comprises the entire sections 102-105, once the bowl portion is in the second position and all the body weight and pelvic alignment has occurred (i.e., cupping effect). The cradling is maintained by sections 102-105, in a continual manner no matter how the sitter moves. The front of the cradle comprises about a 7° incline area 111 in regions of the sections 102, 103, along with regions of the sections 104, 105, proximate the width of section 101. Action of gravity continues to pull the user body weight downward into central bowl portion 20 of the device 100, wherein the bottom of the pelvis is tipped on a pivot and rotated forward by the front edge of the cradle. The rotation is stopped by said upward incline 111 (FIG. 8*b*) of sections 102 and 103 where the meet section 101. Said incline of sections 102 and 103 has an angle $\alpha$ of about 7° from a horizontal support surface in one example, which is sufficient to stop the forward movement of the Ischia. When the Ischia can no longer slide forward, this causes the top of the pelvis to pivot forward bringing about a chain like spine. The spine being a closed kinematic chain must follow the pelvic tilt. Although floating in a layer of cupped muscle tissue, the pelvic pivoting is maintained by the device 100 in response to the weight of the upper body. By using the energy created by gravity of the body weight, the device 100 provides a continual perpetuating process for correcting posture and restricting gluteal spreading that turns the upper body weight from a negative effect into a positive effect on the posture and gluteal spreading.

Step 310: The device 100 stabilizes pelvis and maintains anterior pelvic tilt. Rotation of the pelvis on the front of said cradle stops at a point of equilibrium balance point bp2. (FIGS. 8*b*, 12*a*, 12*b*). The tilting lift causes the ischial tuberosities to slide forward until they are stopped by the upward curve/incline 111 of the central bowl area sections 102 and 103. Said incline 111 of sections 102 and 103, stops the ischial tuberosities from their forward movement forcing the top of the pelvis to pitch forward. This pelvic forward rotation is maintained by the weight of the upper body. The center of gravity balance equilibrium point bp2 and the kinematic chain effect of the spine (properly aligned and balanced) are all maintained by the torsion of the device 100 on its axes.

When the spine is properly aligned and balanced, the thoracic region has a Kyphotic curve. The cervical and lumbar spine region has a Lordotic curve. Together these curves provide an "S" shaped preferred posture (FIGS. 1*d*, 16*a*, 16*b*, 16*c*) which the device 100 provides according to the invention. The present invention provides postural alignment using the natural equilibrium of the body without the seated user having to lean back against a backrest.

The device 100 interacts with the user distal thighs to initiate a postural alignment process. Once the device is in its weight-bearing (dynamic) position, the user distal thighs remain horizontal or above horizontal, enabling the feet to remain flat on the ground throughout the postural range. Further, because the distal thighs push down the front lip section 101, the sections 104 and 105 cup and forward rotation of the device 100 by the angle θ (FIG. 8*b*), lifts the pelvis, providing a preferred angle relationship. The preferred angle relation involves the knees being lower than the hip joint. This in turn transfers (distributes) a portion of the upper body weight away from initial tuberosities onto the distal thighs, sharing body weight pressure over a larger area.

Step 311: The spine is Lordotic and is controlled by the position of the pelvis. When the pelvis is rotated forward, the lumbar spine automatically creates a forward Lordotic curve. The inventor has found the unexpected result that use of the spine as a closed kinetic chain helps contribute to better posture and more comfort while sitting.

In the weight bearing position, the cupping and rotating effect of the device 100 move the pelvis into a forward position that influences the spine (FIG. 2*a*), wherein the spine follows the pelvis until it cannot fall any more forward wherein the front of the user anatomy (ribs, diaphragm, etc.) stops the spine from continuing to fall or fold. At that point, the spine is in a balanced position of "Neutral Posture" that requires the least amount of strain to hold it erect. The device 100 causes a cradled pelvis to induce the preferred "S" shape posture in a balanced postural equilibrium bp2, natural alignment throughout the full range of postures.

Step 312: In the weight bearing position, the center of gravity balance point of the device 100 shifts forward from bp1 to bp2 shifts forward (FIGS. 8*b*, 12*a*, 12*b*). The balance (pivot) point is located just underneath the center of gravity point bp2 on the bottom side of the apparatus. In this position of the device 100, the pelvis is held in an upright neutral posture and balanced position. Upper body weight is shifted into a ring like pelvis. Because a unique Lordotic curve has been achieved, the center of gravity shifts forward away from the sacrum and onto the tips of the ischial tuberosities. Once the center of gravity balance point is achieved the natural equilibrium of the user spine and pelvis can be achieved and maintained. The inventor has determined that this natural equilibrium for each user is unique and is initiated by the device 100 by controlling the pelvis which in turn controls the chain like lumbar spine thoracic spine and cervical spine.

Figures 13A, 13B:
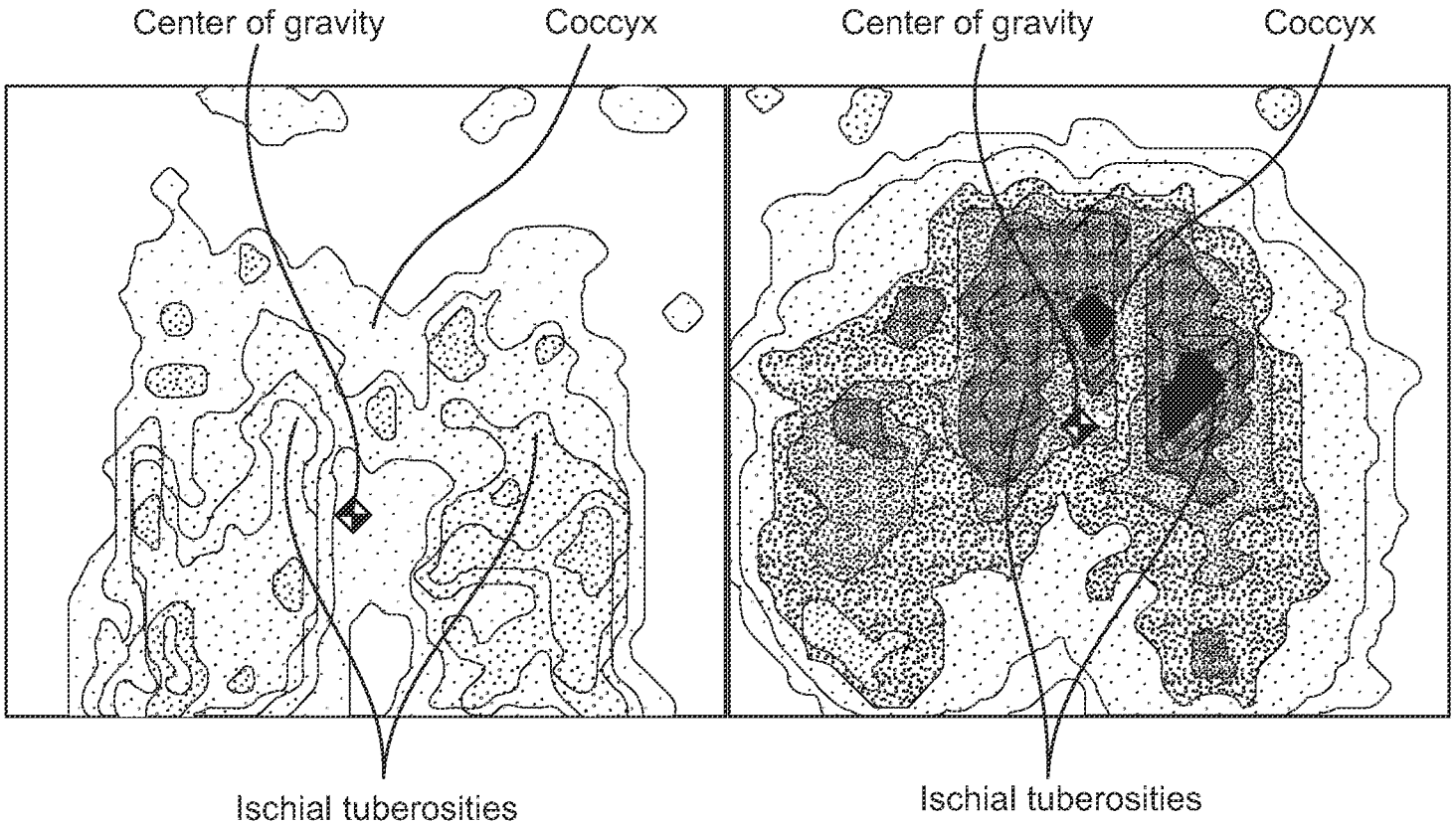
FIG. 13*a* illustrates a bottom view of an actual pressure map on a user seated on an embodiment the seating apparatus according to the invention, showing a center of gravity indicator.
FIG. 13*b* illustrates a bottom view of actual pressure map on a user seated on a conventional ergonomic seat, showing a center of gravity indicator.
Figure 14A:
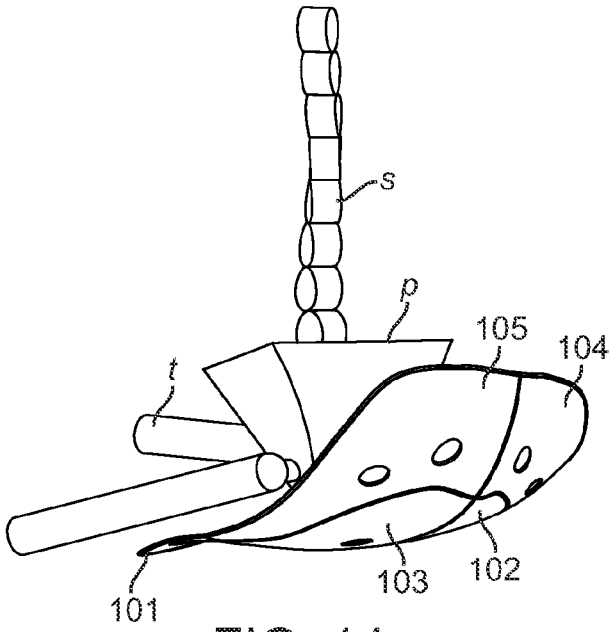
FIGS. 14*a* through 14*i* show different perspective views of the apparatus of FIG. 1*a* in weight bearing positions under weight of a seated user, indicated by a mechanical robot anatomical skeleton representation, illustrating the effect of a twisting of spine and various load positions due to movement of the seated user in the course of natural sitting over a period of time, according to an embodiment of the invention.
Figure 14B:
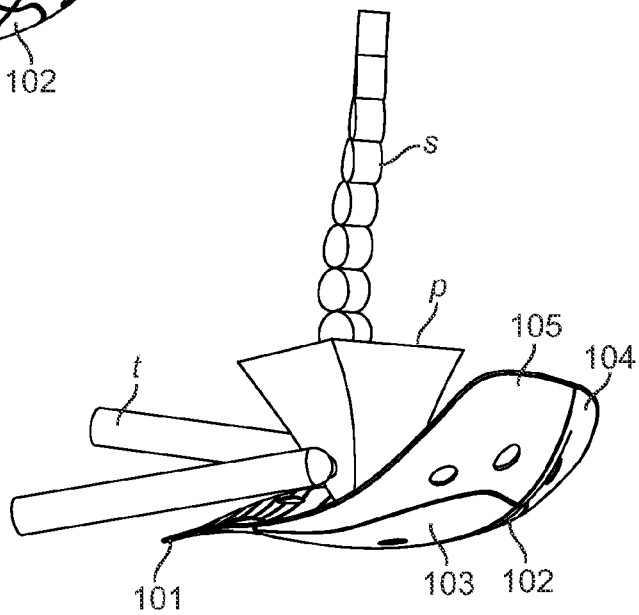
Figure 14C:
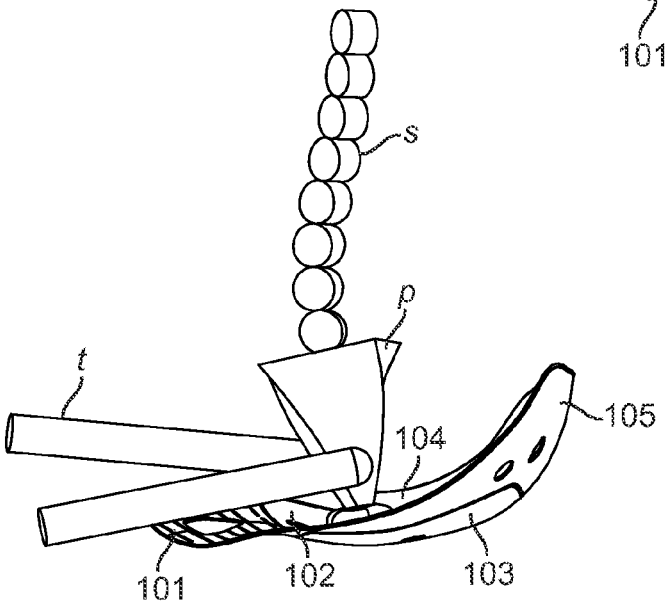
Figure 14D:
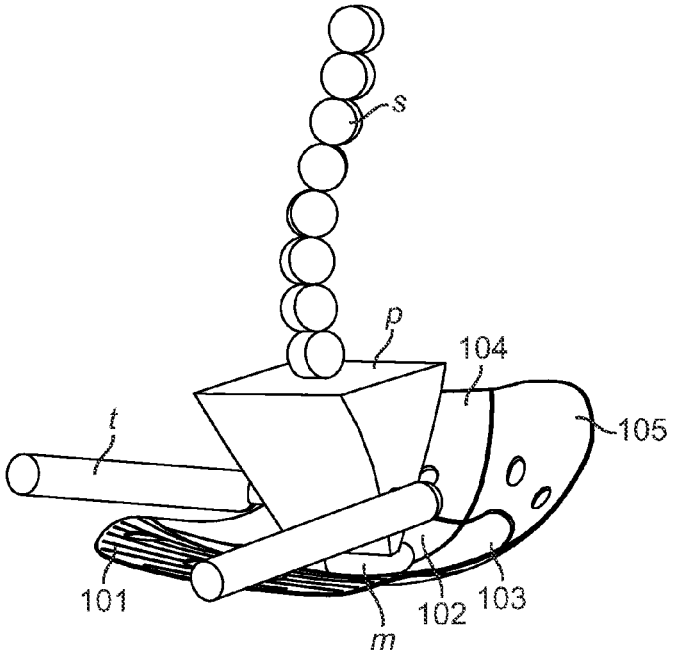
Figure 14E:
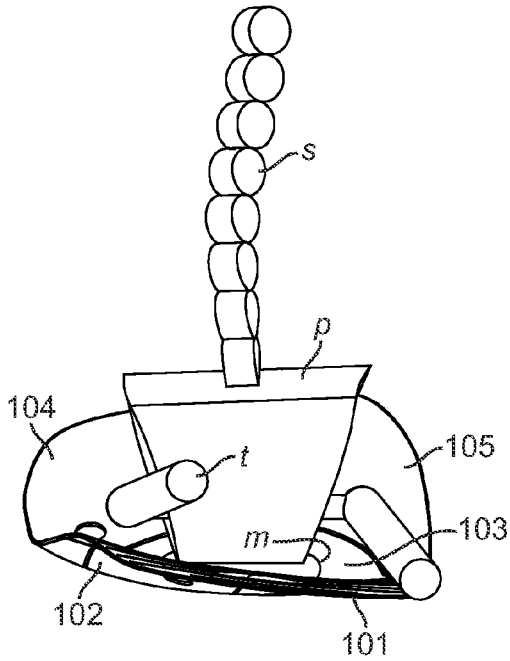
Figure 14F:
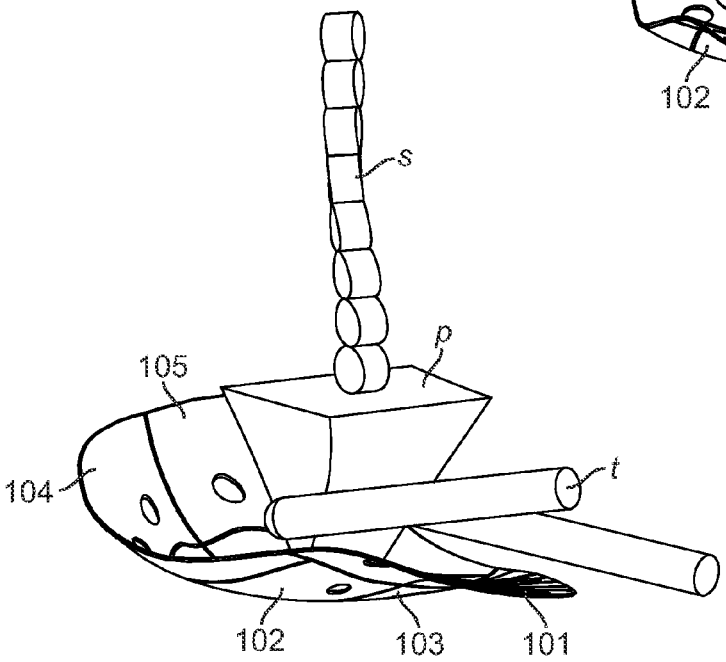
Figure 14G:
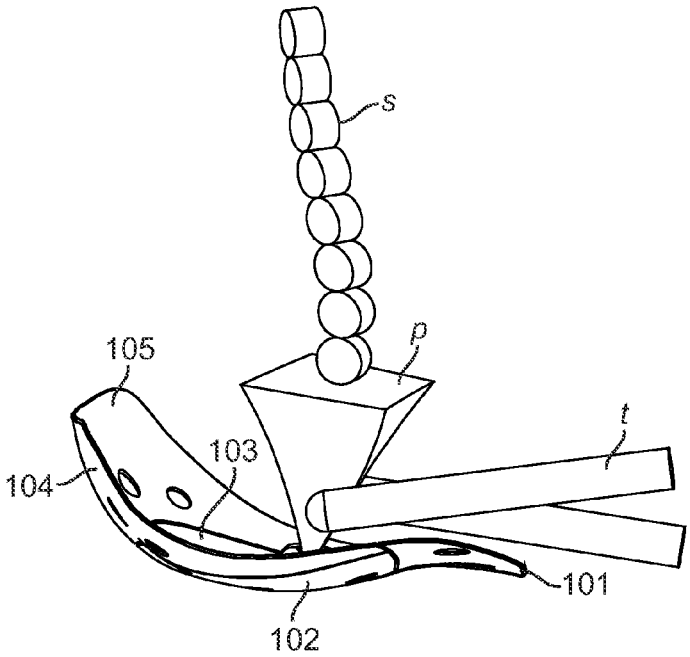
Figure 14H:
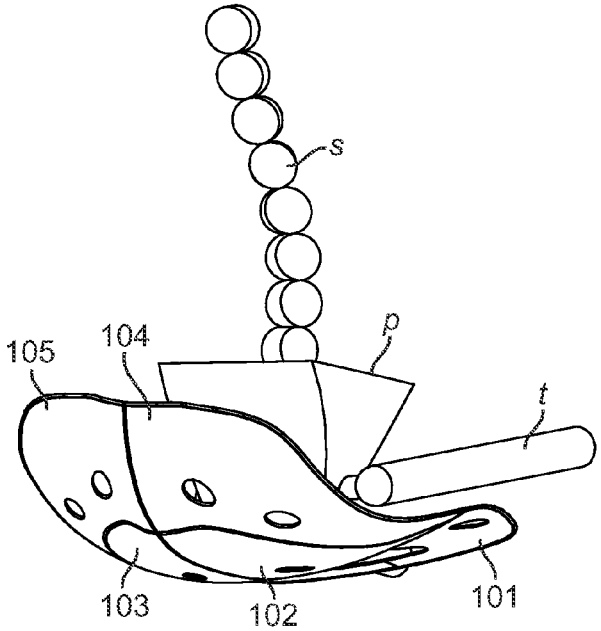
Figure 14I:
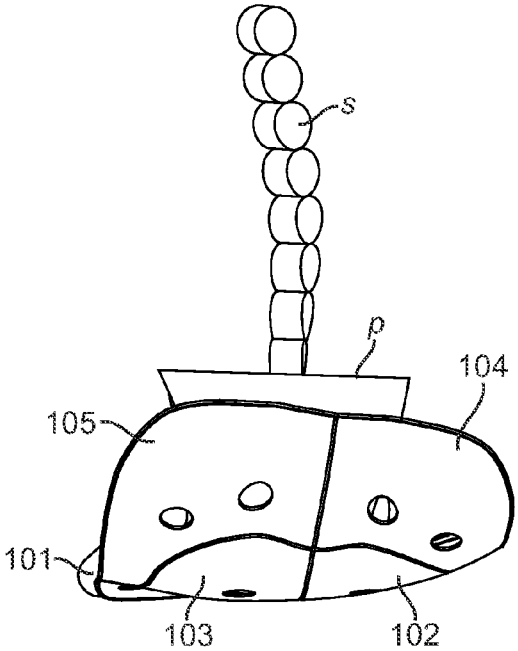

FIG. 13*b* illustrates a bottom view of actual pressure map on a user seated on a conventional seat such as a chair, indicating multiple high-pressure marks from the ischial tuberosities while in an upright position. Darker regions indicate higher-pressure marks. FIG. 13*a* illustrates a bottom view of an actual pressure map on a user seated on an embodiment of the device 100, wherein FIG. 13*a* indicating far fewer high-pressure marks from the ischial tuberosities than in FIG. 13*a*, while in an upright position when the weight bearing device 100 tilts/rotates forward, and cups and cradles the pelvis area, while floating the pelvis in muscle tissue. Further, FIG. 13*a* shows the center of gravity of the user, indicated by a checkered diamond shape, shifting forward (toward the bottom of the drawing sheet) using the device 100 compared to a conventional seat.

Step 313: The upper body weight transfers to the device 100 to become an exoskeleton shell. Specifically, with the pelvis cradled and held in the center of gravity balance equilibrium point posture (FIG. 2*a*, 8*b*) by the weight bearing device 100, the upper body weight moves down through the pelvis, then through the soft tissues of the gluteus and distributes essentially evenly into the sections 101-105 of the device 100. Because the soft tissues and muscles of the gluteus fill the central bowl portion 20 of the device 100 (FIG. 9) and sections 104, 105 cup upward (FIGS. 8*b*, 8*c*), the device 100 becomes an exoskeleton shell for said muscles and soft tissues around the ischial tuberosities.

Step 314: The device 100 transfers weight and pressure into the supporting surface under the device 100. Specifically, functioning as an active orthotic area of the supporting surface (e.g., seat pan), the device 100 distributes the weight and pressure from the user weight onto the supporting surface. The supporting surface now carries the greatest pressures, not the surface of the seated user skin. The function of transferring upper body weight and pressure into supporting surface by the weight-bearing device 100 provides the exoskeleton attributes. Once the gluteus soft tissues have been cupped by sections 104 and 105, the pelvis is cradled by the sections 104 and 105, and rotated forward for stabilization on the center of gravity point bp2 (FIG. 8*a*-1) as described. Upon such stabilization, essentially all body weight of the sitting user is transferred from the bones through the soft tissues and into the weight bearing device 100. The central bowl portion of the device 100 distributes that weight evenly onto the supporting surface 40. When the seated user body moves, the device 100 maintains user weight distribution through said exoskeleton shell effect Step 315: As the seated user body moves (e.g., such as twisting while working on a desk top), the device 100 adapts to changed body position of the user.

Step 316: As the seated user moves, the device 100 torsions on its axes (FIGS. 2*c*, 2*d*, 12*e*, 12*g*) to maintain its cradling position. The device 100 continually applies support by torsion on its axes, maintaining constant dynamic pelvic support. The device 100 essentially constantly adjusts and maintains several simultaneous mechanical functions of tilting/rotating forward, cupping and cradling the pelvis area, while floating the pelvis in muscle tissue.

Figure 12E:
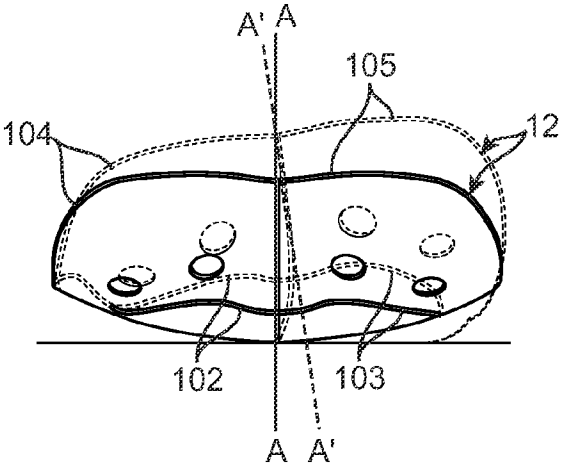
FIGS. 12*d* and 12*e* show corresponding side and back views, respectively, of the seating apparatus of FIG. 1*a*, with superimposition of weight bearing position of the seating apparatus in solid lines, and weight bearing position of the seating apparatus in dashed lines with torsion on its longitudinal axis and a lateral axis due to rotation of the upper body of a seated user to the right, according to an embodiment of the invention.
Figure 12G:
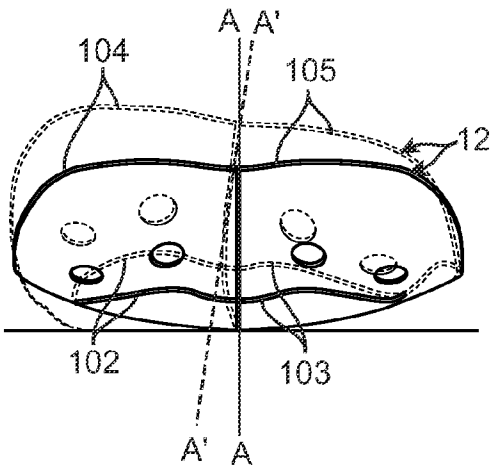
FIGS. 12*f* and 12*g* show corresponding side and back views, respectively, of the seating apparatus of FIG. 1*a*, with superimposition of weight bearing position of the seating apparatus in solid lines, and weight bearing position of the seating apparatus in dashed lines with torsion on its longitudinal axis and a lateral axis due to rotation of the upper body of a seated user to the right, according to an embodiment of the invention.
Figure 12D:
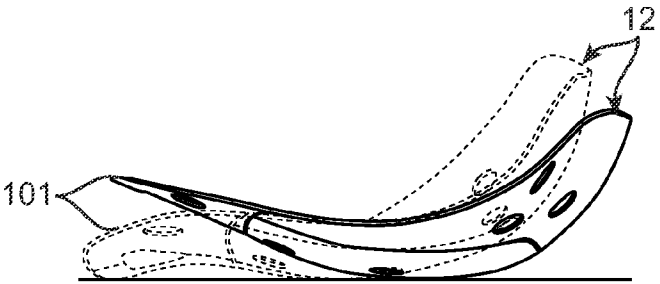
Figure 12F:
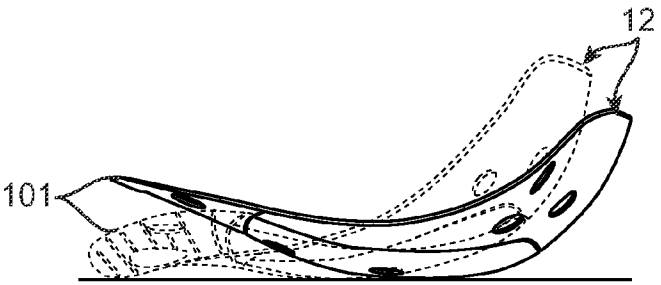
Figure 16A:
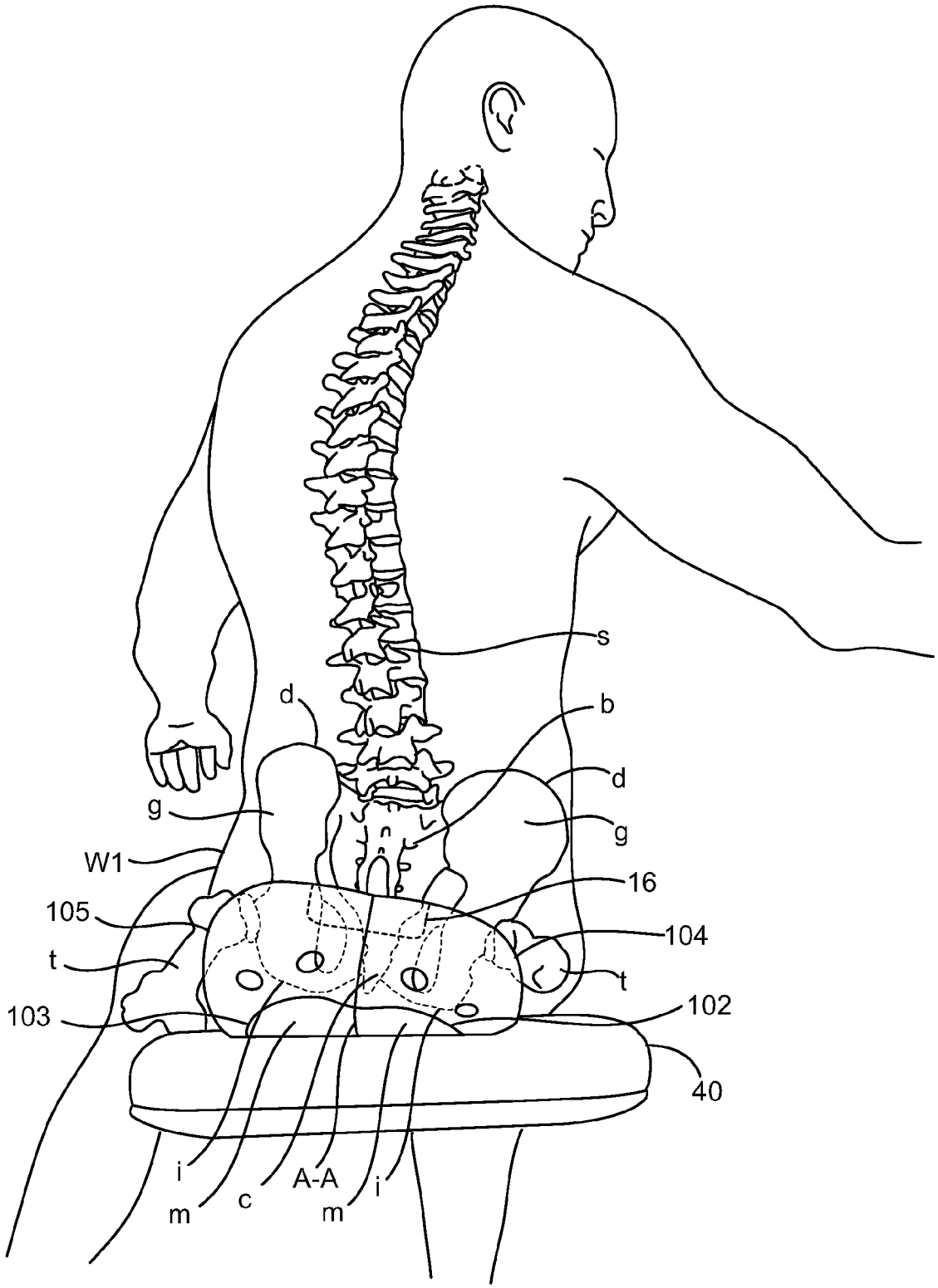
FIGS. 16*a*-16*c* show a user seated on a seating apparatus in FIG. 1*a* from different perspectives, with the upper body of the user twisted to one side, illustrating how the seating apparatus torsions and aligns the pelvis into a lordotic posture while the body moves and twists, according to an embodiment of the invention.
Figure 16B:
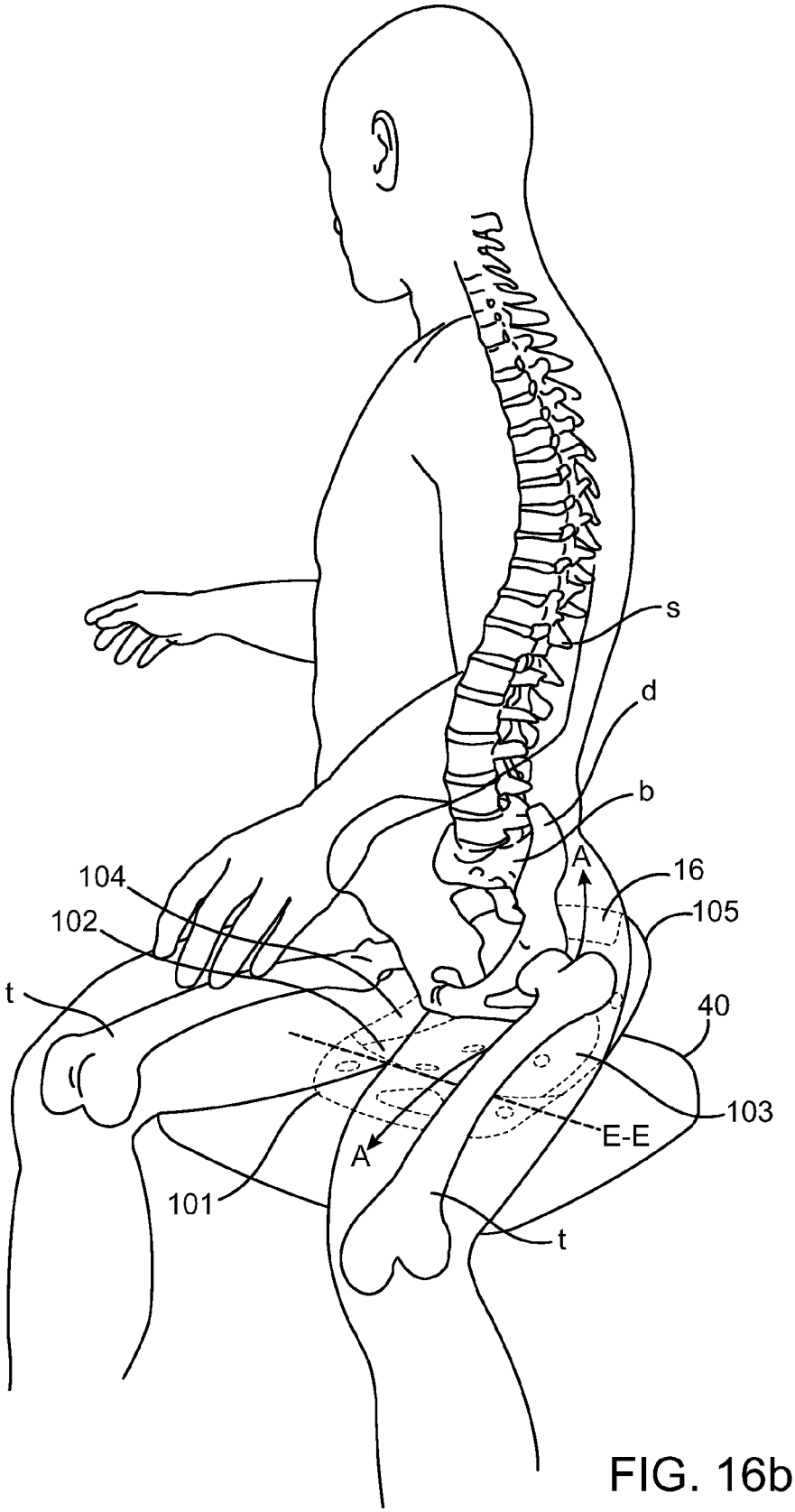
Figure 16C:
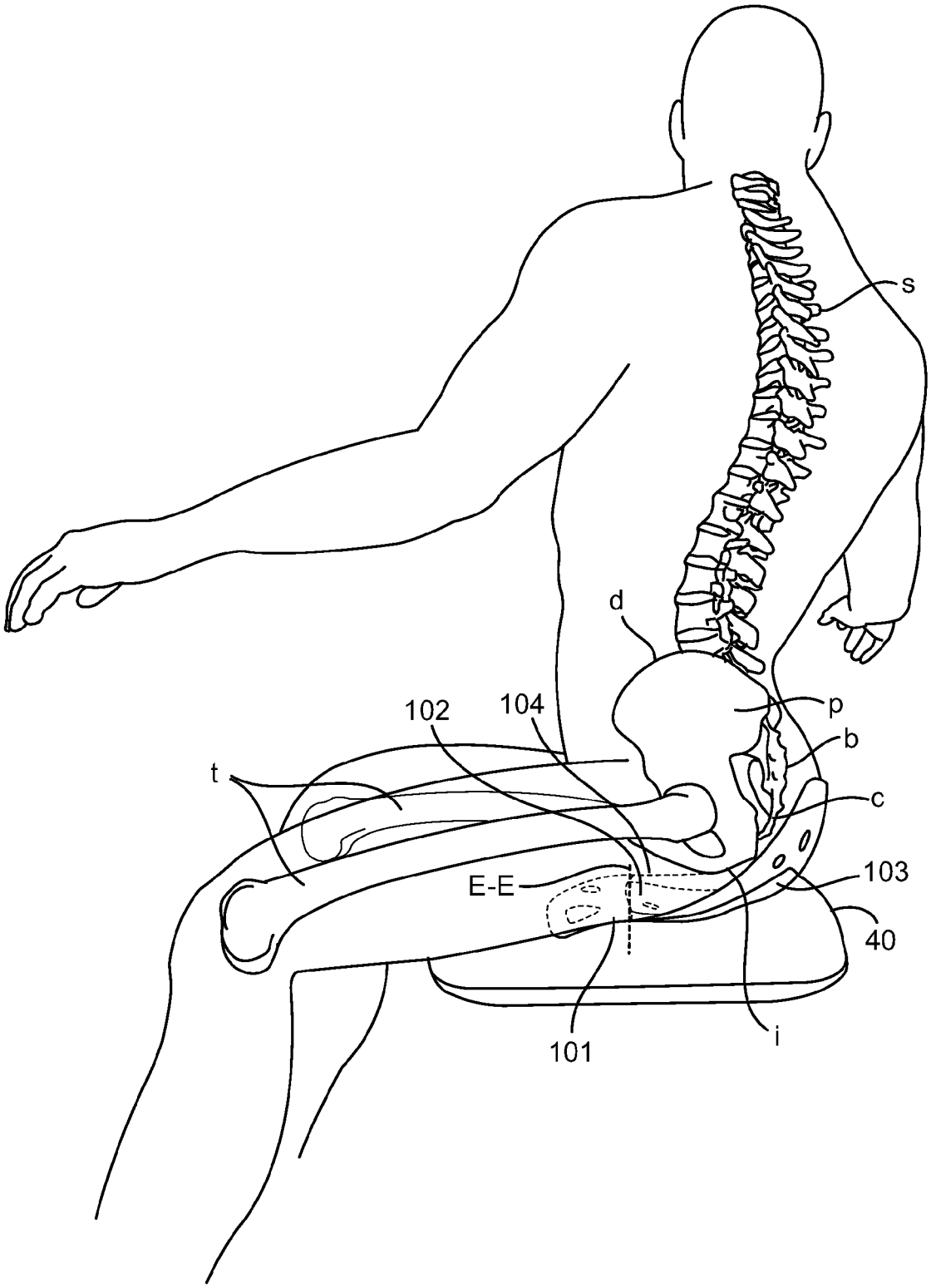

FIG. 3*d* is similar to FIG. 3*c*, and shows by use of dashed lines, the shifting that takes place at the time weight has been placed upon the foundation member 12, and downward tilting of the front, lip-like portion section 101, and further torsion of the foundation member on its axes when a seated user twists to the right (e.g., FIGS. 16*a*-16*c*). The sections 105 104 dynamically move forward following the pelvis sacrum to maintain pressure therein. FIGS. 12*f* and 12*g* show corresponding side and back views, respectively, of the seating apparatus of FIG. 3*d* torsioning along its axes, with superimposition of the weight bearing position of the device 100 in solid lines, and torsioning of the weight bearing position of the device 100 in dashed lines due to rotation of the upper body of a seated user to the right.

FIG. 3*e* is also similar to FIG. 3*c*, and shows by use of dashed lines, the shifting that takes place at the time weight has been placed upon the foundation member 12, and downward tilting of the front, lip-like portion section 101, and further torsion of the foundation member on its axes when a seated user twists to the left. FIGS. 12*d* and 12*e* show corresponding side and back views, respectively, of the seating apparatus of FIG. 3*e*, with superimposition of the weight bearing position of the device 100 in solid lines, and torsioning of the weight bearing position of the device 100 in dashed lines due to rotation of the upper body of a seated user to the left.

The device 100 continually applies support by torsion on its axes along the length of the concave channel 110. Regardless of the type of the upper body twisting and motion of the user, the device 100 responds to the user body position by torsion on its axes to apply dynamic support in stabilizing and holding the pelvis in proper lordotic curve. Regardless of the lean of the pelvis as the seated user moves/twists, the device 100 torsions in response to adjust on its axes to maintain the dynamic support in stabilizing the pelvis. FIGS. 2*c*, 2*d*, show how the lower body twists and the upper body spine twists and how the torsion along its axes reacts to the twisting movement of the user.

FIG. 14*a* through FIG. 14*i* show different perspective views of the device 100 in weight bearing positions under weight of a seated user, indicated by a mechanical robot anatomical skeleton representation, illustrating the effect of a twisting of spine and various load positions due to movement of the seated user in the course of natural sitting over a period of time.

With the user's lower pelvic area disposed in the bowl portion, twisting movement of the user while sitting causes torsion of the foundation member 12 along its axes which causes torsioning of the rear segment 16 of the bowl portion 20 such that said upward and inward motion of the upper edges of the segments 104, 105 of the bowl portion 20 follows twisting of the user's lower pelvic area. As shown in FIGS. 16*a*-16*c*, the segments 104 and 105 continue applying an upwardly and inwardly compressive force to cause a forward rotational tilting of the user's lower pelvic area into a lordotic position, while maintaining the bowl portion in said second position.

The process steps 310-316 are repeated as long as the user remains seated on the device 100 and moves/twists, providing a perpetuating system. When the user body moves or shifts, the cradling effect is adjusted as the device 100 torsions on its axes in response to the user motion. Essentially, the cradling effect of the device 100 "resets" as the seated user naturally moves, maintaining the sated user in a constant, perpetuating correct posture and restricted gluteal spreading. Because a proper Lordotic curve specific to the seated user is achieved by the device 100, the user center of gravity shifts forward away from the sacrum and onto the tips of the ischial tuberosities. Once the center of gravity balance point is achieved, the usernatural equilibrium is achieved and maintained. Achieving this natural equilibrium for each user utilizing device 100 is unique, and results from the device 100 controlling the pelvis which in turn controls the chain like lumbar spine thoracic spine and cervical spine. Action of said sections 101-105 according to the process 300 may be implemented by other materials or structures that will respond and adapt to the user shape.

The device 100 functions as an exoskeleton shell in the weight-bearing position by providing said cupping, cradling, and orthotic floating. Because muscle tissue is 70% water and fat tissue is 35% water, the skin acts much like a latex balloon filled with water. The bowl portion 20 allows the muscles of the user's lower pelvic area to distribute pressure from the user's weight evenly into the bowl portion 20. When disposed in the bowl portion 20, the muscles of the user's lower pelvic area fill the bowl portion and the ischial tuberosities push the muscle and soft tissues of the user's lower pelvic area into bowl portion 20. As the muscle and soft tissues of the user's lower pelvic area fill the bowl portion 20 of the device 100 and the ischial tuberosities are suspended in the muscle tissue, the user's upper body weight is transferred through muscle tissues and into the skin. The skin transfers the pressure into the device 100. Thus the device 100 becomes an exoskeleton shell. The exoskeleton shell is disposed on the supporting surface (40 or 40*a*), wherein the inner surface of the device 100 receives all the pressure of the upper body of the user, and transfers the pressures against the supporting surface. At the same time, suspended in the muscle tissue by the bowl portion of the device 100, the pelvis floats stabilized and cradled. The pelvis is able to articulate, while being held in a forward lordosis by the device 100. Unlike conventional reclined tilting seats, the device 100 provides an upright posture without the negative side effects of increased pressure points under the ischial tuberosities.

In a preferred embodiment of the invention, the foundation member 12 is a one piece member molded from memory retentive material such a nylon plastic with the varying thickness regions as shown by example in FIG. 4*a*. The depiction in FIG. 4*a* also shows the relative scale of the various regions in relation to one another, where the retentive material essentially gradually changes in thickness from one region to another. Each of the sections 101 through 105 shows a grouping of the regions it is made of as shown in FIG. 4*a*, wherein there is no physical separation between the sections 101-105.

Figure 6A:
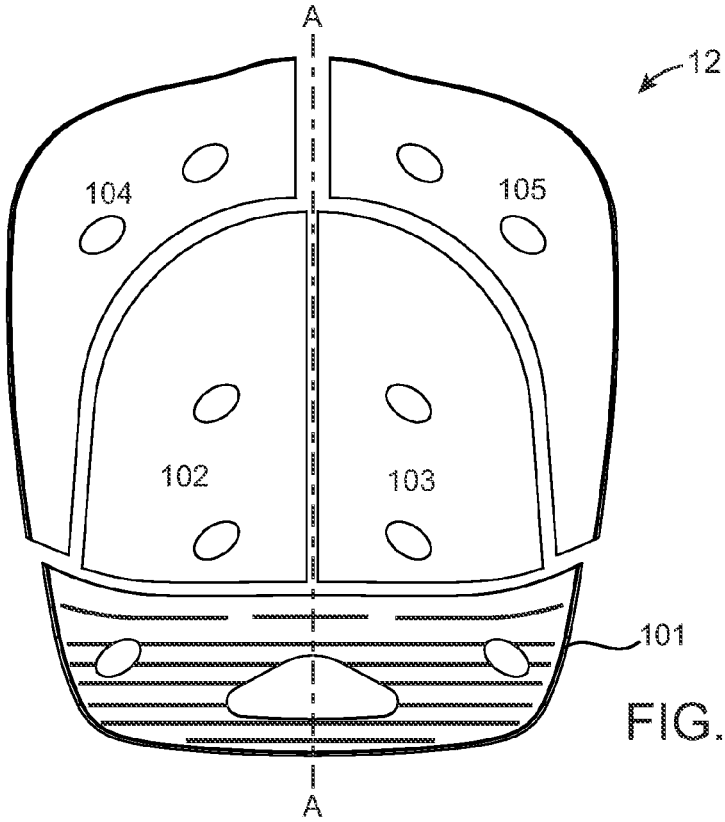
FIG. 6*a* shows an aerial top view of the seating apparatus, with multiple individual sections, according to an embodiment of the invention.
Figure 6B:
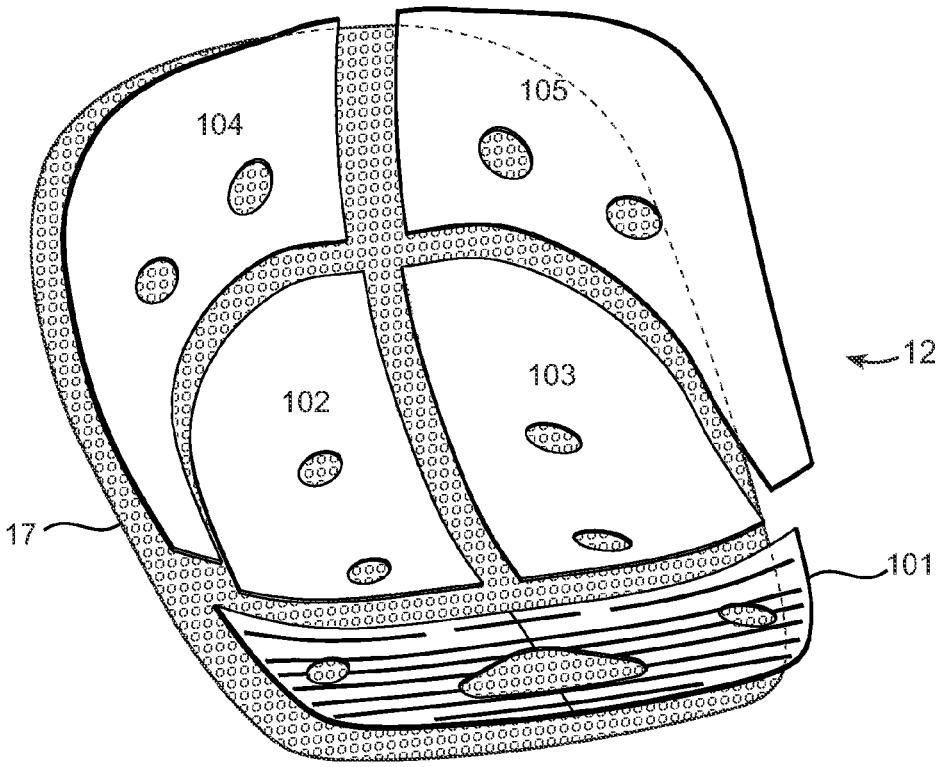
FIG. 6*b* shows a perspective view of the seating apparatus of FIG. 6*a*, with multiple sections shown exploded to illustrate a connection mechanism for the multiple sections, according to an embodiment of the invention.

In another embodiment of the invention (FIGS. 6*a*-6*p*), the sections 101-105 are individual sections and are connected together by a connecting mechanism such as membranes, cabling, hinges, linkages, etc. FIG. 6*a* shows an aerial top view of the sections 101-105 of the foundation member 12, and FIG. 6*b* illustrates a perspective view of the sections 101-105, revealing an example connection mechanism comprising a membrane 17 to which the sections 101-105 are attached. The connection membrane 17 can be in the shape of a continuous membrane as shown, or multiple membrane sections corresponding to sections 101-106 for connecting the peripheries of the sections 101-105 together.

In another embodiment, the present invention provides an integrated system comprising said sections 101-105 (and optionally 106) of the device 100, in a seat (e.g., car seat, plane seat, office sect). Such an integrated system comprises a foundation that can be made from a wide variety of materials, including foams, plastics, air bladders, and other materials. The physical makeup of the component materials (e.g., with varying thickness ranges) according to the invention, allows the sections 101-106 (FIGS. 6*a*-6*p*) to induce physical change to a seated user gluteus form as described according to the process 300 herein. The sections 101-106 of the foundation member 12 work together according to the process 300. In addition to nylon, other materials such as biomechanical devices may be used for the sections 101-106 that react to computerized data and have behavioral ability according to the process 300. In the integrated system, the individual sections 101-106 can move apart, move in different angles and or partially slide over one another, to decrease the size of the overall apparatus as shown by examples in FIGS. 6*c*-6*i*, and 6*j*-6*p*, further below. Action of said individual sections 101-105 according to the process 300 may be implemented by other materials which may have embedded intelligence and or information inherent in the materials themselves, that will respond and adapt to each user's unique requirements. The embedded intelligence and or information materials do not require computerization to adapt to the user according to the process 300. However, computerization using sensors, actuators, and controllers may be implemented (e.g., FIG. 6*m*).

Figure 6C:
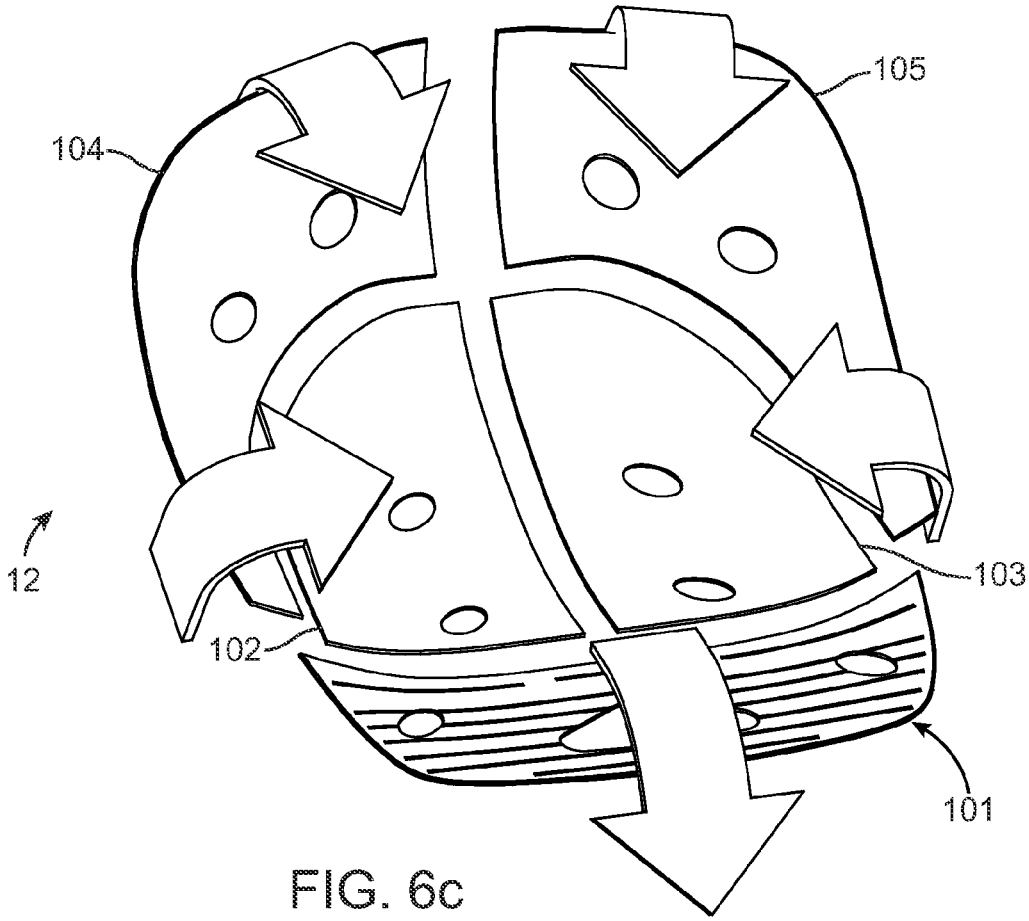
FIG. 6*c* shows a perspective view of an integrated seat pan configuration of a seating apparatus according to an embodiment of the invention, with arrows illustrating movement of the sections when the seating apparatus transitions from a non-weight bearing shape to a weight bearing shape.
Figure 6D:
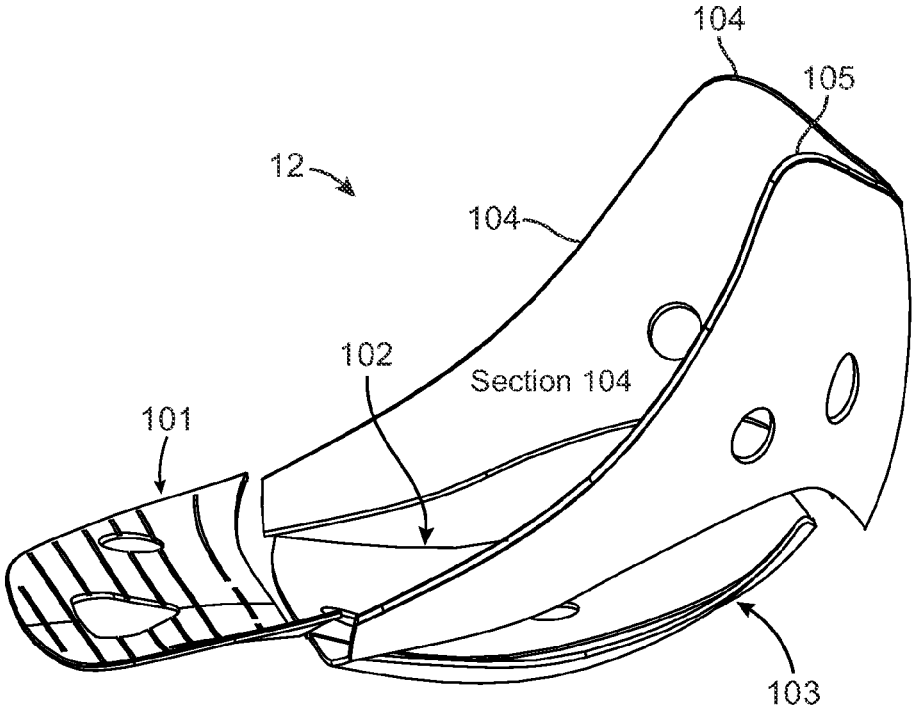
FIG. 6*d* shows a perspective view of the seating apparatus of FIG. 6*c*, when the seating apparatus transitions from a non-weight bearing shape to a weight bearing shape, according to an embodiment of the invention.

FIGS. 6*c*-6*i* represent example integrated seat pan configurations of individual sections 101-105 that can be used to optimize the movement of the sections 101-105 while built-in to a secondary seat pan, such as built into an office seat, car seat, etc. The sections 101-105 are held in place by a backing (not shown) which may be braided together or have backing similar to the membrane 17 in FIG. 6*b*. FIG. 6*c* shows a perspective view of the sections 101-105 in integrated seat pan configuration, with arrows illustrating movement of the sections 101-105 in transition from non-weight bearing shape to a weight bearing shape, described above. This articulation is for a larger configuration. FIG. 6*d* shows a slightly turned perspective view of the sections 101-105 in a secondary, weight bearing shape. This articulation is for an increased upward and inward configuration. The gaps between the sections is the result of the backing in the secondary seat pan stretching under user weight. In one example, a molded screen-like member backing for sections 101-105, allows greater flexibility between the sections 101-105.

Figure 6E:
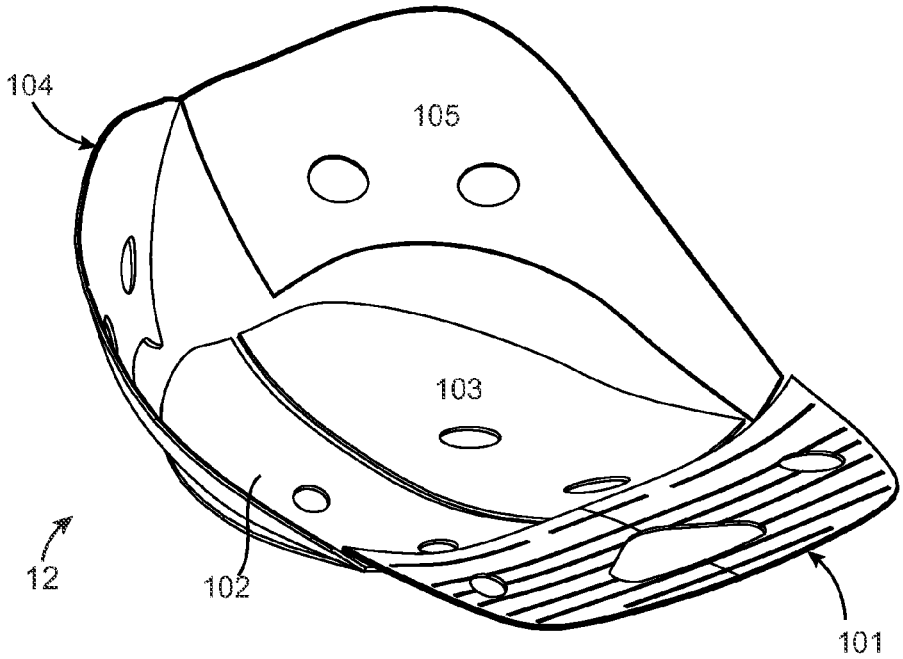
FIG. 6*e* shows a perspective view of the seating apparatus of FIG. 6*c*, with the seating apparatus having transitioned to a weight bearing shape, according to an embodiment of the invention.
Figure 6F:
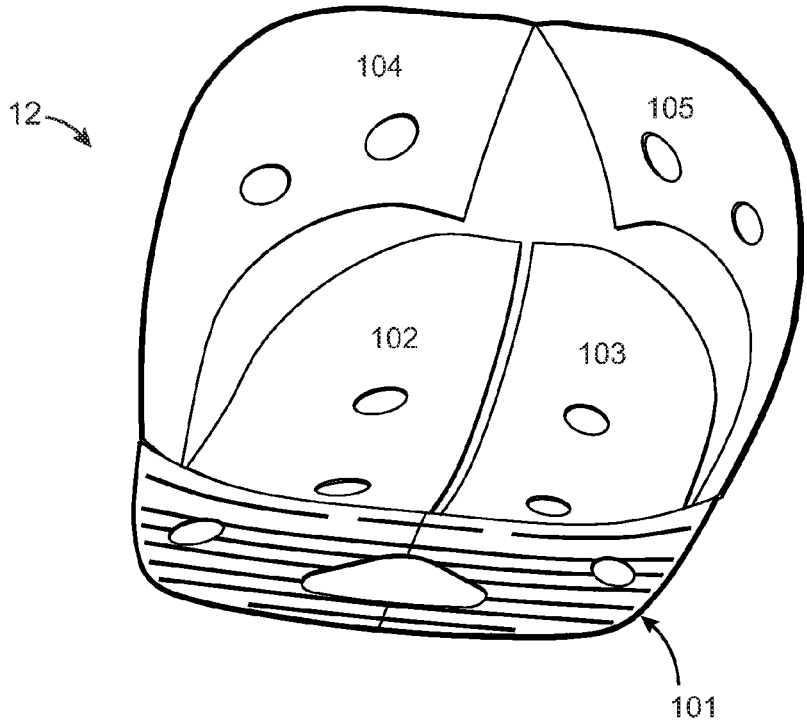
FIG. 6*f* shows a front perspective view of the seating apparatus of FIG. 6*e*, with the seating apparatus having transitioned to a weight bearing shape, according to an embodiment of the invention.
Figure 6G:
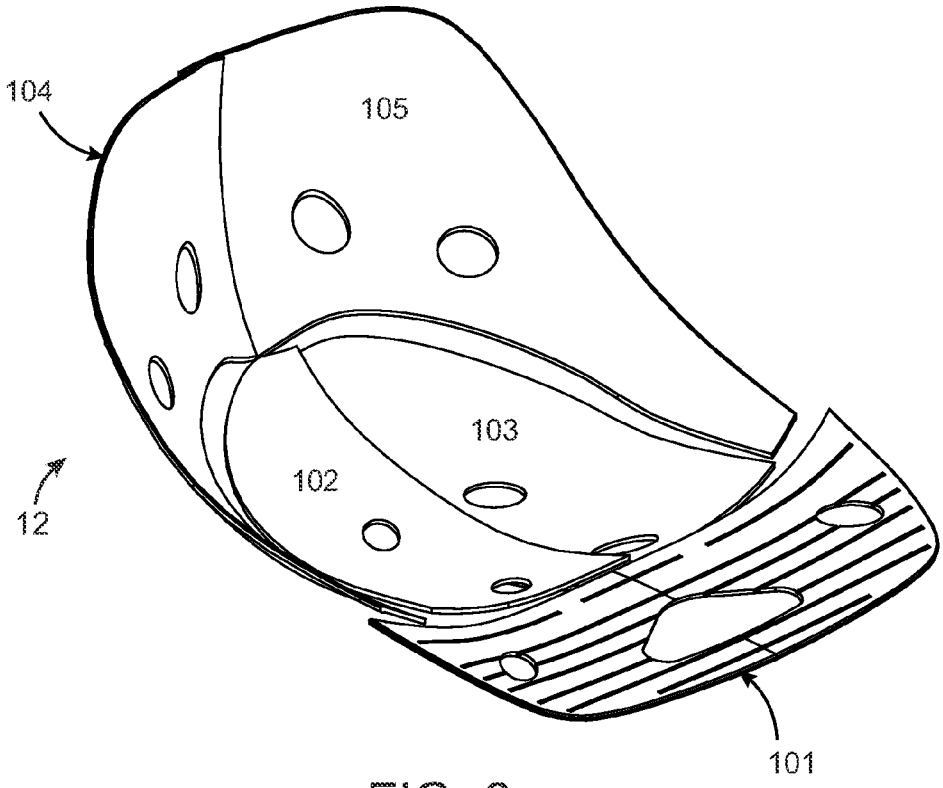
FIG. 6*g* shows a perspective view of the seating apparatus of FIG. 6*c*, with the seating apparatus in a non-weight bearing shape, indicating overlapping of side sections and overlapping of central sections, according to an embodiment of the invention.
Figure 6H:
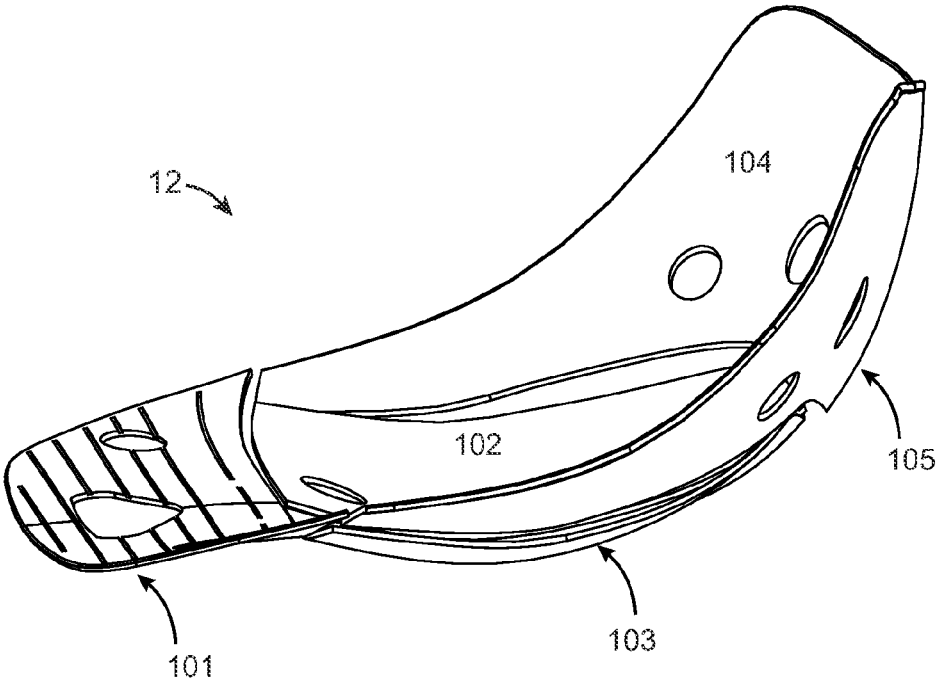
FIG. 6*h* shows a side perspective view of the seating apparatus of FIG. 6*g*, according to an embodiment of the invention.
Figure 6I:
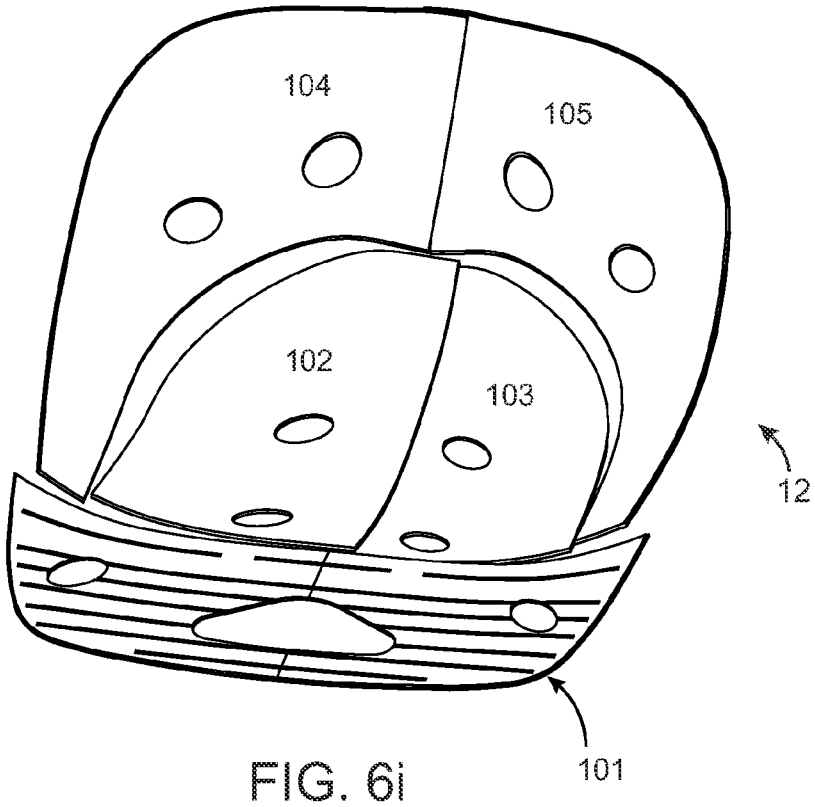
FIG. 6*i* shows a front perspective view of the seating apparatus of FIGS. 6*g* and 6*h*, according to an embodiment of the invention.

FIG. 6*e* shows another perspective view of the sections 101-105 in weight bearing secondary shape. FIG. 6*f* shows a perspective view of the sections 101-105 having transitioned to a weight bearing (secondary) shape. FIG. 6*g* shows a perspective view of the sections 101-105 in a non-weight bearing shape, indicating overlapping of sections 104, 105, and overlapping of central sections 102, 203. This articulation adjustment is for a smaller configuration. FIG. 6*h* shows a slightly turned perspective view of the sections 101-105 in non-weight bearing state. FIG. 6*i* shows a front perspective view of the sections 101-105, showing partially overlapping sections 101-105 in non-weight bearing position. In the weight bearing position, the secondary shape is achieved by sections 101-105, and a full forward lordosis of the pelvis and spine is achieved, according to an embodiment of the invention.

FIGS. 6*j*-6*p* show another example of the integrated seat pan configuration involving the individual sections 101-106, along with attachment points (indicated by cone shapes 19), wherein the attachment points illustrate where the sections 101-106 may be attached to a support environment for manipulating the sections of the seating apparatus, according to an embodiment of the invention.

Figure 6J:
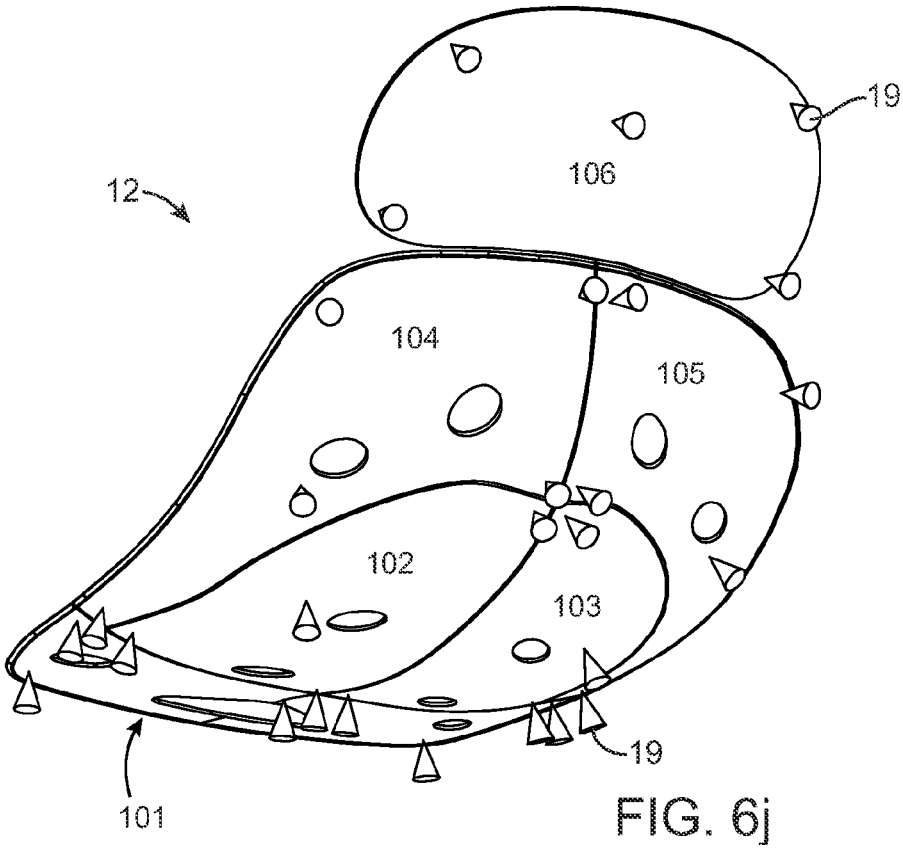
FIG. 6*j* shows a bottom perspective view of another integrated seat pan configuration of a seating apparatus according to an embodiment of the invention, with the seating apparatus in a non-weight bearing shape, with cone shapes point where the sections of the seating apparatus may be attached to a support environment for manipulating the sections of the seating apparatus, according to an embodiment of the invention.
Figure 6K:
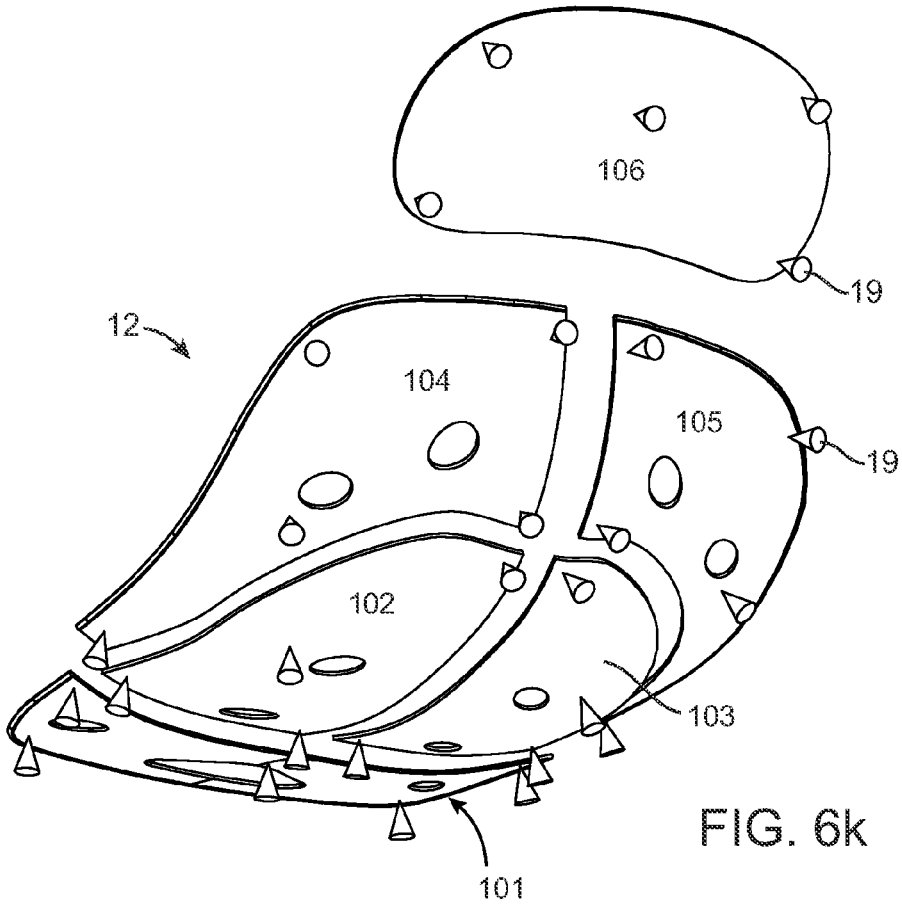
FIG. 6*k* shows a bottom perspective view of the seating apparatus of FIG. 6*j* in a weight bearing shape, according to an embodiment of the invention.
Figure 6L:
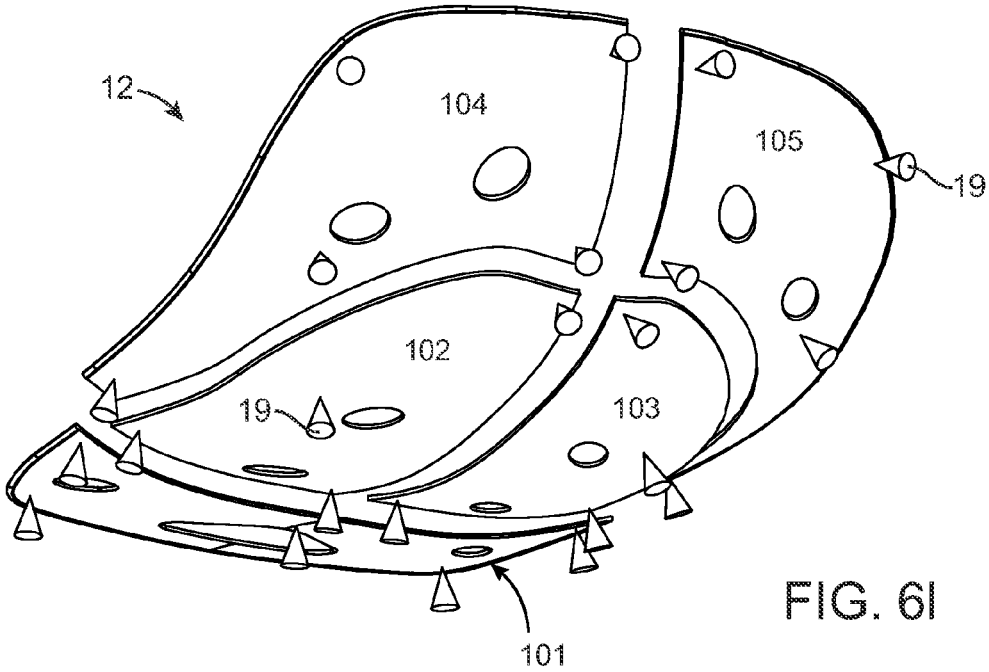
FIG. 6*l* shows a bottom perspective view of the seating apparatus of FIG. 6*j* without a back section in a weight bearing shape, according to an embodiment of the invention.
Figure 6M:
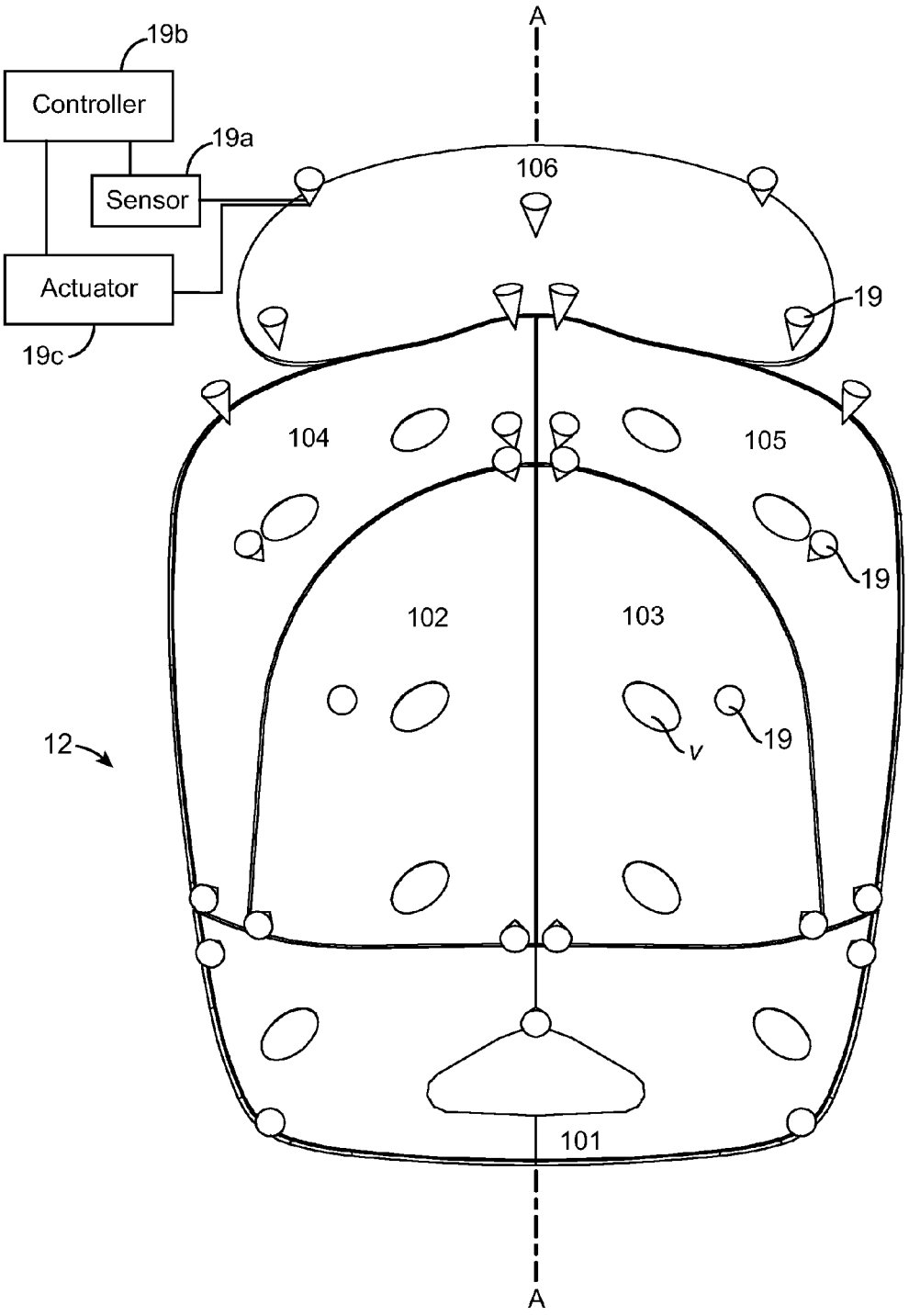
FIG. 6*m* shows a bottom aerial view of the seating apparatus of FIG. 6*j* with the seating apparatus in a non-weight bearing shape, according to an embodiment of the invention.

FIG. 6*j* shows a bottom perspective view of the sections 101-106 in a non-weight bearing shape, with attachment points 19 where the sections 101-106 may be attached to a support environment for manipulating the sections 101-106. FIG. 6*k* shows a bottom perspective view of the sections 101-106 of FIG. 6*j* in a weight bearing shape. FIG. 6l shows a bottom perspective view of the sections 101-105, in a weight bearing shape. FIG. 6*m* shows a bottom aerial view of the sections 101-106 in a non-weight bearing shape. Said manipulation may be active such as using pressure sensors 19*a* which sense pressure on a plurality of the attachment points 19, an electronic controller 19*b* that processes the sensed pressure information and sends control signals to actuators 19*c* (e.g., placed proximate points 19) to move the sections 101-106 until the secondary shape is achieved and a full forward lordosis of the pelvis and spine is achieved, according to an embodiment of the invention.

Figure 6N:
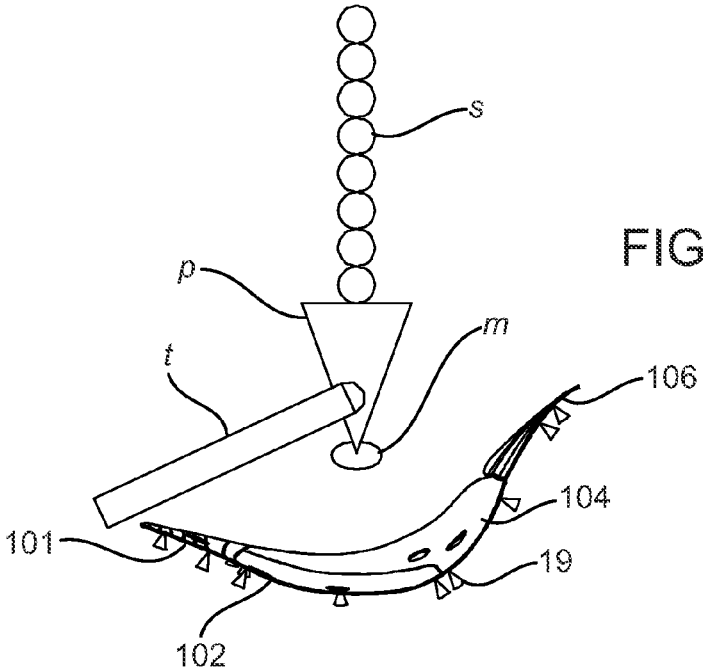
FIG. 6*n* shows a right side view of the seating apparatus of FIG. 6*j*, with a mechanical robot anatomical skeleton representation of a user in the act of sitting, approaching the seating apparatus, according to an embodiment of the invention.
Figure 6O:
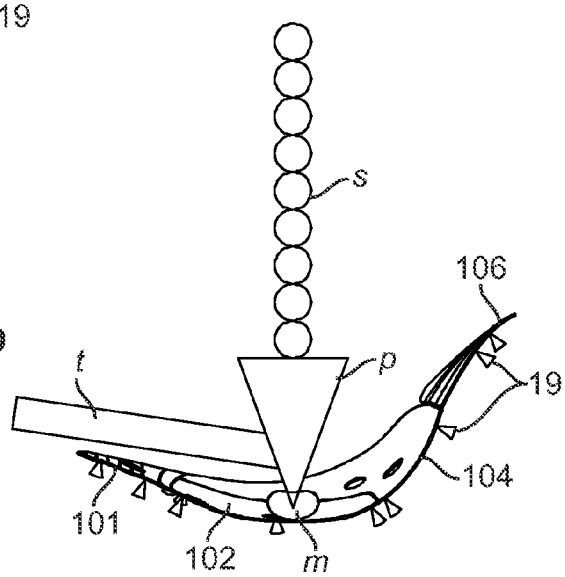
FIG. 6*o* shows a right side view of the seating apparatus of FIG. 6*n*, with the mechanical robot anatomical skeleton touching the seating apparatus, according to an embodiment of the invention.
Figure 6P:
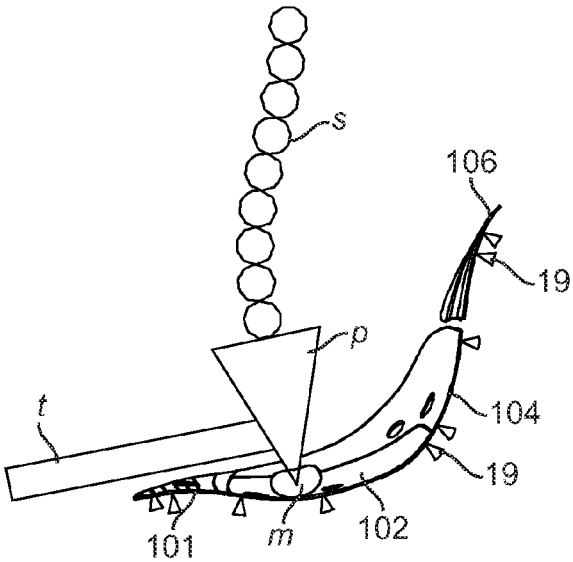
FIG. 6*p* shows a right side view of the seating apparatus of FIG. 6*o* with the mechanical robot anatomical skeleton filling the seating apparatus until total secondary shape is achieved and a full forward lordosis of the pelvis and spine is achieved, according to an embodiment of the invention.

FIG. 6*n* shows a right side view of the sections 101-106 of FIG. 6*j*, with a mechanical robot anatomical skeleton representation of a user in the act of sitting, approaching the sections 101-106. FIG. 6*o* shows a right side view of the sections 101-106 of FIG. 6*n*, with the mechanical robot anatomical skeleton touching at least the bowl portion. FIG. 6*p* shows a right side view of the sections 101-106 of FIG. 6*o* with the mechanical robot anatomical skeleton filling the bowl portion, with the underside of the upper legs pressing down on section 101, until the secondary shape is achieved and a full forward lordosis of the pelvis and spine is achieved, according to an embodiment of the invention.

In another embodiment, the device 100 may be component of a dual seat pan, to induce skeletal alignment and muscle form while the supporting surface (sub seat pan) is to hold the soft tissue structures of the buttocks and distal thighs. Information about average pelvic floor sizes of men and women is utilized. The diameters of the outlet of the pelvis include antero-posterior and transverse. The antero posterior extends from the tip of the coccyx to the lower part of the symphysis pubis, with an average measurement of about 3.25 inches in the male and about 5 inches in the female. The antero-posterior diameter varies with the length of the coccyx, and is capable of increase diminution, on account of the mobility of that bone. The transverse extends from the posterior part of the Ischia tuberosities to the same point on the opposite side, with the average measurement of about 3.25 inches in the male and about 4.75 inches in the female. These measurements are essentially regardless of height, weight and race over the population. Given the average pelvic measurements, the device 100 provided by the invention is suitable for at least 95% range of the adult population. The coccyx cup area 110*a* of the channel 110 (FIG. 3*a*) allows for variable coccyx angles so as to keep the surface of the device 100 from coming in contact with the lower Sacral joints and coccyx.

The device 100 is placed on (or may be integrated into) a conventional seating surface 40*a* to create a dual seat pan. With the addition of a secondary seat pan 40*a*, an active (i.e., non-static) seating system is provided, comprising individual sections 101-105 (active seat pan) on a non-active conventional seat pan 40*a*, combined together. The seat pan 40*a* is designed on the skeletal and muscle structure while the device 100 seat pan provides support for soft tissue structures of the buttocks and thighs. Combining said sections 101-105 (and optionally section 106) of the device 100 together on top of a conventional seat pan 40*a*, provides a cooperative system when the user body weight is placed on the device 100 and the seat pan 40*a*. The process 300 applies to the dual seat pan system.

As noted, in a preferred embodiment of the invention (FIGS. 1*a*-1*d*, 2*a*-2*h*, 3*a*-3*f*, 4*a*-4*c*, 5, 7*a*-7*c*, 8*a*-8*d*, 9, 10*a*-10*f*, 11*b*, 12*a*-12*f*, 14*a*-14*i*, 15, 16*a*-16*c*, 17*a*-17*b*, 18*a*-18*n*), the foundation member 12 is a one piece member molded from memory retentive material such a nylon plastic with the varying thickness regions as shown by example in FIG. 4*a*. The depiction in FIG. 4*a* also shows the relative scale of the various regions in of the foundation member 12 in relation to one another, where the memory retentive material essentially gradually changes in thickness from one region to another region. Each of the sections 101 through 105 shows a grouping of the regions it is made of (FIGS. 4*a*-4*b*), wherein there is no physical separation between the sections 101-105.

Figure 15:
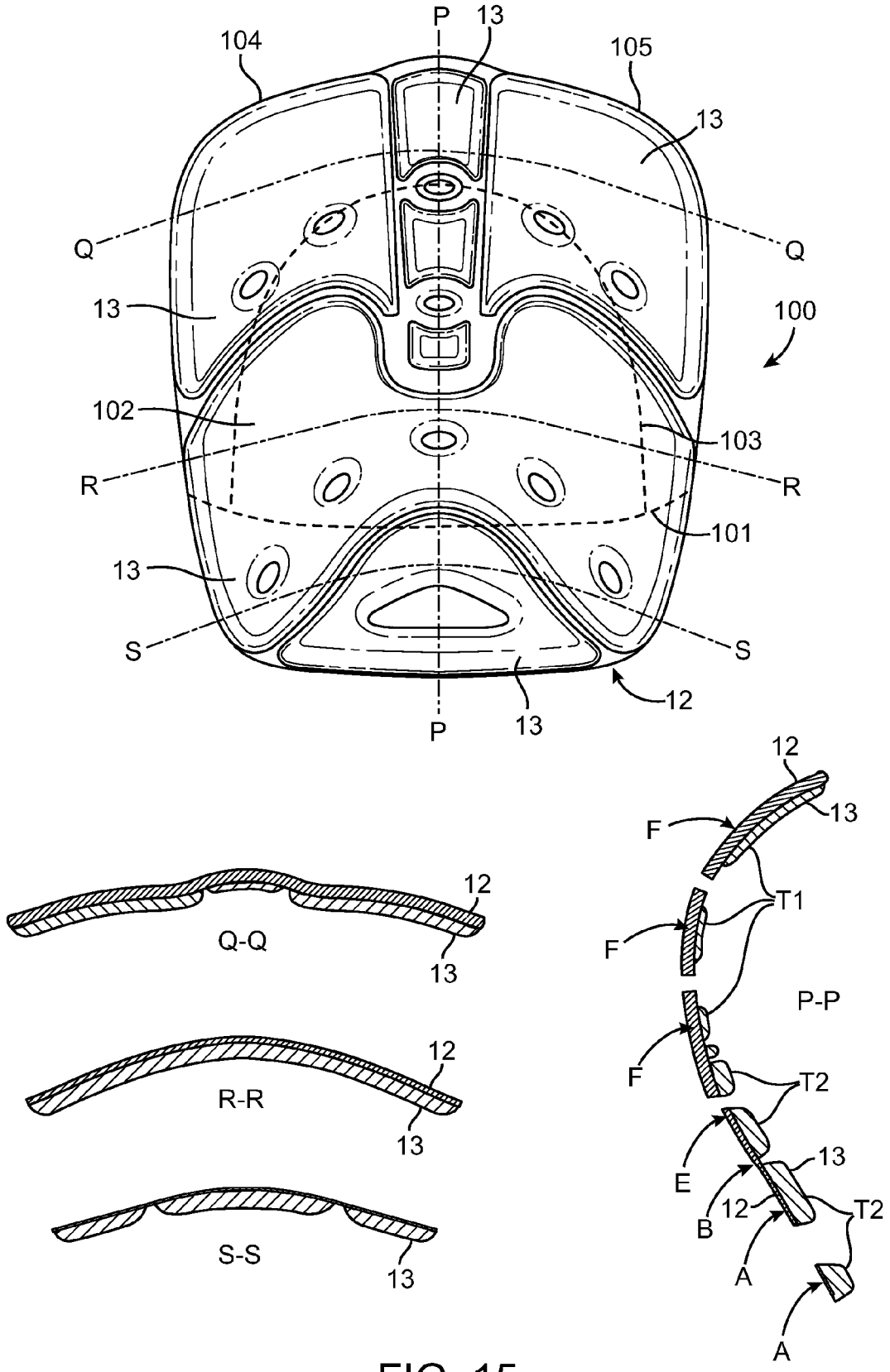
FIG. 15 shows an embodiment of the seating apparatus of FIG. 1*a*, having a foundation member and fabric foam overlay, with thicknesses of the foundation member and foam overlay attachment, according to an embodiment of the invention.

According to said preferred embodiment, the device 100 further includes a padding layer 13 shown in FIG. 15. The padding layer 13 comprises foam attached to top of the foundation member 12. The foam thickness is contoured as to not negatively affect the function of the foundation member. The top illustration in FIG. 15 shows an aerial view of the top surface of the device 100 showing a foam pattern on to of the sections 101-105 (shown in dashed lines). FIG. 15 further shows cross-sections of the device 100 along planes P-P, Q-Q, R-R and S-S. The cross sections show the foundation member 12 (not drawn to scale in terms of thickness). The thickness of the different regions of the foundation member 12 in cross-section P-P are shown by lettering A, B, E, F as applicable corresponding to thickness legend in FIG. 4*a*. The thickness of the foam 13 in cross-section P-P is indicated as T1 (e.g., about 4 mm thick), T2 (e.g., about 10 mm thick), T3 (e.g., about 12 mm thick). The foam 13 is thicker than the one piece foundation member 12 to enhance the effect of the stopping the forward sliding Ischia's tip from riding up said incline 111, and enhance rotation of the pelvis forward by stopping the bottom of the Ischia's trip on said incline 111, thereby enhancing forward rotation of the pelvis via the bowl portion 20. The foam is thinnest in the rear landing zone 3 so as to not keep the bowl portion 20 in sections 102-105, from filling up with muscles of the user's lower pelvic region.

In the preferred embodiment, the foundation member 12 is preferably molded from memory retentive materials such a nylon plastic (e.g., Nylon 6,6) that is able to maintain its memory and flexibility over a wide range of temperatures. Even though sections 101-105 are molded in one piece, thickness difference in the regions in FIG. 4*a*, generally change along the peripheries of the regions in FIG. 4*a*, providing a desired response in the reaction to weight of the user.

The plastic used for the regions of the sections 101-106 is preferably able to withstand the heat necessary to form and mold EVA, PU and MDI Foam. The heat required to mold Polyurethane Foams, Polyester fabric and weld the fabric is about 218° F. to 285° F. Although the novel foundation member 12 in accordance with the invention is able to assume an advantageous secondary shape or configuration when bearing 90 or more pounds, there is a strong tendency for the foundation member 12 made of this particular plastic to return to its original configuration when weight is removed, which is an important feature of the invention. Other materials exhibiting such characteristics may also be used.

Ventilation holes v (FIG. 3*a*) are not required for the device 100, but assist in breathability and with thermal comfort. The ventilation hole pattern helps the surface to breathe, providing comfort and allowing conduction of heat and dispersion of moisture away from the surface of the user skin. Thermal comfort should not be posture dependent, thus the device 100 includes a preferred pattern of ventilation holes in FIG. 3*a*.

In the preferred embodiment, the foundation member 12 comprises varying depth thickness regions of nylon in a direction perpendicular to the surface of the foundation member 12 (i.e., perpendicular to drawing sheet of FIG. 4*a*). Because such nylon has a specific flexibility and memory that allows it to go from an original shape to a secondary shape, the varying thickness regions enhance the secondary shape adding to the dynamic reaction of the device 100. The varying thickness regions have specific desired effects on the secondary, weight-bearing, shape of the device 100, acting to return the weight-bearing shape back to the non-weight bearing shape, causing a dynamic reaction to maintain tilting/rotating forward, cupping and cradling the pelvis area, while floating the pelvis in muscle tissue. Further, the device 100 with the example dimensions and thickness regions provided herein is suitable for a wide range of the population. The device 100 deals directly with pelvic floor measurements and the sub seat pan 40*a* deals with the anthropomorphic measurements. Based on anatomical data bases for humans, the dual seat pan system of the invention is suitable for the majority, is not all of the human population.

An example manufacturing process for the preferred embodiment of the device 100 (FIGS. 1*a*-1*d*, 2*a*-2*h*, 3*a*-3*f*, 4*a*-4*c*, 5, 7*a*-7*c*, 8*a*-8*d*, 9, 10*a*-10*f*, 11*b*, 12*a*-12*f*, 14*a*-14*i*, 15, 16*a*-16*c*, 17*a*-17*b*, 18*a*-18*n*) involves two molding processes. A first mold comprises a thermoplastics and thermosetting polymer injection mold for the foundation member 12. The first mold allows injection molding a specific nylon plastic (Nylon 6,6). During the injection of the nylon plastic, a bidirectional polyester microfiber fabric can be placed inside the mold so as to be molded simultaneously with the nylon foundation. Thus, the nylon foundation and its bottom side fabric are molded together. The nylon foundation member with a bidirectional polyester fabric bottom surface is then placed into a match metal thermoforming mold with a cutting die component. The match metal thermoforming mold performs several simultaneous functions. First, the match metal thermoforming mold forms a Polyurethane Foam 13 and polyester microfiber into a specified formed and molded shape. Second, the match metal thermoforming mold "welds" the bidirectional polyester fabric 13 while, cutting the polyester fabric and polyurethane foam 13 in specific areas shown by example in FIG. 15.

The process depends on the flexible moldable plastic foundation being able to withstand the heat necessary to form and mold the EVA, PU and MDI Foam 13 (described further below). The heat required to mold the Polyurethane Foams, Polyester fabric and weld the fabric is 218° F. to 285° F. All thermoplastics and thermosetting polymers have a melting point at similar temperatures that the EVA, PU and MDI Foams 13 are molded. This creates a specific need for the foundation polymer that does not melt under the heat and pressure required by the EVA, PU and MDI Foam and Polyester fabric to be able to be press molded, die cut and welded together. The Nylon 6,6 can withstand the heat and still be an injectable polymer 12.

Although the nylon can withstand said heat molding process, it can not do so and be sufficiently flexible to function properly. As such, it must be steam heated to regain a specific flexibility after it is gone through the molding process. The invention discloses the ability to have an injectable Nylon 12 with specific flexibility and memory retentive characteristics without melting at the same temperatures as the foams and fabrics 13 that surround the nylon foundation member 12. This involves a Nylon 6,6 make-up and steam heating for a to regain a specific flexibility.

Another aspect of the process involves ventilation holes v cut on the interior areas of the device 100, while still allowing the polyester Fabric and EVA, PU and MDI Foam 13 to be welded together. These holes in various shapes and sizes and locations across the device 100 (without flat surfaces to match metal die), must not only be formed to create the proper shape for molding the foam 13, but also to meet the bottom surface of the mold in such an exact fashion as to not to dull the cutting die blade, such that touch heat and pressure can weld the two sides of fabric together and cut at a precise point.

In one example, the device 100 has a nylon foundation member 12 comprising a synthetic polymers known generically as polyamides. Subsequently polyamides 6, 10, 11, and 12, developed based on monomers which are ring compounds (e.g., Caprolactam nylon 6,6 is a material manufactured by condensation polymerization). EVA foam comprising Ethylene vinyl acetate (also known as EVA) is the copolymer of ethylene and vinyl. PU polyurethane foam 13 on the foundation member 12 includes Polyurethane formulations that cover a wide range of stiffness, hardness, and densities. A polyurethane substance, IUPAC (PUR or PU), is any polymer comprising a chain of organic units joined by urethane (carbamate) links. Polyurethane polymers are formed through step-growth polymerization by reacting a monomer containing at least two isocyanate functional groups with another monomer containing at least two hydroxyl (alcohol) groups in the presence of a catalyst.

MDI PPG Memory Foam 13 comprises polyurethane with additional chemicals increasing its viscosity. It is often referred to as visco-elastic polyurethane foam. In some formulations, it is firmer when cooler. Higher density memory foam reacts to body heat, allowing it to mould to a warm human body in a few minutes. Lower density memory foam is pressure-sensitive and moulds quickly to the shape of the body.

Bidirectional Polyester Microfiber Fabric or any Bidirectional Polyester Fiber Microfiber refers to synthetic fibers that measure less than one denier. The most common types of microfibers are made from polyesters, polyamides (nylon), and or a conjugation of polyester and polyamide.

Microfiber is used to make non-woven, woven and knitted textiles. The shape, size and combinations of synthetic fibers are selected for specific characteristics, including: softness, durability, absorption, wicking abilities, water repellency, electrodynamics, and filtering capabilities. Microfiber is commonly used for apparel, upholstery, industrial filters and cleaning products.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other modifications may occur to those ordinarily skilled in the art.

What is claimed is:

1. An orthopedic device for improving posture while sitting, the orthopedic device comprising:

a foundation member comprising:

a front portion configured to receive a user's upper legs;

a bowl portion configured to receive a user's lower pelvic area, the bowl portion comprising a central portion and a upwardly inclined lateral portion, wherein the lateral portion and the front portion collectively surround the central portion, and the central portion has plural regions of varying flexibility and the lateral portion has plural regions of varying flexibility, and a concave recessed portion extending from a segment of the lateral portion through the central portion to the front portion along a longitudinal midline of the foundation member wherein the concave recessed portion comprises an arcuate segment that is less flexible relative to other regions of the foundation member, wherein the lateral portion has a rear segment surrounded on either side by a lateral segment, said rear and lateral segments of the lateral portion comprising tension regions extending and coupling to the front portion, said tension regions being of higher flexibility than the concave recessed portion, the concave recessed portion having an arcuate underside corresponding to said arcuate segment, wherein the arcuate underside is configured to rotate the orthopedic device on a supporting seating surface between a first position when the user's lower pelvic area is not disposed in the bowl portion, and a second position, rotationally forward of the first position, when the user's lower pelvic area is disposed in the bowl portion, to thereby cause a forward rotational tilting of the user's lower pelvic area into a forward lordotic position after the lower pelvic area is placed in the bowl portion, whereby the bowl portion applies continuous dynamic upwardly and inwardly compressive force for active stabilization support when the lower pelvic area of the user is disposed in the bowl portion.

2. The orthopedic device of claim 1, wherein:

the lateral portion has an arcuate rear segment with an upper edge, surrounded on either side by a lateral segment with an upper edge, said rear and lateral segments forming rear and lateral segments of the bowl portion, respectively;

said rear and lateral segments of the lateral portion comprise tension regions of lower flexibility than other regions of the bowl portion having higher flexibility; and said tension regions extending and coupling to the front portion such that application of a downward force on the front portion causes an upward and inward movement of the upper edges of said rear and lateral segments of the bowl portion, wherein said regions of higher flexibility allow upward and inward movement of said tension regions.

3. The orthopedic device of claim 2, wherein:

the foundation member has axes including a longitudinal axis extending centrally from the rear segment of the bowl portion through the front portion, and a lateral axis intersection the longitudinal axis proximate the front portion;

the concave recessed portion extending from the upper edge of the rear segment of the lateral portion through the central portion to the front portion along said axes, the concave recessed portion comprising a region of similar flexibility to the tension regions wherein said arcuate segment of the concave recessed portion is least flexible relative to other regions of the foundation member; and the bowl portion has an underside, at least a portion of which is arcuate along an underside of the concave recessed portion providing a wheel-like structure configured to rotate the orthopedic device on a seating surface between the first position and the second position.

4. The orthopedic device of claim 3, wherein the bowl portion further comprises an upwardly inclined portion along the front portion, said upwardly inclined portion impeding forward motion of ischial tuberosities in the pelvic area and causing user's lower pelvic area to pivot forward into a forward lordotic position in the second position of the bowl portion on a center of gravity balance equilibrium point on the supporting surface, thereby maintaining ischial tuberosities atop said center of gravity balance equilibrium point in response to user motion while the lower pelvic area is in the bowl portion, wherein the central portion and the upwardly inclined lateral portion of the bowl portion of the orthopedic device including said tension regions, apply continuous dynamic pressure to user's ischial tuberosities by cradling and cupping user's gluteus muscles.

5. The orthopedic device of claim 4, wherein:

said tension regions comprise essentially planar regions along the upper edges of the rear and lateral segments of the bowl portion, said tension regions being of relatively lower flexibility than other regions of the lateral portion to provide upward and inward tensioning upon application of a downward force on the front portion.

6. The orthopedic device of claim 5, wherein:

the central portion comprises a pelvic landing region intersecting said concave recessed portion and extending outwardly from the concave recessed portion, the pelvic landing region having a similar flexibility as the concave recessed portion;

the central potion further comprises regions of higher flexibility surrounding the pelvic landing region; and the front portion comprises a region adjacent the lateral and central portions, said front portion region being of higher flexibility than the tension regions of the lateral portion.

7. The orthopedic device of claim 1, wherein:

the concave recessed portion has a thickness greater than other portions of the foundation member surrounding the concave recessed portion, and the concave recessed portion protrudes from an underside of the foundation member to rotate the orthopedic device on a seating surface between the first position and the second position.

8. The orthopedic device of claim 7, wherein:

said upward and inward movement of the upper edges of the rear and lateral segments of the bowl portion cause cupping and cradling of gluteus muscles in the user's lower pelvic area in the bowl portion.

9. The orthopedic device of claim 8, wherein:

with the user's lower pelvic area disposed in the bowl portion, twisting movement of the user while sitting causes torsion of the foundation member along said axes which causes torsioning of the rear segment of the bowl portion such that said upward and inward motion of the upper edges of the rear and lateral segments of the bowl portion follow twisting of the user's lower pelvic area for applying an upwardly and inwardly compressive force to cause a forward rotational tilting of the user's lower pelvic area into a lordotic position, while maintaining the bowl portion in said second position.

10. The orthopedic device of claim 9, wherein said regions of varying flexibility comprise a single layer memory retentive plastic including regions of varying thickness in the foundation member, such that a thicker region is less flexible than a relatively thinner region.

11. The orthopedic device of claim 10 wherein the foundation member comprises a memory retentive plastic including said regions of varying thickness.

12. An orthopedic device for improving posture while sitting, the orthopedic device comprising:

a foundation member comprising:

a front portion comprising at least one individual front section configured to receive a user's upper legs;

a central portion comprising a pair of adjacent individual central sections;

a lateral portion comprising a pair of upwardly inclined, partially adjacent, individual lateral sections flanking and partially surrounding the central sections; and a concave recessed portion extending from a segment of the lateral portion through the central sections to the front portion along a longitudinal midline of the foundation member, wherein the lateral portion has a rear segment surrounded on either side by a lateral segment, said rear and lateral segments of the lateral portion comprising tension regions extending and coupling to the front portion, said tension regions being of higher flexibility than the concave recessed portion, wherein each central section has plural regions of varying flexibility and each lateral section has plural regions of varying flexibility, wherein the concave recessed portion comprises an arcuate segment that is least flexible relative to other regions of the foundation member, the lateral sections and the front section collectively surround the central sections such that the central portion and the lateral portion together form a bowl portion configured to receive a user's lower pelvic area, and for applying continuous dynamic upwardly and inwardly compressive force for active stabilization support when the lower pelvic area of the user is disposed in the bowl portion; and the concave recessed portion having an arcuate underside corresponding to said arcuate segment, wherein the arcuate underside is configured to rotate on a supporting surface between a first position when the user's lower pelvic area is not disposed in the bowl portion, and a second position, rotationally forward of the first position, when the user's lower pelvic area is disposed in the bowl portion, to thereby cause a forward rotational tilting of the user's lower pelvic area into a forward lordotic position after the user's lower pelvic area is placed in the bowl portion.

13. The orthopedic device of claim 12, wherein:

each lateral section has an arcuate rear segment with an upper edge, and a lateral segment with an upper edge, such that the rear and lateral segments of the lateral sections form rear and lateral segments of the bowl portion;

said rear and lateral segments of each lateral section comprise tension regions of lower flexibility than other regions of the bowl portion having higher flexibility; and said tension regions extending and coupling to the front portion such that application of a downward force on the front portion causes an upward and inward movement of the upper edges of the rear and lateral segments of the lateral sections of the bowl portion, wherein said regions of higher flexibility allow upward and inward movement of said tension regions.

14. The orthopedic device of claim 13, wherein:

the foundation member has axes including a longitudinal axis extending centrally from the rear segment of the bowl portion through the front portion, and a lateral axis intersection the longitudinal axis proximate the front portion;

the concave recessed portion extending from the upper edge of the rear segment of the bowl portion through the central portion to the front portion along said axes, the concave recessed portion comprising a region of similar flexibility to the tension regions wherein said arcuate segment of the concave recessed portion is least flexible relative to other regions of the foundation member; and the bowl portion has an underside, at least a portion of which is arcuate along an underside of the concave recessed portion and configured to rotate on a seating surface between the first position and the second position.

15. The orthopedic device of claim 14, wherein the central sections further comprise upwardly inclined portions proximate the front portion, said upwardly inclined portions impeding forward motion of ischial tuberosities in the pelvic area and causing user's lower pelvic area to pivot forward into a forward lordotic position in the second position of the bowl portion on a center of gravity balance equilibrium point on the supporting surface, thereby maintaining ischial tuberosities atop said center of gravity balance equilibrium point in response to user motion while the lower pelvic area is in the bowl portion, wherein the central sections and each lateral section of the bowl portion of the orthopedic device including the tension regions, apply continuous dynamic pressure to user's ischial tuberosities by cradling and cupping user's gluteus muscles.

16. The orthopedic device of claim 15, wherein the foundation member further comprises a connecting mechanism for moveably connecting the plural sections, such that the lateral sections and the front section collectively surround the central sections, and said tension regions comprise essentially planar regions along the upper edges rear and lateral segments of the bowl portion, said regions being of relatively lower flexibility than other regions of the lateral sections to provide upward and inward tensioning upon application of a downward force on the front section.

17. The orthopedic device of claim 12, wherein:

the concave recessed portion has a thickness greater than other portions of the foundation member surrounding the concave recessed portion, and the concave recessed portion protrudes from an underside of the foundation member to rotate the orthopedic device on a seating surface between the first position and the second position.

18. The orthopedic device of claim 17, wherein:

each central segment comprises a pelvic landing region adjacent the other central section, said pelvic landing regions being of relatively lower flexibility than other regions of the central section.

19. The orthopedic device of claim 18, wherein:

the front section comprises a region adjacent the lateral and central sections, said front section region being of higher flexibility than the tension regions of the said lateral sections.

20. The orthopedic device of claim 19, wherein:

said upward and inward movement of the upper edges of the arcuate rear and lateral segments of the lateral sections of the bowl portion cause cupping and cradling of gluteus muscles in the user's lower pelvic area in the bowl portion.

21. The orthopedic device of claim 20, wherein:

with the user's lower pelvic area disposed in the bowl portion, twisting movement of the user while sitting causes torsion of the foundation member along said axes which causes torsioning of the rear segment of the bowl portion such that said upward and inward motion of the upper edges of the rear and lateral segments of the bowl portion follow twisting of the user's lower pelvic area for applying an upwardly and inwardly compressive force to cause a forward rotational tilting of the user's lower pelvic area into a lordotic position, while maintaining the bowl portion in said second position.

22. The orthopedic device of claim 21 wherein said regions of varying flexibility comprise regions of varying thickness in the foundation member, such that a thicker region is less flexible than a relatively thinner region.

23. The orthopedic device of claim 22 wherein the foundation member comprises a single layer of memory retentive plastic including said regions of varying thickness.

24. A method for dynamically improving posture while sitting, comprising: providing a foundation member comprising:

a front portion configured to receive a user's upper legs;

a bowl portion configured to receive a user's lower pelvic area, the bowl portion comprising a central portion and a upwardly inclined lateral portion wherein the lateral portion and the front portion collectively surround the central portion; and a concave recessed portion extending from a segment of the lateral portion through the central portion to the front portion along a longitudinal midline of the foundation member, wherein the concave portion has a thickness greater than other portions of the foundation member surrounding the concave recessed portion such that the concave recessed portion comprises an arcuate segment that is least flexible relative to other regions of the foundation member, wherein the concave recessed portion protrudes from an underside of the foundation member, wherein the lateral portion has a rear segment surrounded on either side by a lateral segment, said rear and lateral segments of the lateral portion comprising tension regions extending and coupling to the front portion, said tension regions being of higher flexibility than the concave recessed portion, wherein the central portion has plural regions of varying flexibility and the lateral portion has plural regions of varying flexibility, the bowl portion configured for applying continuous dynamic upwardly and inwardly compressive force for active stabilization support when the lower pelvic area of the user is disposed in the bowl portion; and the concave recessed portion having an arcuate underside corresponding to said arcuate segment, wherein the arcuate underside is configured to rotate on a supporting surface between a first position when the user's lower pelvic area is not disposed in the bowl portion, and a second position, rotationally forward of the first position, when the user's lower pelvic area is disposed in the bowl portion, to thereby cause a forward rotational tilting of the user's lower pelvic area into a forward lordotic position after the lower pelvic area is placed in the bowl portion; and in response to application of a downward force on the front portion, upper and rear portions of the bowl portion moving upward and inward, thereby continuously and dynamically applying an upwardly and inwardly compressive force for active stabilization support while the lower pelvic area of the user is disposed in the bowl portion.

25. The method of claim 24 further comprising:

with the user's lower pelvic area disposed in the bowl portion, in response to a twisting movement of the user while sitting, the foundation member flexing torsionally on causing torsioning of a rear segment of the bowl portion such that said upward and inward motion of the upper edges of rear and lateral segments of the bowl portion follow twisting of the user's lower pelvic area for applying an upwardly and inwardly compressive force to cause a forward rotational tilting of the user's lower pelvic area into a lordotic position, while maintaining the bowl portion in said second position with essentially constant dynamic pelvic area active stabilization support wherein the user's center of gravity shifts forward away from the sacrum and onto the tips of the ischial tuberosities of the user's lower pelvic area.

26. The method of claim 25, further comprising:

performing dynamic postural alignment by repeating a cycle comprising:

with the user's lower pelvic area disposed in the bowl portion, in response to a twisting movement of the user while sitting, the foundation member flexing torsionally causing torsioning of the rear segment of the bowl portion such that said upward and inward motion of the upper edges of the rear and lateral segments of the bowl portion follow twisting of the user's lower pelvic area for applying an upwardly and inwardly compressive force to cause a forward rotational tilting of the user's lower pelvic area into a lordotic position, while maintaining the bowl portion in said second position.

27. A method for dynamically improving posture while sitting, comprising:

providing a foundation member comprising:

a front portion comprising a section configured to receive a user's upper legs;

a central portion comprising plural sections of varying flexibility, and a lateral portion comprising plural upwardly inclined individual sections of varying flexibility, such that the central portion and the lateral portion together form a bowl portion configured to receive a user's lower pelvic area; and a concave recessed portion extending from a segment of the lateral portion through the central portion to the front portion along a longitudinal midline of the foundation member, wherein the concave portion has a thickness greater than other portions of the foundation member surrounding the concave recessed portion such that the concave recessed portion comprises an arcuate segment that is least flexible relative to other regions of the foundation member, performing dynamic postural alignment by repeating a cycle comprising:

wherein the lateral portion has a rear segment surrounded on either side by a lateral segment, said rear and lateral segments of the lateral portion comprising tension regions extending and coupling to the front portion, said tension regions being of higher flexibility than the concave recessed portion, the concave recessed portion having an arcuate underside corresponding to said arcuate segment, wherein the arcuate underside is configured to rotate the orthopedic device on a supporting seating surface between a first position when the user's lower pelvic area is not disposed in the bowl portion, and a second position, rotationally forward of the first position, in response to application of a downward force on the front portion, upper and rear portions of the bowl portion moving upward and inward, thereby applying continuous and dynamic upwardly and inwardly compressive force for active stabilization support while the lower pelvic area of the user is disposed in the bowl portion, and with the user's lower pelvic area disposed in the bowl portion, in response to a twisting movement of the user while sitting, the foundation member flexing torsionally causing torsioning of the rear segment of the bowl portion such that said upward and inward motion of the upper edges of the rear and lateral segments of the bowl portion follow twisting of the user's lower pelvic area for applying an upwardly and inwardly compressive force to cause a forward rotational tilting of the user's lower pelvic area into a lordotic position, while maintaining the bowl portion in said second position with essentially constant dynamic pelvic area support, wherein the user's center of gravity shifts forward away from the sacrum and onto the tips of the ischial tuberosities of the user's lower pelvic area, and continuous dynamic pressure is applied by the central portion and the lateral portion of the orthopedic device to user's ischial tuberosities by cradling and cupping user's gluteus muscles.

* * * * *